US006808001B2

(12) United States Patent
Jelic et al.

(10) Patent No.: US 6,808,001 B2
(45) Date of Patent: Oct. 26, 2004

(54) COVERING FOR A SIMULATED DIVIDED LIGHT ARCHITECTURAL OPENING AND SYSTEMS FOR MOUNTING SAME

(75) Inventors: Ralph G. Jelic, Boulder, CO (US); Paul F. Josephson, Longmont, CO (US); Barbara A. Forst Randle, Broomfield, CO (US); Jason T. Throne, Steamboat Springs, CO (US); Ronald L. Bowman, Golden, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/421,457

(22) Filed: Apr. 22, 2003

(65) Prior Publication Data

US 2003/0192651 A1 Oct. 16, 2003

Related U.S. Application Data

(62) Division of application No. 09/687,451, filed on Oct. 13, 2000, now Pat. No. 6,571,851.

(60) Provisional application No. 60/217,644, filed on Jul. 10, 2000, and provisional application No. 60/159,905, filed on Oct. 15, 1999.

(51) Int. Cl.[7] ..... E06B 9/08

(52) U.S. Cl. ..... 160/120

(58) Field of Search ..... 160/26, 25, 120, 160/121.1, 122, 98

(56) References Cited

U.S. PATENT DOCUMENTS

| | | | | | |
|---|---|---|---|---|---|
| 85,818 | A | | 1/1869 | Harding | 160/113 |
| 135,713 | A | * | 2/1873 | Johnson | 160/120 |
| 179,123 | A | * | 6/1876 | McGill | 160/120 |
| 901,715 | A | | 10/1908 | Lapres | 160/87 |
| 1,281,312 | A | | 10/1918 | Dutcher | 160/113 |
| 1,445,697 | A | * | 2/1923 | Love | 160/21 |
| 1,482,059 | A | | 1/1924 | Zimmer | 160/84.06 |
| 1,557,167 | A | * | 10/1925 | Ives | 160/30 |
| 2,139,580 | A | * | 12/1938 | Draper et al. | 160/120 |
| 2,607,963 | A | | 8/1952 | Ansel | 49/392 |
| 2,957,520 | A | | 10/1960 | Howard | 160/113 |
| 3,298,424 | A | | 1/1967 | Griffin | 160/113 |
| 3,308,872 | A | * | 3/1967 | Smith | 160/120 |
| 3,446,263 | A | | 5/1969 | Roth | 160/120 |
| 3,593,772 | A | | 7/1971 | Abraham | 160/84 |
| 4,565,230 | A | | 1/1986 | Van Rijn et al. | 160/84.01 |
| 4,768,576 | A | | 9/1988 | Anderson | 160/107 |
| 4,813,468 | A | | 3/1989 | Fraser | 160/84.03 |
| 4,979,551 | A | | 12/1990 | Schon | 160/84.1 |
| 5,016,701 | A | | 5/1991 | Vore | 160/241 |
| 5,195,569 | A | | 3/1993 | Peterson et al. | 160/84.06 |
| 5,265,373 | A | | 11/1993 | Vollebregt | 47/17 |
| 5,568,831 | A | * | 10/1996 | Blackwell | 160/98 |
| 5,787,951 | A | | 8/1998 | Tonomura et al. | 160/84.01 |

FOREIGN PATENT DOCUMENTS

| | | |
|---|---|---|
| GB | 2151682 | 7/1995 |

* cited by examiner

*Primary Examiner*—Blair M. Johnson
(74) *Attorney, Agent, or Firm*—Dorsey & Whitney LLP

(57) ABSTRACT

Various embodiments of an architectural covering insert primarily adapted for use in simulated divided light openings is disclosed. The insert includes an outer framework with horizontal and vertical dividers, a plurality of horizontally or vertically disposed shade components associated with one or more dividers and control means for moving the shade components between extended and retracted positions across simulated openings defined by the vertical and horizontal dividers. The shade components can be of the roller shade type or collapsible cellular type with the net result being that, from a visual standpoint, there are shade components associated with each individual simulated opening defined by the horizontal and vertical dividers, as opposed to a single shade that covers the entire architectural opening.

8 Claims, 68 Drawing Sheets

644
648
646
104
104
103
103
642
102
102
654
656
660
662
658
636
640

642
640
660
662
656
654
658
636

634
642
644

634
642
644
650
652

634

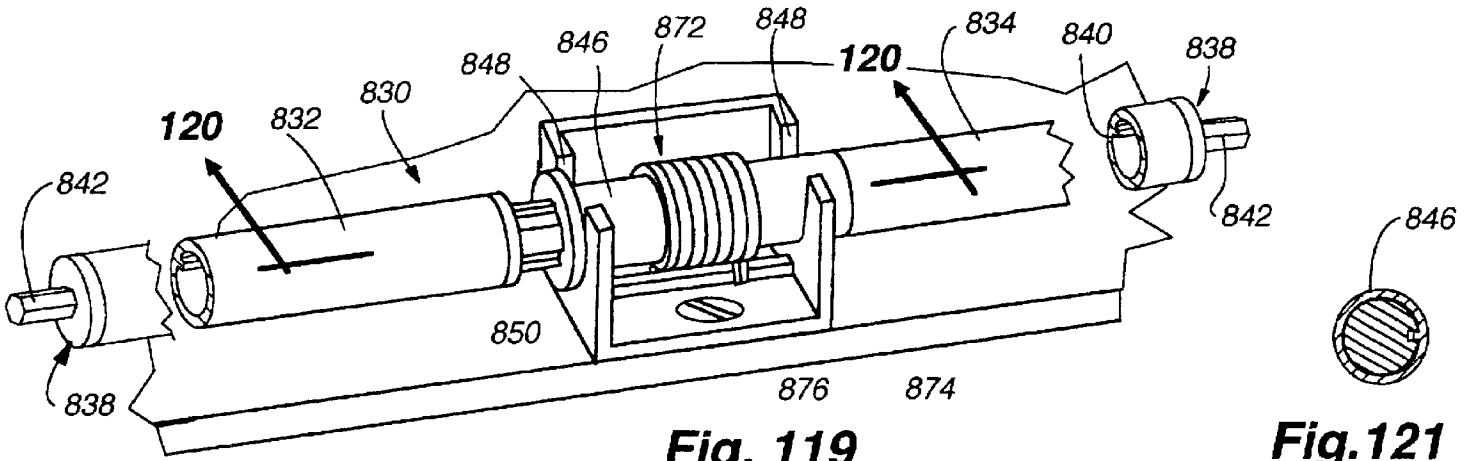
Fig.121
Fig. 119
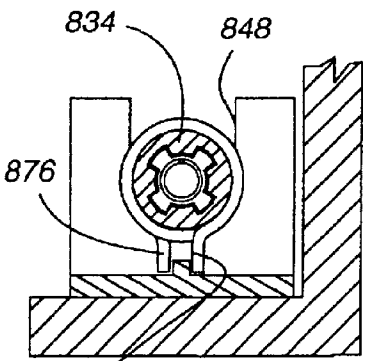
Fig. 122
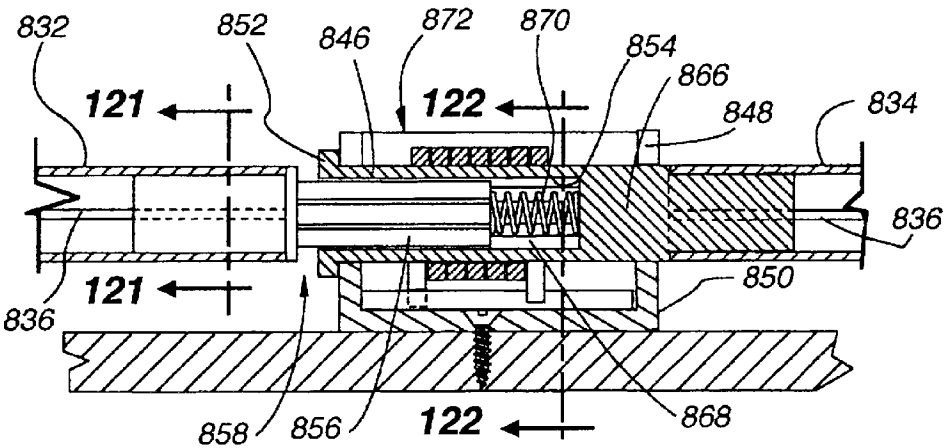
Fig. 120

COVERING FOR A SIMULATED DIVIDED LIGHT ARCHITECTURAL OPENING AND SYSTEMS FOR MOUNTING SAME

CROSS REFERENCE TO RELATED APPLICATIONS

This application is a divisional application of co-pending nonprovisional application Ser. No. 09/687,451, filed Oct. 13, 2000, allowed, U.S. Pat. No. 6,571,851 which claimed priority to provisional application Nos. 60/217,644 filed Jul. 10, 2000, and 60/159,905 filed Oct. 15, 1999.

BACKGROUND OF THE INVENTION

1. Field of the Invention

The present invention relates generally to coverings for architectural openings and, more particularly to an insert adapted to be placed in an architectural opening to simulate a divided light opening with the insert including a plurality of shade components to cover each simulated opening.

2. Description of the Relevant Art

Coverings for architectural openings have taken numerous forms for many years with early coverings simply consisting of fabric draped across the architectural opening in various aesthetic orientations. Draperies are another common form of covering wherein a fabric material is typically pleated along an upper marginal edge, and suspended along the top edge of an architectural opening and mounted so that the pleated material can be moved between an extended position across the architectural opening and a retracted position adjacent one or both sides of the architectural opening.

More recent coverings have taken the form of Venetian blinds wherein horizontal slats of material are suspended in spaced relationship in an architectural opening on tape ladders such that the slats can be elevated into a stacked relationship adjacent the top of the opening or suspended in uniformly spaced relationship across the architectural opening. The slats can further be rotated about their longitudinal axes to permit or block the passage of vision and light through the covering.

Similarly, vertical blinds have vertically oriented slats that operate very similarly to the horizontally oriented slats of a Venetian blind and, again, the vertically oriented slats can be evenly distributed across the opening or retracted adjacent to one or both sides of the opening. They further can be rotated about vertical axes to block or permit the passage of vision and light through the covering.

More contemporary shades have been referred to as cellular shades wherein adjacent interconnected cells are adapted to be extended across an architectural opening. The interconnected cells can also be collapsed or gathered adjacent the top or bottom of the architectural opening in a retracted position or wrapped around a roller in the retracted position. Some cellular products include horizontal or vertically extending vanes that can be manipulated to block or permit the passage of vision or light through the covering even when it is extended across the architectural opening.

Coverings of the aforenoted type are utilized in many types of architectural openings including windows, doors, archways and the like, and in the case of glass paneled architectural openings, it does not matter whether there is an opening with one large panel of glass or an opening with a plurality of individual smaller units of glass referred to as divided light openings.

In fact, large glass panels that may totally cover an architectural opening have been aesthetically divided into a plurality of smaller units by use of an insert having horizontal and vertical crisscrossing frame components that thereby define square or rectangular passages therethrough so that when the insert is positioned in overlying relationship with the large glass panel, the glass panel has the appearance of a plurality of smaller individual glass units. Such inserts have the advantage of being readily removable so that the larger glass panel can be easily cleaned. When an insert of this type is used, the opening is referred to as a simulated divided light opening.

The aforenoted coverings for architectural openings are typically designed to totally cover an entire architectural opening as opposed to individual smaller units within a divided light opening or a simulated divided light opening. It will be appreciated, however, that a totally different aesthetic look could be created with a covering for an architectural opening wherein each individual unit or various combinations of units defined in a simulated divided light opening had its own covering component.

An undesirable feature of prior art coverings for architectural openings resides in the fact that most of the coverings are operated by control cords which have been accepted for utilitarian purposes but are not necessarily aesthetically pleasing. A retractable architectural covering which did not require such cords would, therefore, be desirable.

It is further desirable in some environments to have a covering for an architectural opening which is retractably mounted for movement across the opening but which is totally hidden from view when in a retracted condition. In other words, in some environments, while it is desirable to have a covering that can be extended across an architectural opening to control vision and the passage of light, it may also be desirable that the covering be hidden from view when retracted so that an observer would not even realize the opening had a covering associated therewith.

It should also be appreciated that when moving a retractable covering between extended and retracted positions, which is typically accomplished with a pull or lift cord system, numerous pulling strokes by the operator of the covering may be required. In other words, to move a covering from a fully retracted to a fully extended position, an operator needs to apply several pulling strokes on the cord in order to obtain a full extension or retraction of the covering. Gearing could be provided to reduce the number of strokes necessary to fully move the covering between extended and retracted positions but the work required to move the covering is correspondingly increased. Accordingly, an improved system for extending and retracting coverings for architectural openings with a minimal stroke and no excessive work would be desirable.

It is to overcome the shortcomings in the prior art noted above that the present invention has been developed.

SUMMARY OF THE INVENTION

The architectural covering of the present invention takes the form of a framed insert sized and configured to overlie an architectural opening. By way of example, if the architectural opening were a window, having a glass panel therein, the insert would fit within the confines of the window frame so as to define a simulated divided light window having the appearance of a window with a plurality of small individual glass panels. The insert itself has vertical and horizontal dividers or muntins that are surrounded by a peripheral framework and each horizontal or vertical divider might include one or more covering components so that each simulated individual panel or unit defined by the insert has the appearance of a covering component associated therewith.

The covering components could take numerous forms such as a cellular shade, Venetian blind, roll up shade or the like. Accordingly, the covering components may be alternately referred to as shade components. The division of the covering for the architectural opening into a plurality of component units to cover one or more simulated panels in the architectural opening provides not only a unique appearance for an architectural covering but also a unique mechanism for unitarily operating each covering component simultaneously.

In accordance with the present invention, behind a vertical or horizontal divider or muntin in the insert, a roll-up or stacking mechanism is provided so as to be substantially invisible to someone within the building structure in which the insert is mounted. In a preferred embodiment of the invention, a simple manually operable slide is positioned along the framework for the insert so that movement of the slide in one direction causes the individual covering components to selectively extend across a simulated panel or panels to which they are associated and a sliding movement of the operable slide in the opposite direction causes the covering components to retract into a hidden position behind the horizontal or vertical divider.

It will be appreciated from the detailed description that follows that a covering in accordance with the present invention is designed to have at least first and second parallel but separated support elements on which retractable coverings are mounted. A drive mechanism is coupled to at least one of the support elements in a manner such that the plurality of coverings are operated from a single drive mechanism.

It will further be appreciated from the description that follows that the architectural covering is hidden when retracted and the drive mechanism for operating the covering is also substantially hidden so that an observer is virtually unaware that a covering exists when the covering is fully retracted.

Another feature of the present invention which will become apparent with the detailed description that follows resides in the fact that the operating system or drive mechanism for moving the covering between extended and retracted positions entails a mechanism that requires a very short stroke to fully move the covering between extended and retracted positions and without any additional effort than required for conventional architectural coverings.

Other aspects, features and details of the present invention can be more completely understood by reference to the following detailed description of the preferred embodiments, taken in conjunction with the drawings and from the appended claims.

BRIEF DESCRIPTION OF THE DRAWINGS

FIG. 105 is an enlarged fragmentary rear elevation of the upper right-hand corner of the covering as viewed in FIG. 94.

FIG. 106 is an enlarged fragmentary rear elevation of a portion of the rear of the covering as shown in FIG. 94 showing a slide bracket used in the covering.

FIG. 107 is a section taken along line 107—107 of FIG. 111.

FIG. 108 is a fragmentary enlarged section taken along line 108—108 of FIG. 105.

FIG. 109 is a fragmentary section taken along line 109—109 of FIG. 108.

FIG. 110 is a fragmentary section taken along line 110—110 of FIG. 108.

FIG. 111 is a fragmentary rear elevation showing a fixed bracket associated with the top roller of a shade component other than the uppermost shade component.

FIG. 112 is a fragmentary rear elevation showing the lowermost bracket used for supporting the transfer rod of the covering of FIG. 93.

FIG. 113 is a horizontal section taken through a slide bracket utilized to mount the bottom rail of each shade component.

FIG. 114 is a section taken along line 114—114 of FIG. 113.

FIG. 115 is a section taken along line 115—115 of FIG. 112.

FIG. 116 is a section taken along line 116—116 of FIG. 115.

Figure 93:
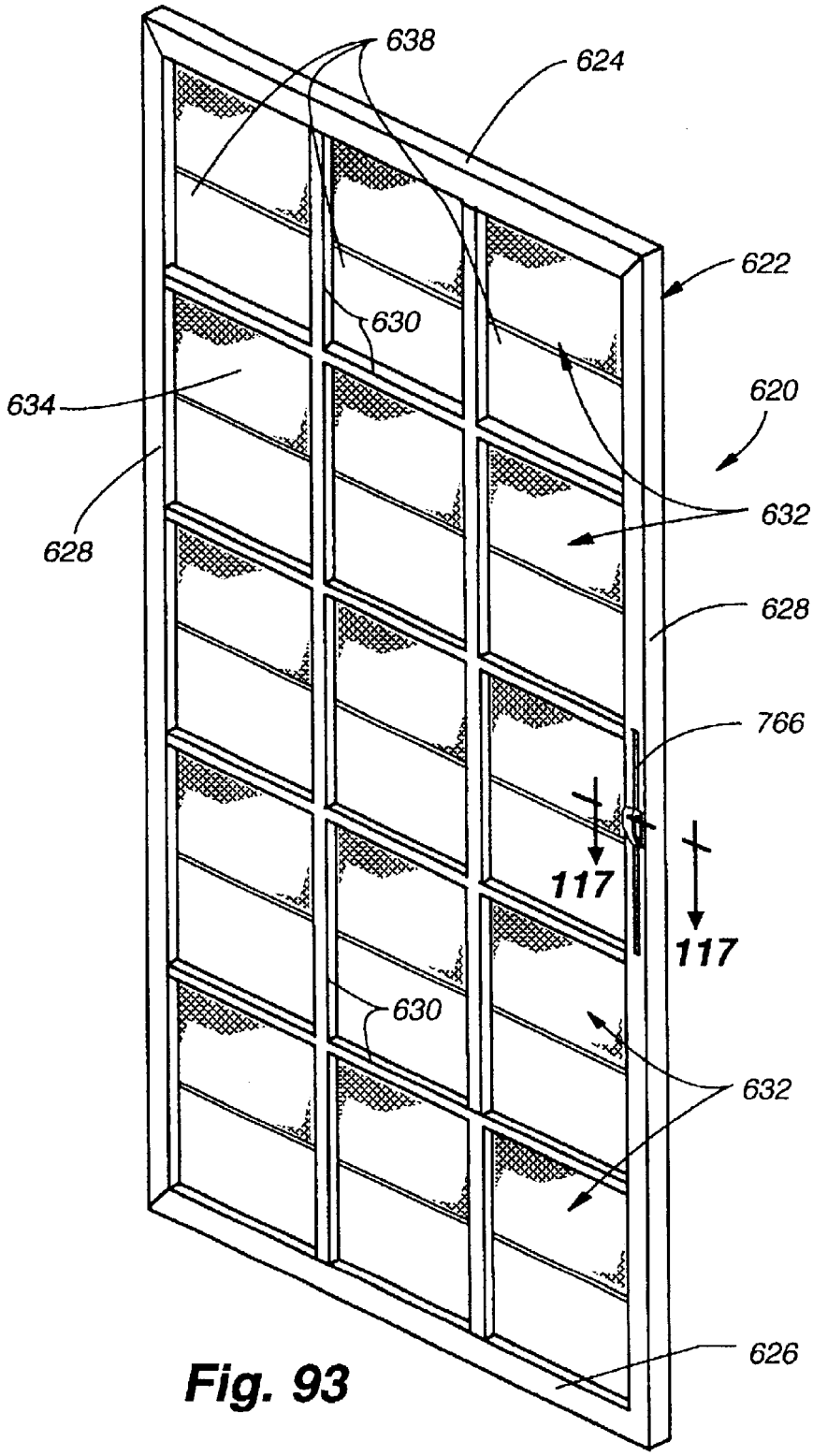
FIG. 93 is an isometric view of a further embodiment of the architectural covering of the present invention.
Figure 117:
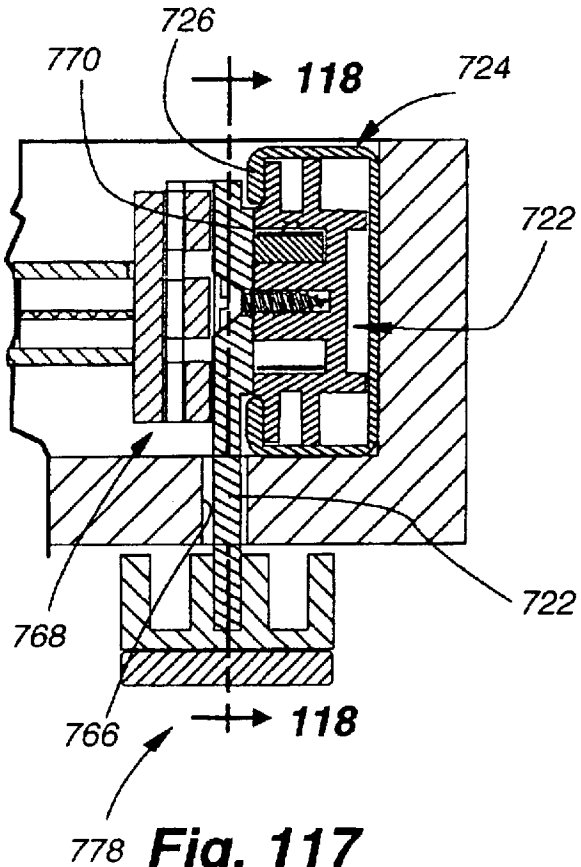

FIG. 117 is an enlarged section taken along line 117—117 of FIG. 93.

Figure 118:
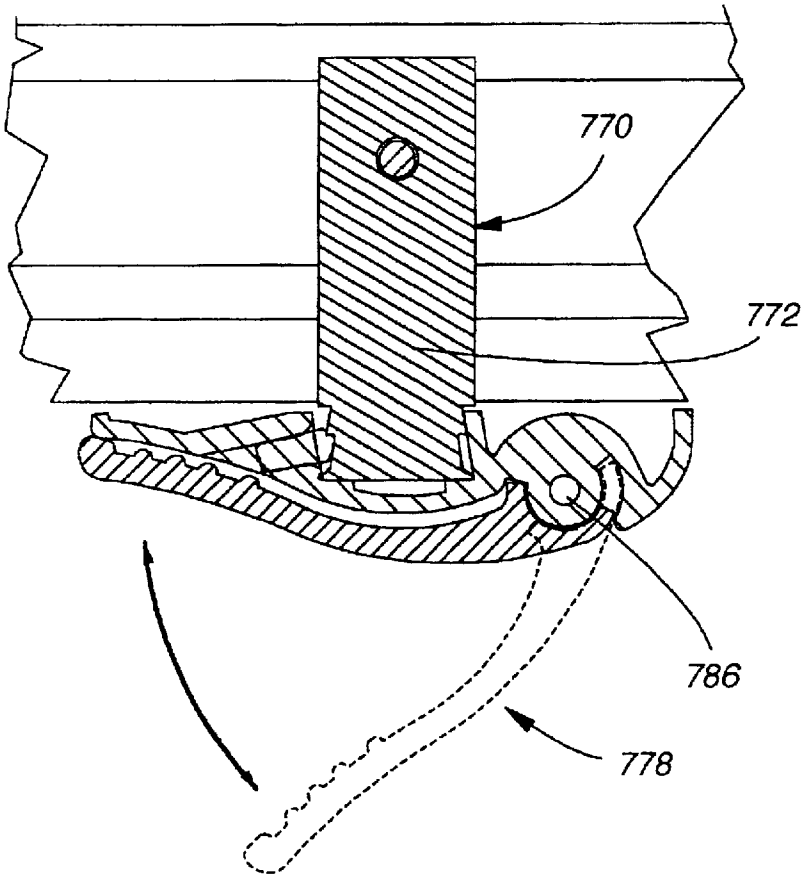

FIG. 118 is a section taken along line 118—118 of FIG. 117.

FIG. 119 is a fragmentary isometric looking downwardly at the center of the transfer rod used at the bottom of the covering shown in FIG. 93.

FIG. 120 is a section taken along line 120—120 of FIG. 119.

FIG. 121 is a section taken along line 121—121 of FIG. 120.

FIG. 122 is a fragmentary section taken along line 122—122 of FIG. 120.

Figure 123:
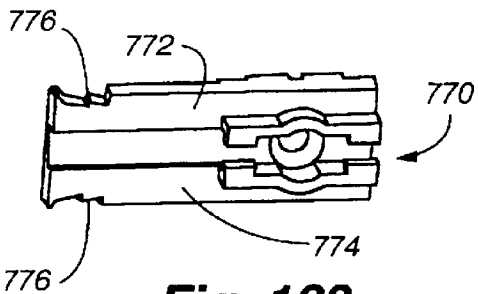

FIG. 123 is an isometric view of the male component of the slide bracket associated with the center shade component having a system for connecting a slide finger thereto.

Figure 124:
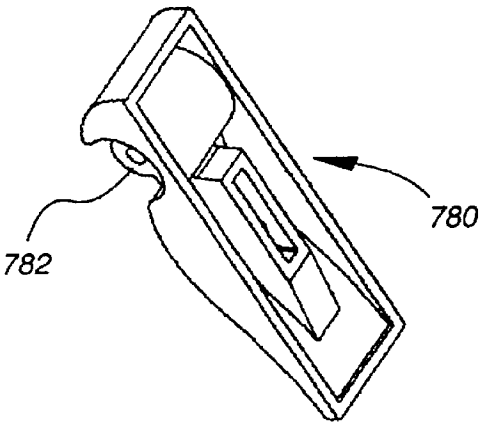

FIG. 124 is an isometric view of the rear of the base component of the slide finger.

Figure 125:
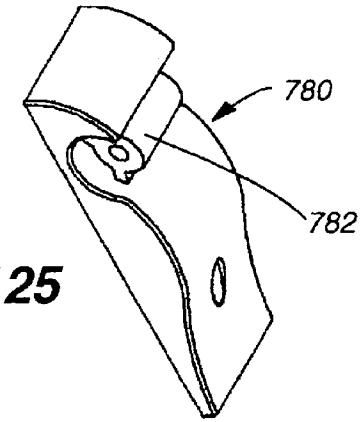

FIG. 125 is a front isometric of the base component of the slide finger.

Figure 126:
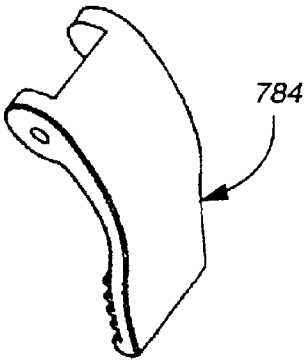

FIG. 126 is an isometric of the front of the pivot plate of the slide finger.

Figure 127:
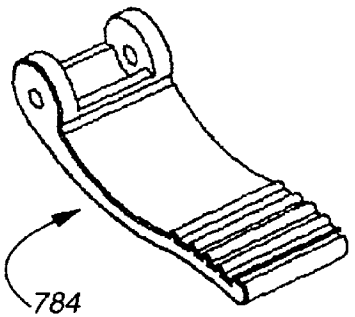

FIG. 127 is an isometric of the rear of the pivot plate of the slide finger.

Figures 128, 129, 129A, 130, 131, 131A, 132:
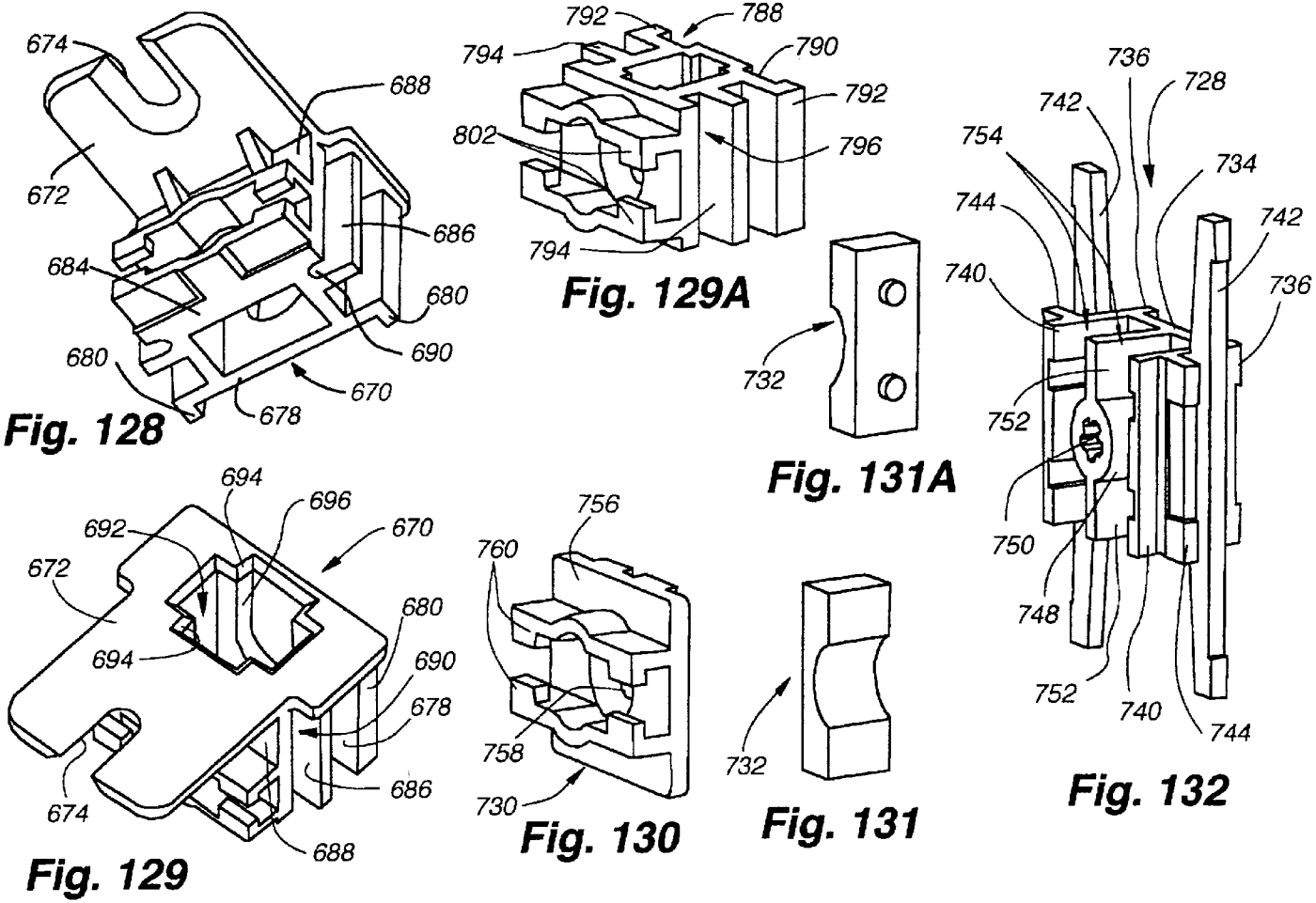

FIG. 128 is a rear isometric of the top bracket used to mount the roller for the uppermost shade component.

FIG. 129 is an isometric looking downwardly at the bracket illustrated in FIG. 128.

FIG. 129A is an isometric of a bracket used to mount to the frame members the roller of each shade component except the uppermost shade component.

FIG. 130 is an isometric view of connector component of the slide bracket used in the covering shown in FIG. 93.

FIG. 131 is an isometric view of one side of the anchor block used in the slide bracket.

FIG. 131A is an isometric view of the rear side of the anchor block used in the slide bracket.

FIG. 132 is an isometric view of the base component of the slide bracket.

Figure 133:
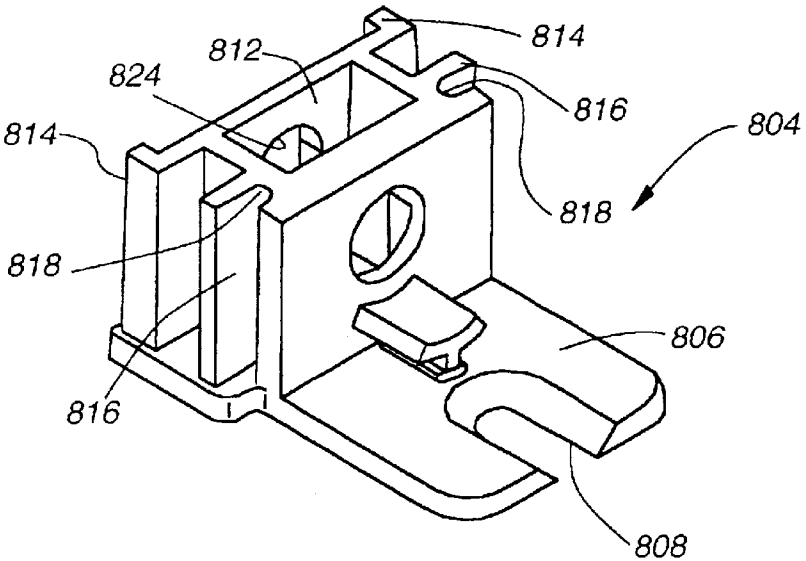

FIG. 133 is an isometric view looking downwardly on the bottom bracket used to support the transfer rod of the covering shown in FIG. 93.

Figure 134:
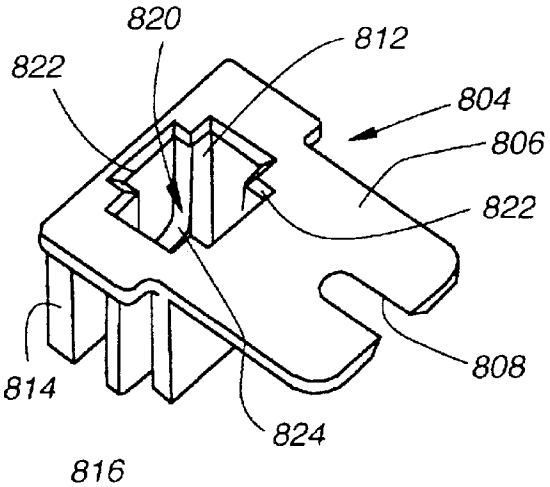

FIG. 134 is an isometric looking upwardly at the bottom of the bracket shown in FIG. 133.

Figure 135:
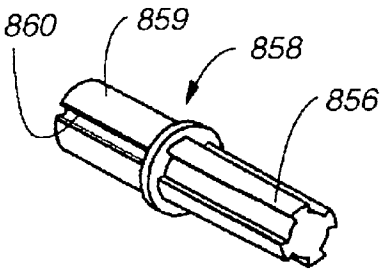

FIG. 135 is an isometric view of a shaft component used in the transfer bar of the covering of FIG. 93.

Figure 136:
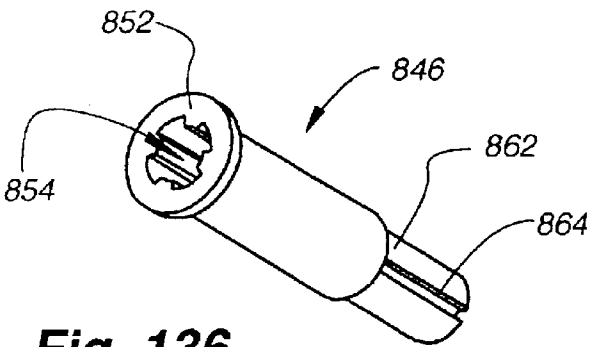

FIG. 136 is an isometric of a sleeve component of the transfer rod used in the covering of FIG. 93.

DESCRIPTION OF THE PREFERRED EMBODIMENTS

Figure 1:
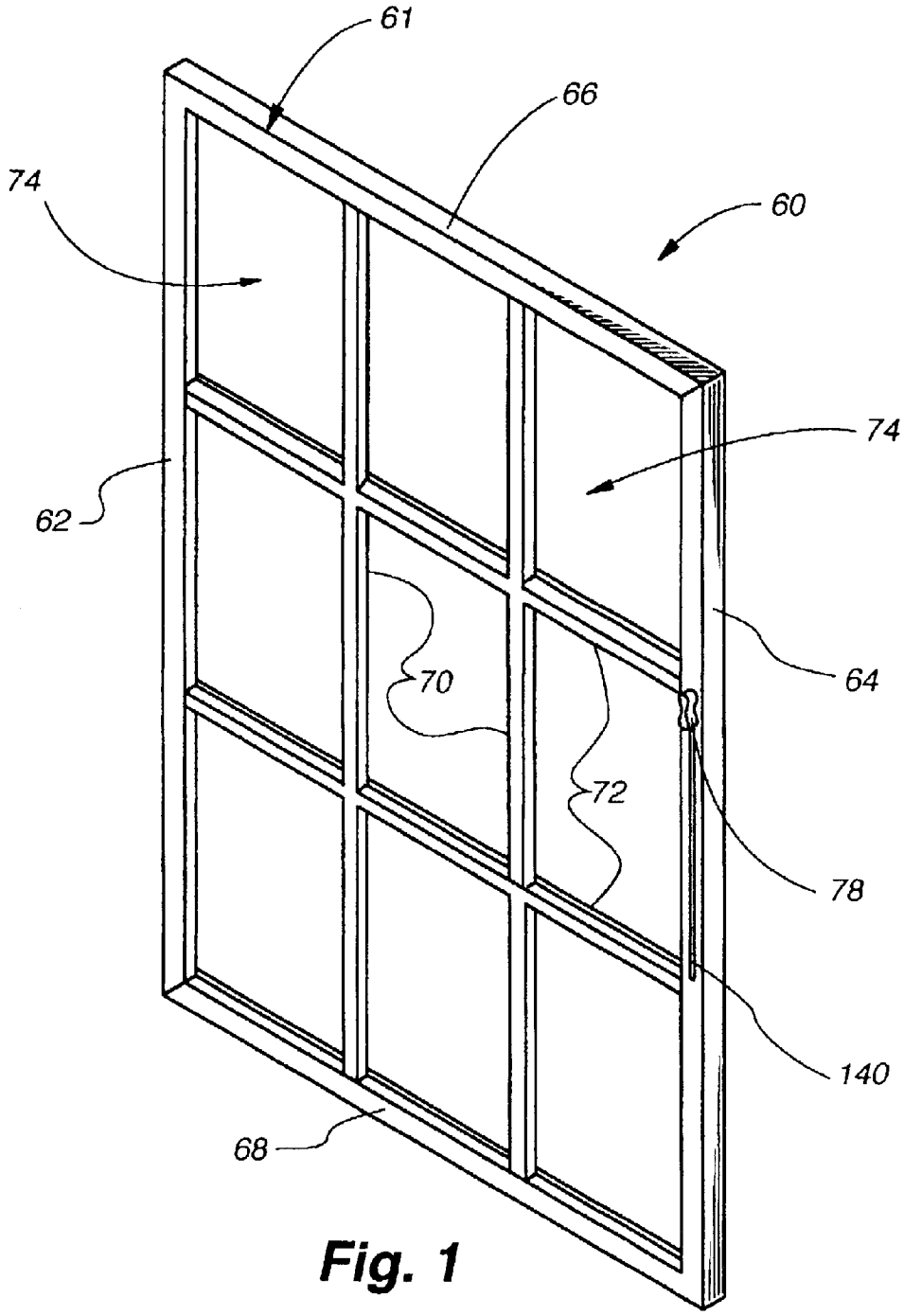
FIG. 1 is a front isometric of an insert for a simulated divided light window in accordance with the present invention and with the covering component associated with the insert in a retracted position.
Figure 2:
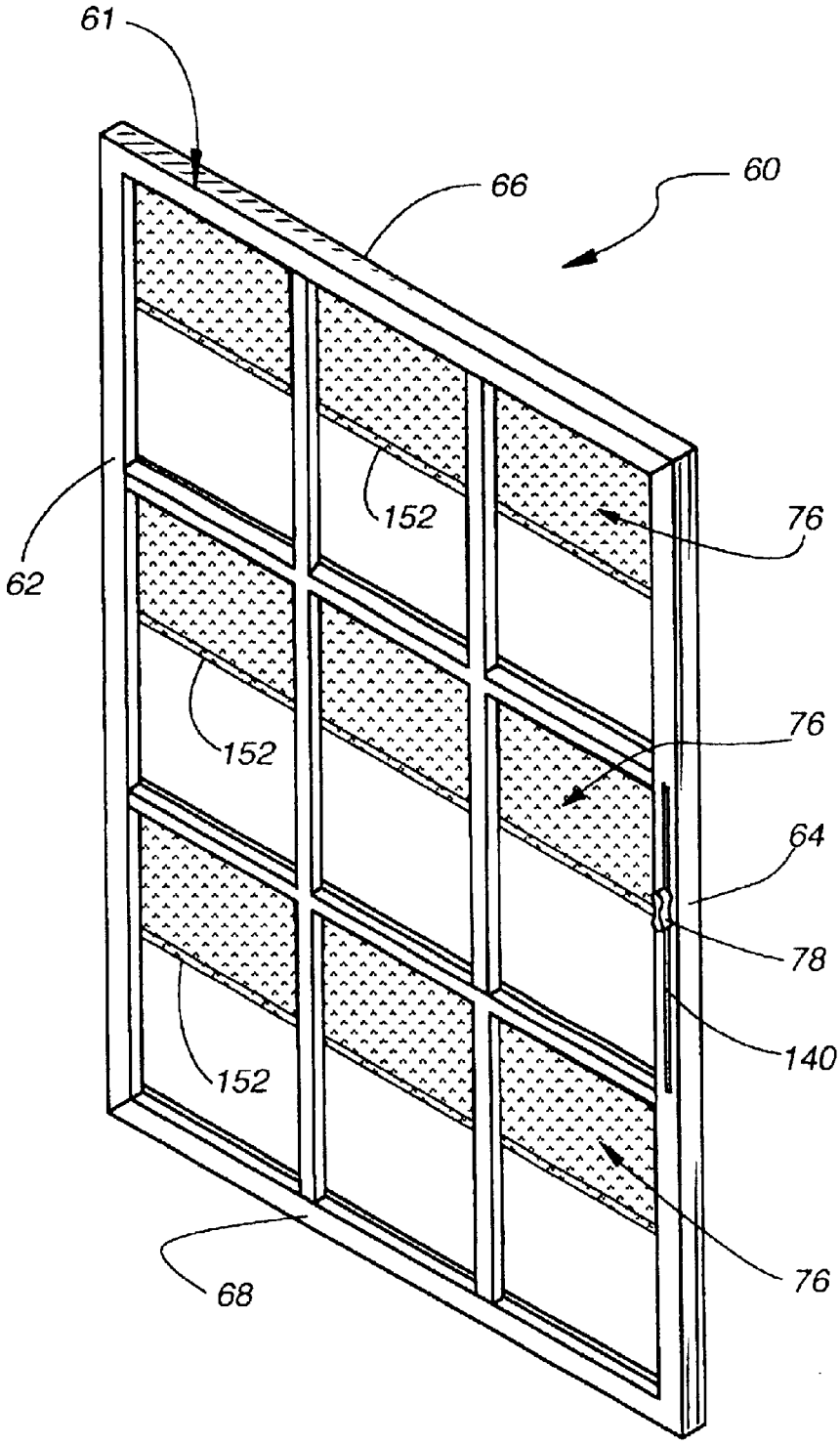
FIG. 2 is an isometric similar to FIG. 1 with the covering components in a partially extended position.
Figure 3:
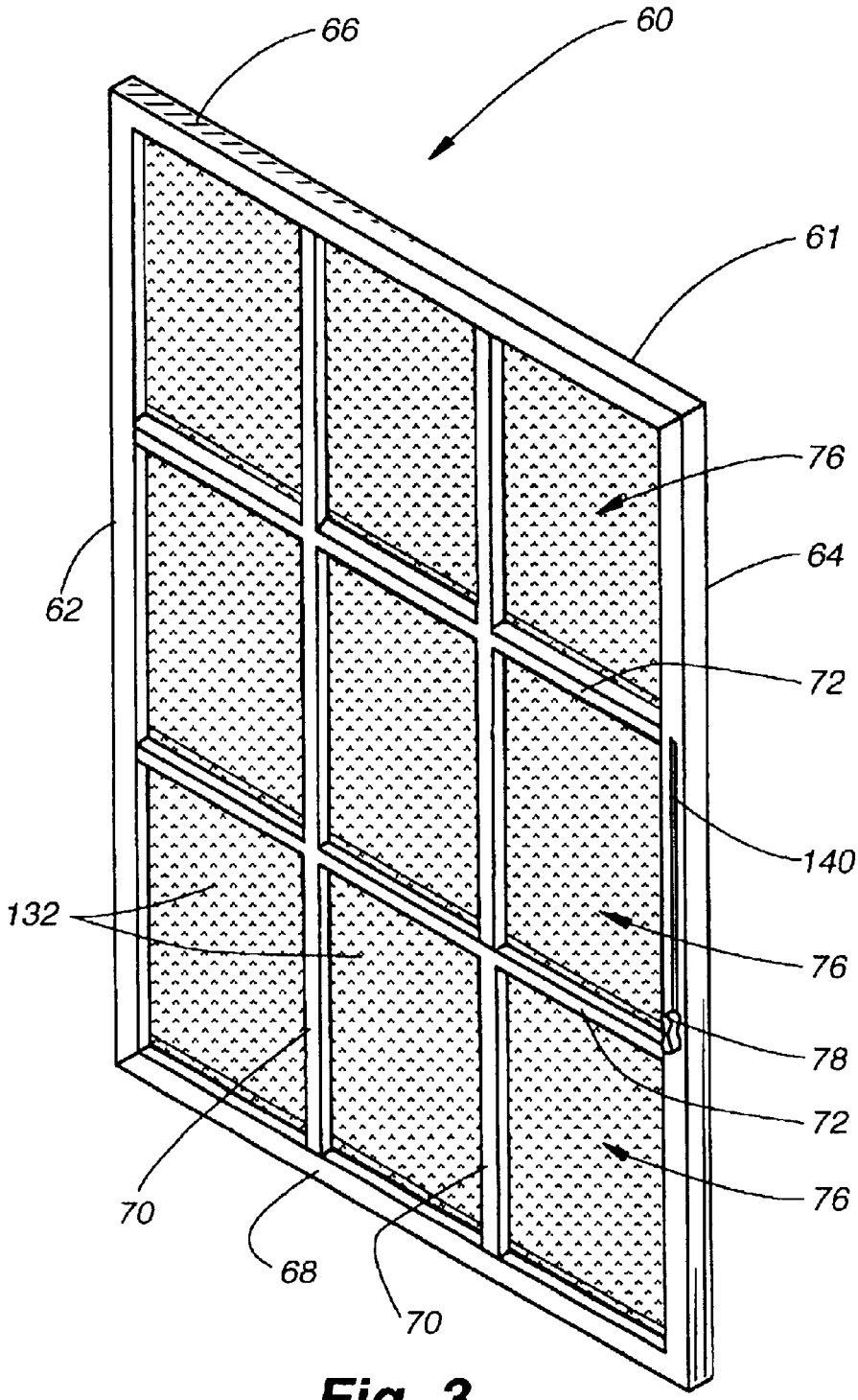
FIG. 3 is an isometric similar to FIG. 1 with the shades in a fully extended position.
Figures 4, 5:
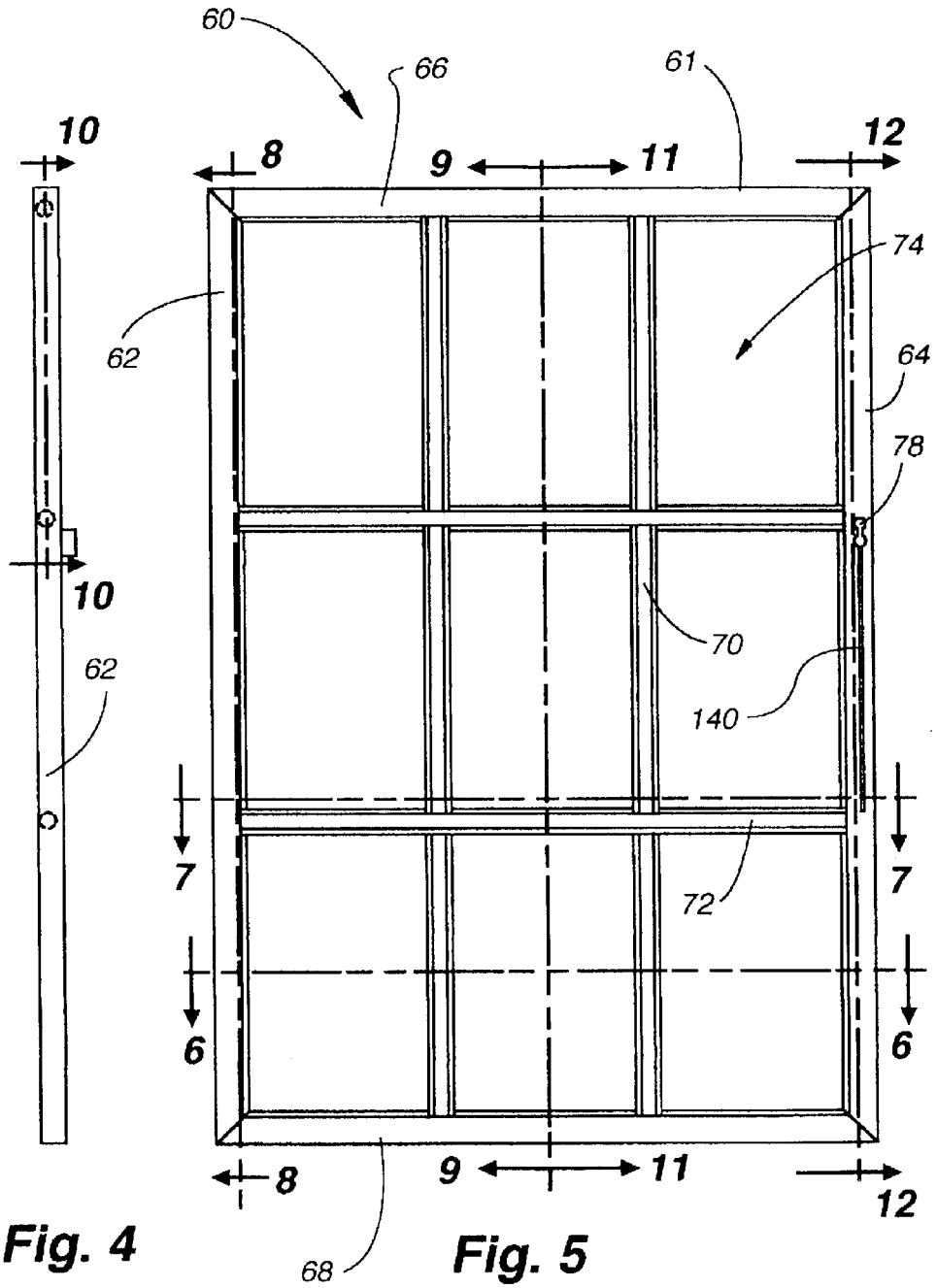
FIG. 4 is a left side elevation of the insert shown in FIG. 1.
FIG. 5 is a front elevation of the insert shown in FIG. 1.
Figure 6:
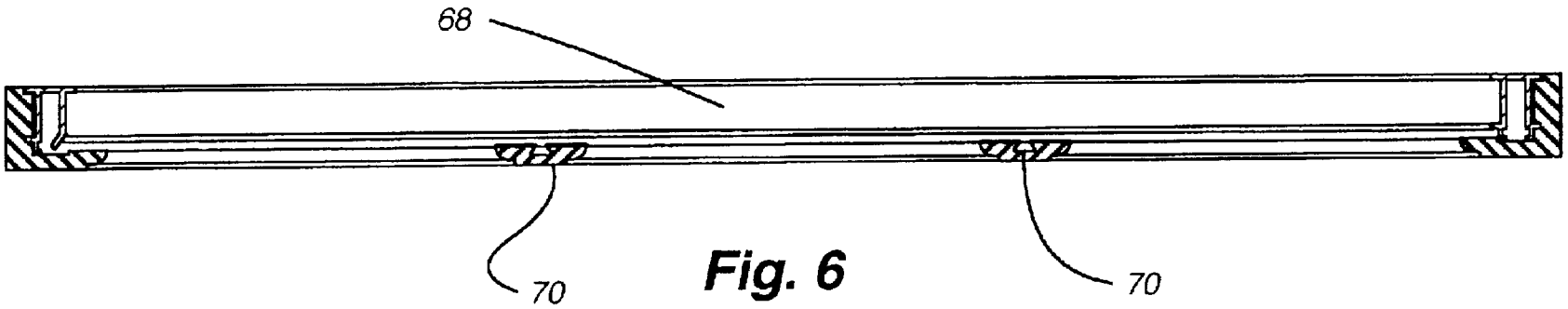
FIG. 6 is an enlarged section taken along line 6—6 of FIG. 5.

Referring first to FIGS. 1–3, an insert covering 60 for an architectural opening (not shown) is illustrated. The insert-type covering is adapted to cooperate with an architectural opening such as a window, so as to convert the aesthetics of the window from a single pane picture window to a simulated divided light window. Depending upon architectural desires, windows found in building structures may have single panes of undivided glass or the windows may be divided light windows wherein a plurality of muntins or dividers separate a plurality of smaller panels of glass. The muntins are typically vertical and horizontal dividers which support glass panels within the quadrangular openings defined by the muntins. More recently, simulated divided light windows have become popular with these windows being formed with a single large pane of glass and a framed insert having peripheral frame members along the edges of the large pane and muntins or cross frame members interconnecting opposed peripheral frame members placed against the internal face of the glass so as to simulate a divided light window. In other words, the window opening appears to have a plurality of smaller glass panels but in reality it is one large glass panel. Such systems are desirable for cleaning purposes as the insert can be removed so that one large panel of glass can be cleaned in a quicker and more efficient manner than the plurality of smaller independent panels found in divided light windows. The expense of a simulated divided light window is also less than a real divided light window.

While the present invention will be described in connection with a window type architectural opening, it will be apparent to those skilled in the art that it is applicable to other types of architectural openings such as doorways where, for example, the invention would be mounted on a door.

The present invention incorporates a retractable covering or shade component into a simulated divided light window system and does so by incorporating retractable shade or curtain panels into an insert of the type that can be positioned adjacent to the inner face of a glass pane. The insert thereby forms a simulated divided light window while providing retractable shades or coverings for the window.

As seen in FIGS. 1–3, the insert 60 of the present invention includes an outer or peripheral framework 61 having left and right vertical frame members 62 and 64, respectively, and upper and lower horizontal frame members 66 and 68, respectively, which are mitered at their corners to form a continuous peripheral outer frame for the insert. Vertical and horizontal cross frame members, muntins or dividers 70 and 72, respectively, are positioned within the space defined by the outer peripheral frame thereby dividing the larger opening of the peripheral frame into smaller quadrangular openings 74. In the illustrated embodiment, there are two vertical dividers 70 and two horizontal dividers 72 so as to define nine openings or units 74 that will simulate smaller glass panels of a window opening when placed in a window opening. In accordance with the present invention, retractable shade components 76 are positioned behind the horizontal dividers 72 and also the upper horizontal frame member 66 of the peripheral frame so that in a retracted position, the shade components are hidden from view as illustrated in FIG. 1 and are mounted along spaced parallel paths. The shade components 76 are shown partially extended in a downward direction in FIG. 2. Full extension of the shade components is illustrated in FIG. 3. It will be appreciated that each shade component is capable of vertical extension and retraction across the space defined between adjacent horizontal dividers 72. The covering insert has the appearance of having a separate shade component for each divided opening 74 in the insert even though in reality, in the embodiment illustrated, there are only three shade components, with each shade component or covering being associated with three horizontally adjacent openings 74 in the insert. A control system, which will be defined hereafter, for moving the shade components between the retracted position of FIG. 1 and the extended position of FIG. 3 is operated by a finger slide 78 that in the illustrated embodiment is positioned in the right hand vertical frame member 64 so as to be substantially unnoticeable.

It should also be pointed out that while various embodiments of the present invention will be described hereafter, in many of these embodiments, the shade components 76 can be made to move vertically as illustrated in FIGS. 1–5 or horizontally with the shade components mounted behind vertical dividers 70 as opposed to the horizontal dividers 72 as shown in FIGS. 1–5. In either event, the shade components are substantially hidden from view when retracted.

Also, while the shade components described are associated with a plurality of side-by-side openings 74 in the insert, separate shade components 76 could be utilized in association with each opening 74 in the insert as would be apparent to one skilled in the art.

Figure 19:
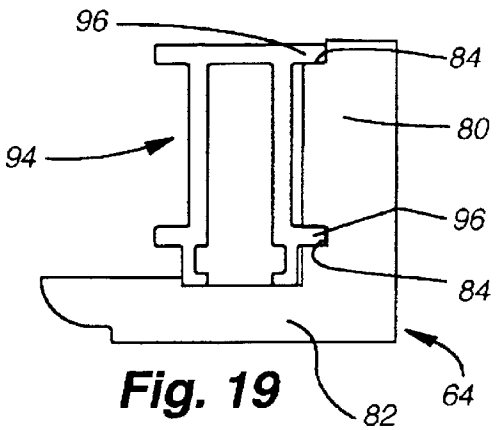
FIG. 19 is an end view of the right vertical frame member used in the insert of FIG. 1.
Figure 17:
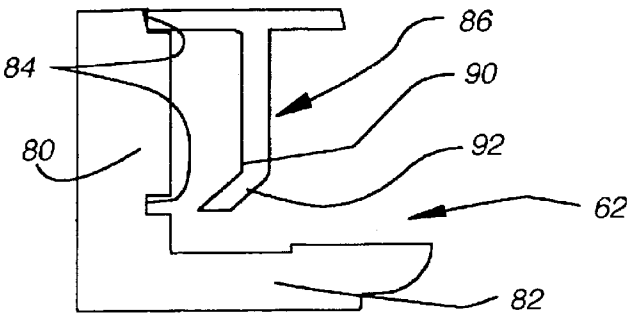
FIG. 17 is an end view of the left vertical frame member of the insert shown in FIG. 1.

Referring next to FIGS. 17 and 19, preferred embodiments are shown for the left and right vertical frame members 62 and 64, respectively. FIG. 17 illustrates the left vertical frame member 62 and it can be seen to be of generally L-shaped cross-section having a vertical leg 80 and a horizontal leg 82. The vertical leg has a pair of spaced notches 84 formed therein. The vertical leg in reality extends from the front of the peripheral frame 61 defined by the horizontal leg 82, rearwardly toward a glass panel (not shown) as might be found in a window opening. The notch 84 formed in the upper end of the vertical leg, which would be adjacent to the window pane, receives an edge of an elongated bracket member 86 that is adapted to support one end of rollers 88 (FIG. 15) forming part of each shade component 76. The elongated bracket member 86 is generally T-shaped in cross-section with the main body 90 of the T-shaped bracket being flexible and having a tapered lower end 92 to facilitate guiding movement of one end of a roller for a shade component. The T-shaped bracket can be adhesively secured or otherwise rigidly bonded to the left vertical frame member 62 so that the bracket is suitably mounted for supporting a plurality of rollers along the length of the left vertical frame member in a manner to be described later.

Referring to FIG. 19, the right vertical frame member 64 is illustrated and is shown to be a mirror image of the left vertical frame member. An inverted U-shaped bracket 94 is mounted on the right vertical frame member for receiving and supporting the opposite or right end of the rollers 88 of the shade component with the elongated inverted U-shaped bracket having a pair of protruding ribs 96 that are received in the notches 84 in the vertical leg 80 of the bracket and are secured therein in any suitable manner such as with adhesive, ultrasonic bonding, heat welding or the like. It will be appreciated that both the left and right brackets for supporting the rollers extend the full length of the associated left and right frame members and thus the full height of the insert. They are also hidden from view when seen from the interior of the building structure in which the insert is mounted by the horizontal leg 82 of the left and right side vertical frame members as illustrated in FIGS. 17 and 19. The upper and lower frame members 66 and 68, respectively, of the peripheral frame can take on any suitable form including the form illustrated in FIGS. 17 and 19 for the vertical frame members, but mounting brackets for the rollers are not secured to the upper and lower frame members and, accordingly, their design is not as critical.

Figure 18:
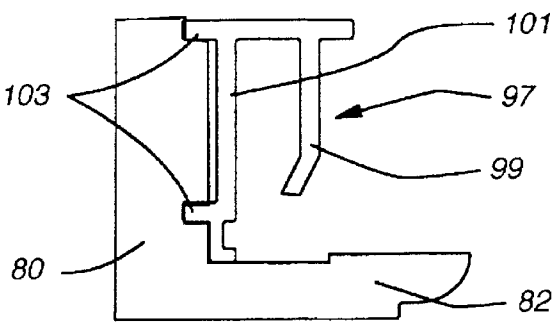
FIG. 18 is a view similar to FIG. 17 showing an alternative arrangement of the left vertical frame member.

FIG. 18 illustrates an alternative embodiment 97 for the elongated bracket that is mounted in the left vertical frame member, with this bracket being very similar to the inverted U-shaped bracket 94 shown in FIG. 19 except that the innermost leg 99 of the bracket is shaped like the main body of the T-shaped bracket 86 illustrated in FIG. 17. In other words, the bracket 97 has one outer leg 101 with ribs 103 that are received in the notches 84 in the left vertical frame member and are anchored therein in any suitable manner such as with adhesive, ultrasonic bonding, heat welding or the like. The other leg 99 of the bracket is flexible and has a tapered lower end so that one end of a roller 88, as will be appreciated with the description that follows, can be easily and removably connected to the bracket.

Figure 19A:
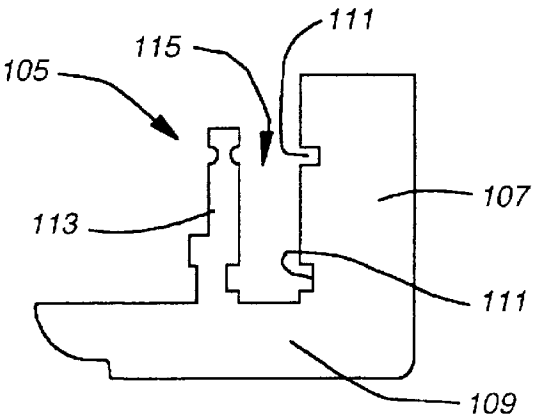
FIG. 19A is a view similar to FIG. 19 showing an alternative arrangement of the right vertical frame member of the insert of FIG. 1.

FIG. 19A shows an integrated embodiment of the vertical frame members. As will be appreciated, in the integrated embodiment 105 of the vertical frame members, the vertical 107 and horizontal 109 legs are substantially identical even though notches 111 in the vertical leg are placed at different locations. In addition to the vertical and horizontal legs, an upstanding rib 113 extends parallel to the vertical leg 107 in spaced relationship therewith so as to define a channel 115 therebetween. The channel therebetween is very similar to the channel defined in the inverted U-shaped bracket 94 described previously in connection with FIG. 19. The vertical leg 107 and the parallel rib 113 are each appropriately notched and deformed so that they accommodate the various needs described previously in connection with the left and right vertical frame members and needs that will become more apparent with the description that follows.

Figure 15:
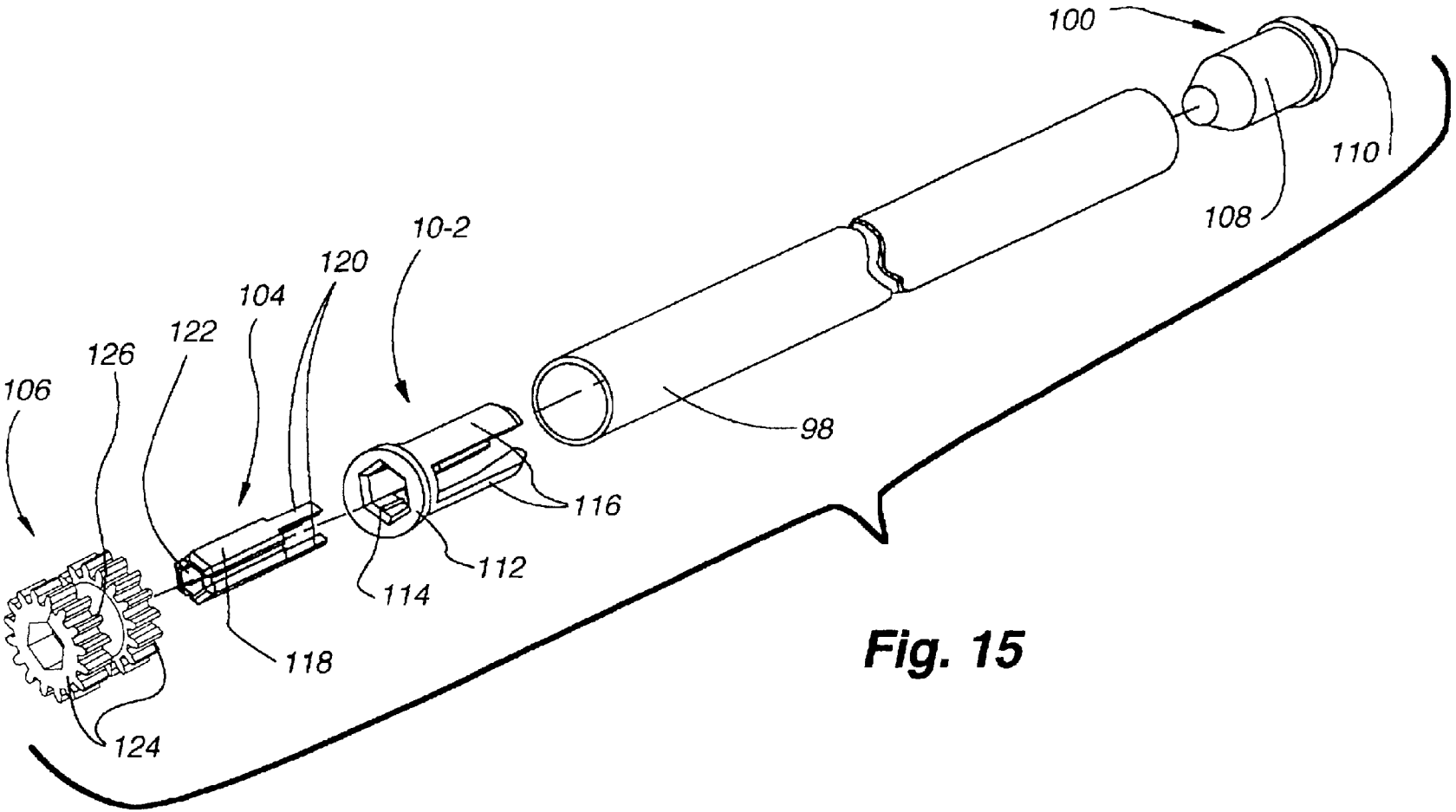
FIG. 15 is an exploded isometric showing the roller for a shade utilized in the insert illustrated in FIG. 1.

The rollers 88 of the individual shade components 76 are probably best seen in FIG. 15 to include a cylindrical main body 98, a male plug 100 at one end and a female plug 102 at the opposite end, with the female plug being adapted to releasably axially receive a drive shaft 104 that supports on its distal end a dual spur gear 106. The cylindrical main body can be made of any suitable material but preferably a light weight but structurally strong material, such as plastic. The male plug has a main body 108 adapted to be tightly received in the associated open end of the cylindrical main body 98 so as to move in unison therewith. The male plug includes a reduced diameter hemispherical protrusion 110 that cooperates with the mounting bracket 86 on the left vertical frame member, as will be described later. The female plug has a disk-like outer end 112 with a hexagonal opening 114 therethrough and three axially extending somewhat rigid resilient legs 116 adapted to be inserted into the associated open end of the cylindrical main body 98. The resilient legs are spaced and dimensioned so as to form a tight fit within the cylindrical main body. The female plug is releasably retained in place such that it, too, will move in unison with the cylindrical main body 98. The drive shaft 104 has a central body portion 118 of hexagonal configuration and also has three axially protruding somewhat rigid flexible legs 120. The main component of the central body portion 118 has a hollow hexagonal interior 122. The three flexible legs 120 of the drive shaft are adapted to frictionally engage and grip interior surfaces of the legs 116 of the female plug so that the drive shaft rotates with the plug and with the main cylindrical body 98 of the roller. The dual spur gear is an integral unit defining a separate but integrated spur gear 124 at each axial end thereof with the spur gears being spaced by a channel 126 of concave cylindrical cross-sectional configuration. The dual spur gear has a hexagonal passage 124 therethrough sized and configured to receive the drive shaft so that the dual spur gear rotates with the drive shaft and the cylindrical main body of the roller.

Figure 13:
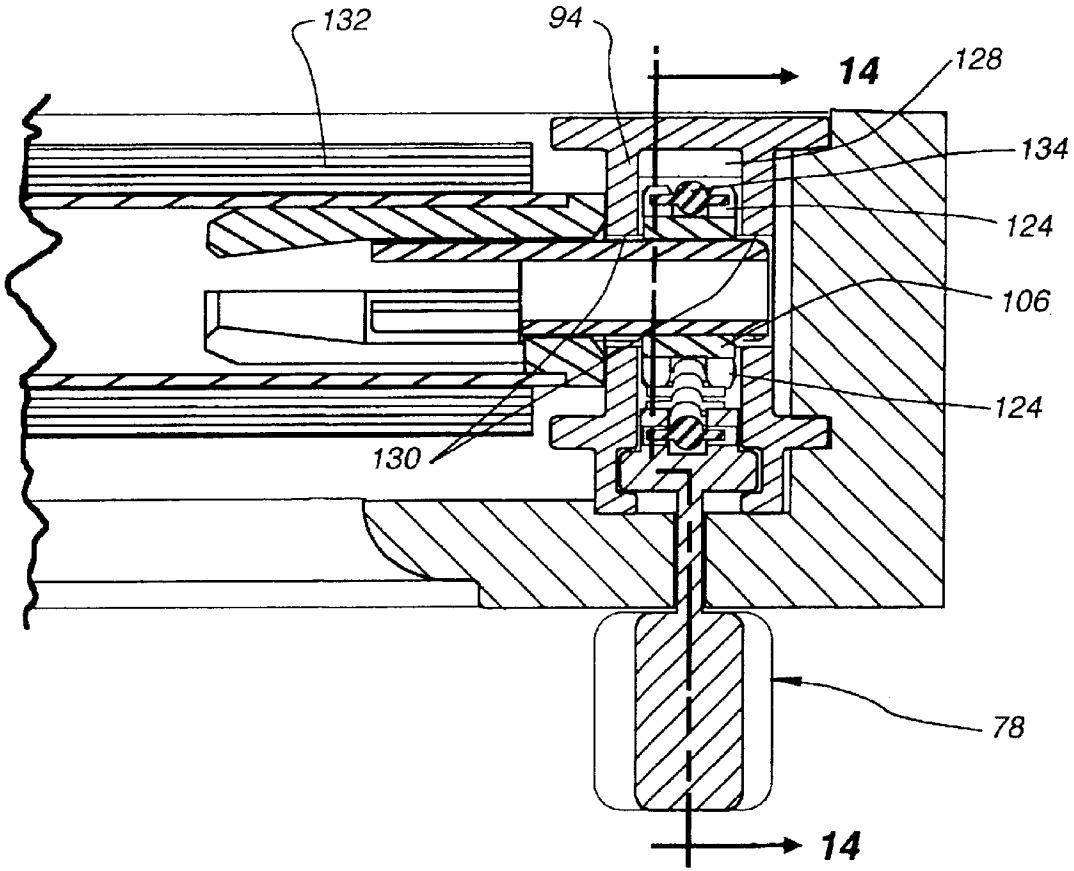
FIG. 13 is a fragmentary enlarged section taken along line 13—13 of FIG. 12.
Figure 13A:
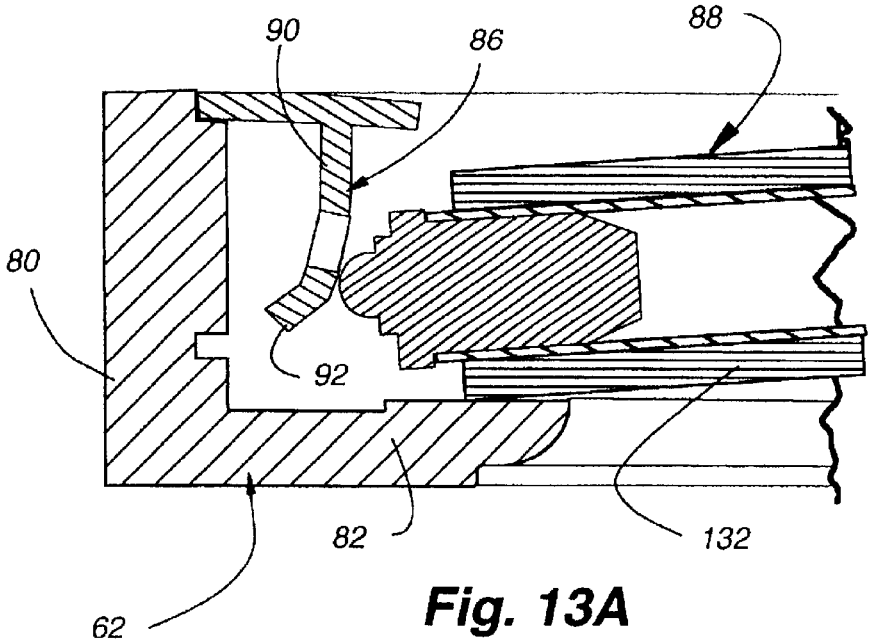
FIG. 13A is a fragmentary vertical section illustrating the mounting of the left end of a shade roll to its supporting bracket.
Figure 13B:
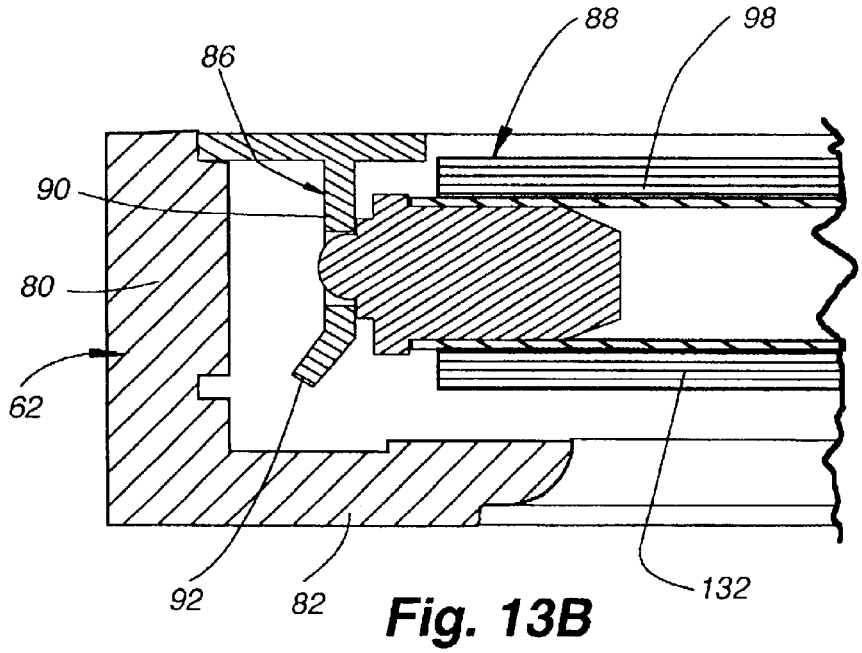
FIG. 13B is a view similar to FIG. 13A showing the roll rotatably supported by the bracket.

Referring to FIGS. 13A and 13B, the male plug 100 at the end of a roller 88 is shown being moved into operative relationship with the support bracket 86 in the left vertical frame member. The main body 90 of the T-shaped bracket has vertically aligned holes 126 therethrough at periodic intervals along the length of the bracket but at a minimum at locations where the horizontal muntins or dividers 72 are located. The hemispherical protrusion 110 of the male plug is engaged with the tapered lower end 92 of the main body of the T-shaped bracket and slid therealong until it is releasably seated in a desired hole 126, as seen in FIG. 13B. With the male plug received in the hole, it is supported for rotatable movement about the longitudinal axis of the cylindrical main body 98. It will be appreciated also that the roller is spatially fixed in position relative to the remainder of the insert 60 so that it is hidden behind an associated horizontal divider 72.

With reference to FIG. 13, the end of the roller 88 that carriers the dual spur gear 106 is operatively mounted in the inverted U-shaped bracket 94 of the right vertical frame member 64. The dual spur gears are disposed within a channel 128 defined by the inverted U-shaped bracket. A plurality of horizontal passages or aligned holes 130 are provided through the legs of the U-shaped bracket to receive the drive shaft 104 so as to support the drive shaft at a fixed location behind a horizontal divider 72 of the insert. The passages 130 through the legs of the inverted U-shaped bracket are provided at fixed intervals along the length of the bracket but at a minimum at locations aligned with a horizontal divider 72 so that the roller supported thereby is horizontally aligned with a horizontal divider and supported at opposite ends for rotational movement about its longitudinal axis. The passages 130 are sufficiently larger in diameter than the drive shaft 104 so that the roller can be tilted for insertion into the T-shaped bracket 86 after having been positioned at the opposite end in the inverted U-shaped bracket 94.

Figure 7:
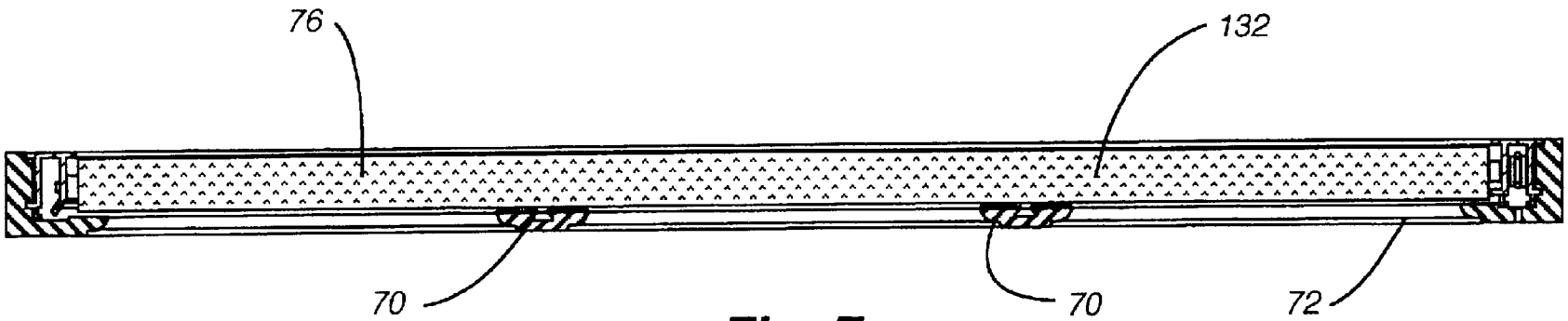
FIG. 7 is an enlarged section taken along line 7—7 of FIG. 5.
Figure 8:
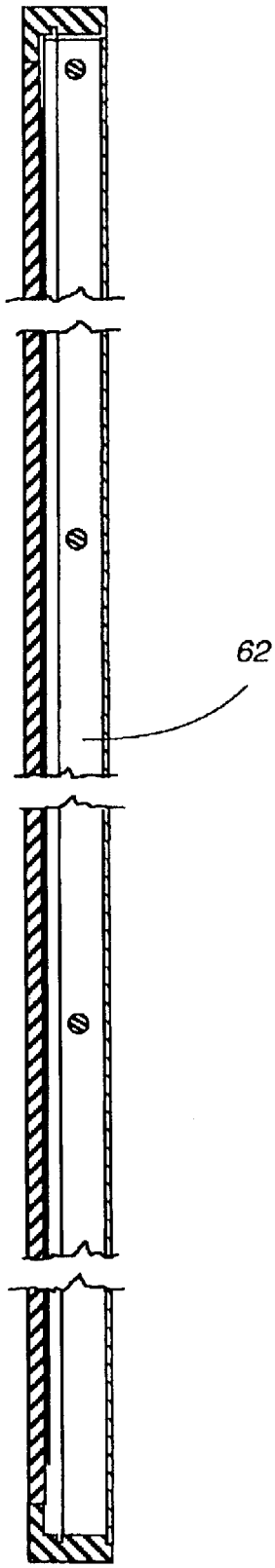
FIG. 8 is an enlarged section with parts removed taken long line 8—8 of FIG. 5.
Figure 9:
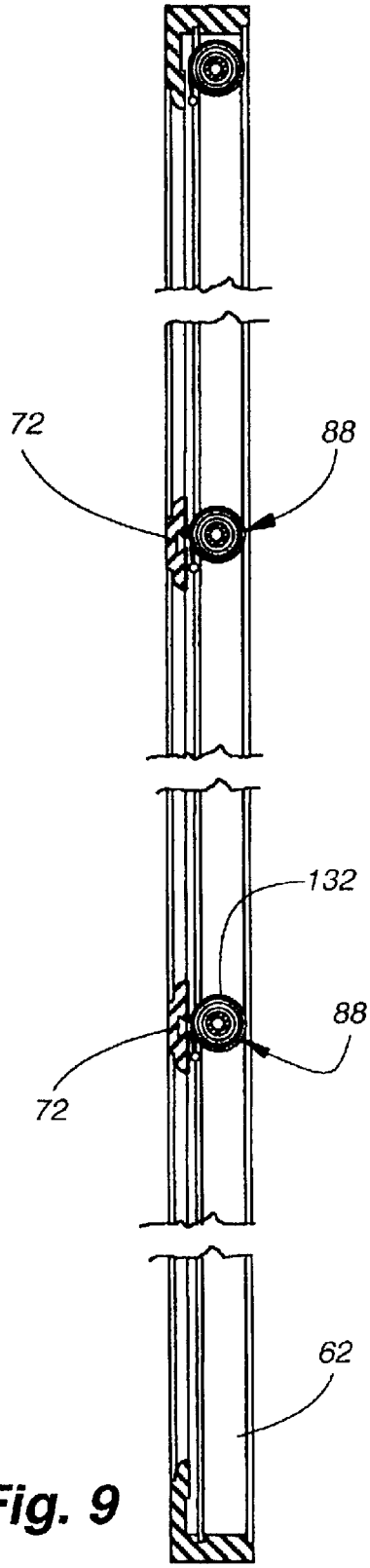
FIG. 9 is an enlarged section with parts removed taken along line 9—9 of FIG. 5.
Figure 10:
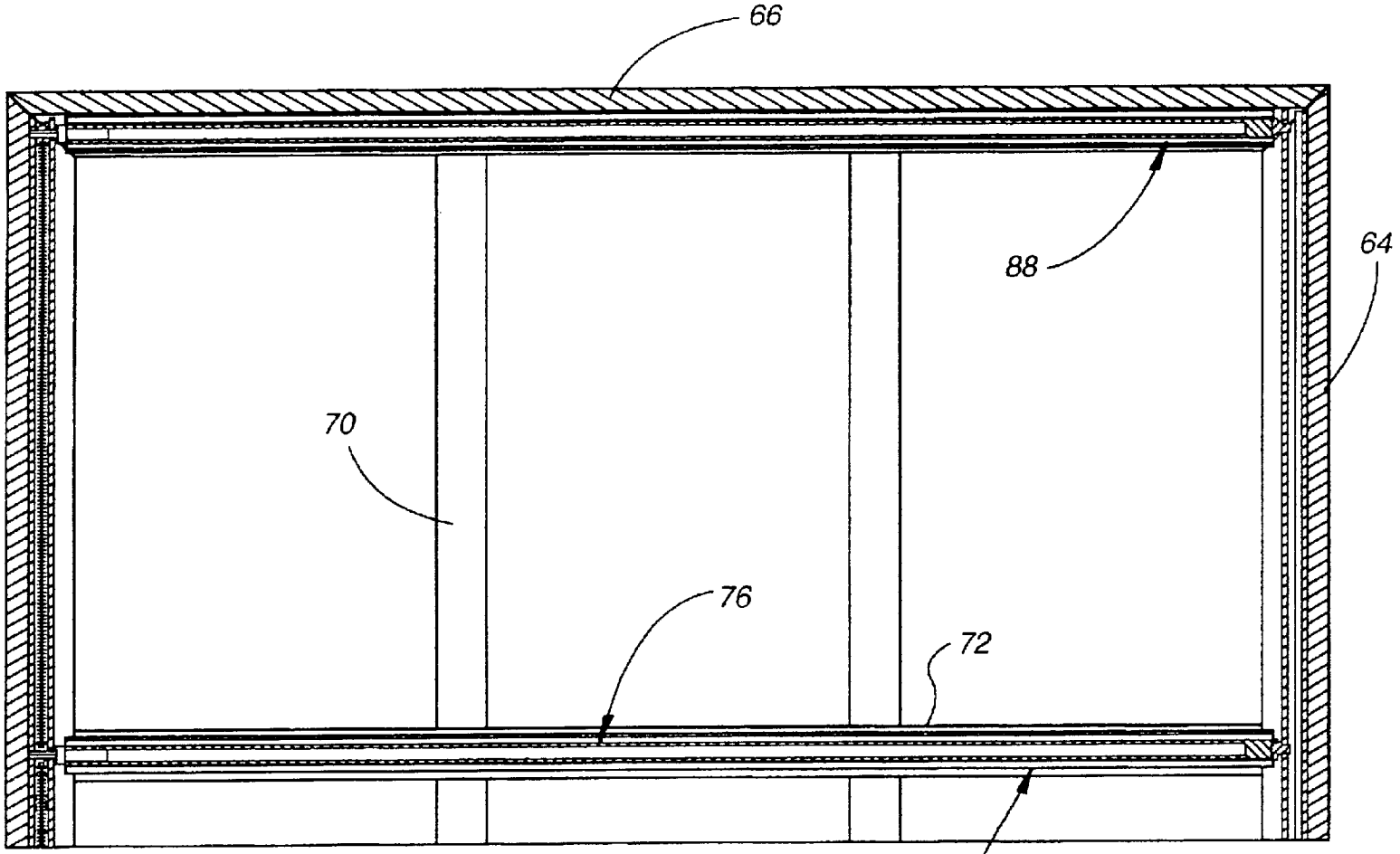
FIG. 10 is an enlarged section taken along line 10—10 of FIG. 4.
Figure 11:
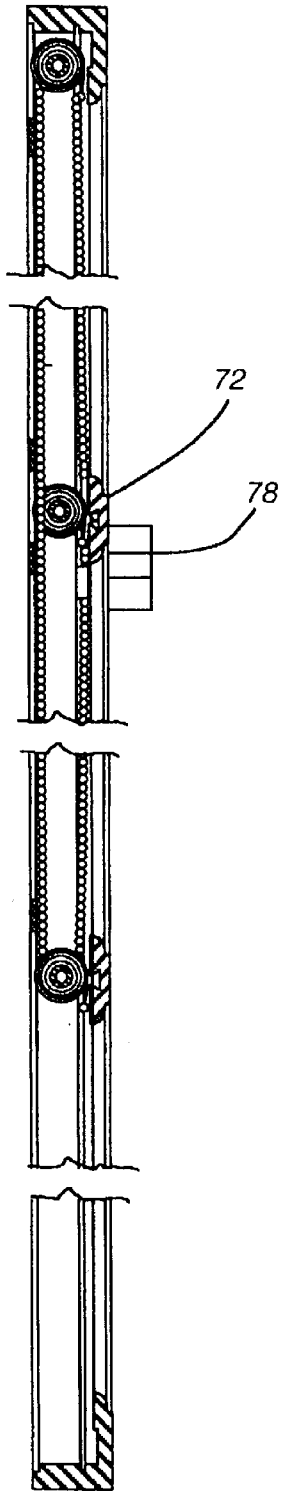
FIG. 11 is an enlarged section with parts removed taken along line 11—11 of FIG. 5.
Figure 12:
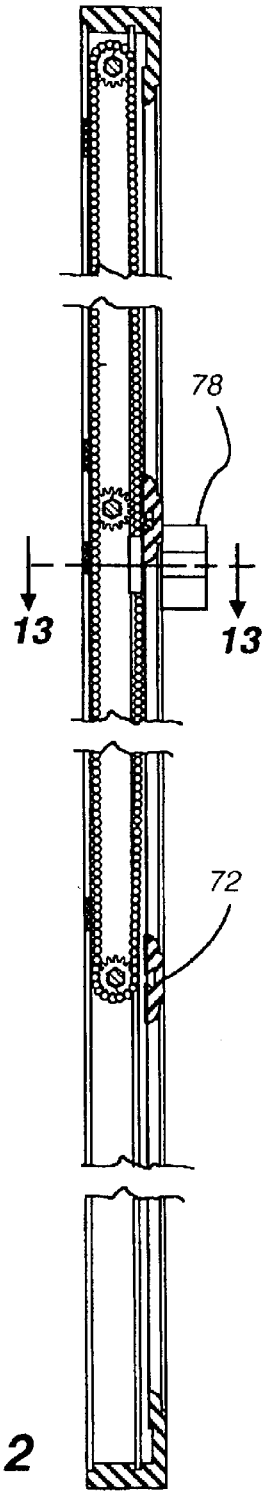
FIG. 12 is an enlarged section with parts removed taken along line 12—12 of FIG. 5.

As probably best seen in FIGS. 7 and 9, each roller 88 has wrapped therearound a sheet or curtain of flexible fabric material 132 such as might be used in a conventional window shade with one edge of the material being secured to the roller. The sheet material could be embossed with a pattern, could be a sheer, or an opaque material or any other desirable but flexible material. The length of the material is sufficient to bridge the gap between adjacent horizontal dividers 72 or a horizontal divider and the upper or lower frame member 66. The width of the sheet material is substantially coincident with the length of the main body 98 of the roller. The rollers for each shade component 76 are selectively rotated about their longitudinal horizontal axes by a beaded chain 134, which is probably best seen in FIG. 16. The beaded chain includes a plurality of flexibly interconnected beads 136 having diametrically extending pins 138 therefrom which extend in a horizontal direction. The pins are adapted to be received in the radial grooves of the individual spur gears 124 of the dual pinion gear, with the beads being adapted to be received within the concave cylindrical channel 126 between the pinion gears. In this manner, as the beaded chain passes by a roller 88, the roller is caused to be rotated in a preselected direction by the engagement of the diametrically extending pins with the associated pinion gears. Of course, depending upon the direction of movement of the beaded chain, the rollers can be caused to be rotated in either direction.

Figure 14:
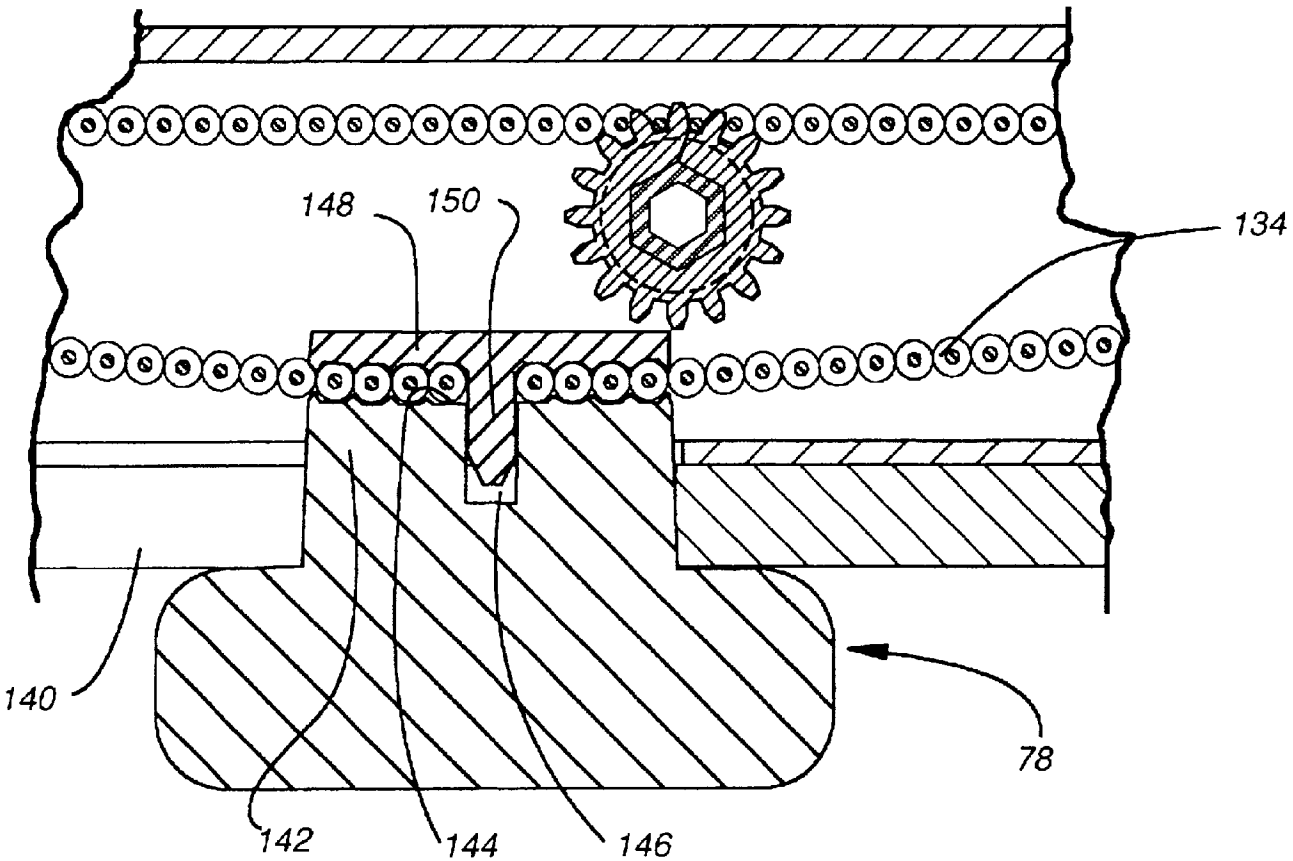
FIG. 14 is a section taken along line 14—14 of FIG. 13.
Figure 16:
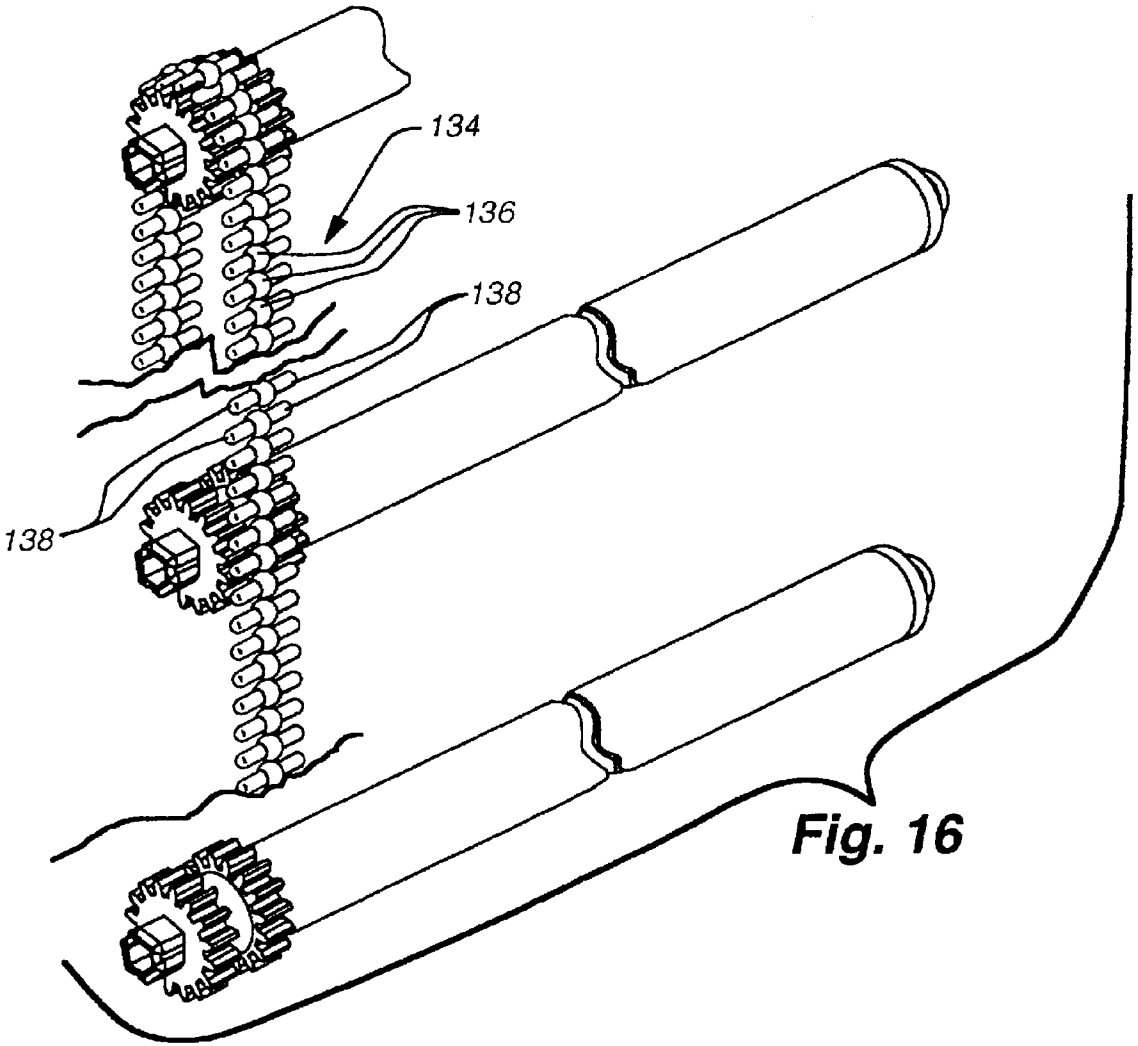
FIG. 16 is an isometric with parts removed illustrating assembled rollers used in the insert of FIG. 1 with a beaded drive chain associated therewith.

As mentioned previously, the shade components 76 in the preferred embodiment are operated by a drive member in the form of a finger slide 78 that is disposed in a slot 140 in the right frame member 64 and the slide as illustrated in FIG. 14 is of generally T-shaped cross-section, having a protruding body segment 142 that extends through the horizontal leg 82 of the right vertical frame member and slides easily within the elongated slot formed in the right frame member. The inner end 144 of the finger slide has a cylindrical blind hole 146 formed therein and is also scalloped in a manner to conformably receive the beads 136 of the beaded chain. A closure cap 148, which also has a scalloped face, is placed in confronting relationship with the inner end of the finger slide and the closure cap has a cylindrical pin 150 protruding therefrom adapted to be received in the blind hole 146 so that opposite ends of the beaded chain are captured between the protruding body segment 142 and the closure cap 148. The closure cap is secured to the protruding body segment in any suitable manner, such as with adhesive, ultrasonic bonding, heat fusion or the like. The beaded chain thereby effectively becomes an endless beaded chain and, again as best seen in FIG. 16, passes in a vertical loop within the right frame member 64. At the upper and lower ends of the loop, the beaded chain passes around the dual spur gear 106 of the uppermost and lowermost rollers but in-between the uppermost and lowermost rollers, the beaded chain merely engages the dual spur gears of the remaining rollers 88 as it passes thereby. It can be appreciated by reference to FIG. 13, that the beaded chain is confined within the inverted U-shaped bracket 94 so that it remains in operative engagement with the respective dual spur gears as it passes thereby or therearound.

It can be appreciated from the above that as the finger slide 78 is moved vertically up and down in the guide slot, the roller members 88 supporting the shade components 76 are rotated in one direction or another about their longitudinal axes. Of course, rotation of the rollers in one direction causes the sheet material 132 to be unwound from their associated rollers, while rotation in the opposite direction causes the sheet material to be wound around their associated rollers. To assure that the sheet material or shades drop vertically downwardly as they are unrolled from their associated rollers, a weighted bar 152, as best seen in FIG. 2, could be secured to the free edge of the shade material so that as the shade material is unwound, gravity pulls the free edge thereof downwardly.

It will be apparent to those skilled in the art that the finger slide 78 could be replaced with various pull cord or bead manipulated systems and the finger slide is only shown as illustrative of a means for moving the drive beads and cords deployed within the framework.

It should also be appreciated that a relatively short stroke of the finger slide affects an entire extension or retraction of the shade components and a complete coverage or non-coverage of the architectural opening in which the covering is mounted. In other words, due to the fact that there are a plurality of shade components each being operative to cover only a portion of the architectural opening and the plurality of components are simultaneously operated with a single slide, a relatively small stroke of the finger slide is operative to move each shade component across its portion of the opening so that in combination the plurality of shade components completely cover the architectural opening.

If you assume a one-for-one movement of the covering through manipulation of the finger slide 78, and if there are three shade components associated with one architectural opening, then a full extension or retraction of the covering across the entire architectural opening can be accomplished with a stroke of only a third of the height of the architectural opening. This is to be contrasted with conventional cord operated systems wherein the cord needs to be pulled a substantial distance, typically the entire height of the architectural opening, in order to extend the associated shade component fully thereacross from its fully retracted position.

It will, therefore, be appreciated that with the present invention, a very short and simple stroke of the finger slide accomplishes a complete extension or retraction of the covering components across the architectural opening with no more work than is required to lift a conventional window shade. While the stroke of a conventional window covering might be shortened by adding gearing to the control system, there would be additional work required to operate the system in order to achieve this result.

Figure 20:
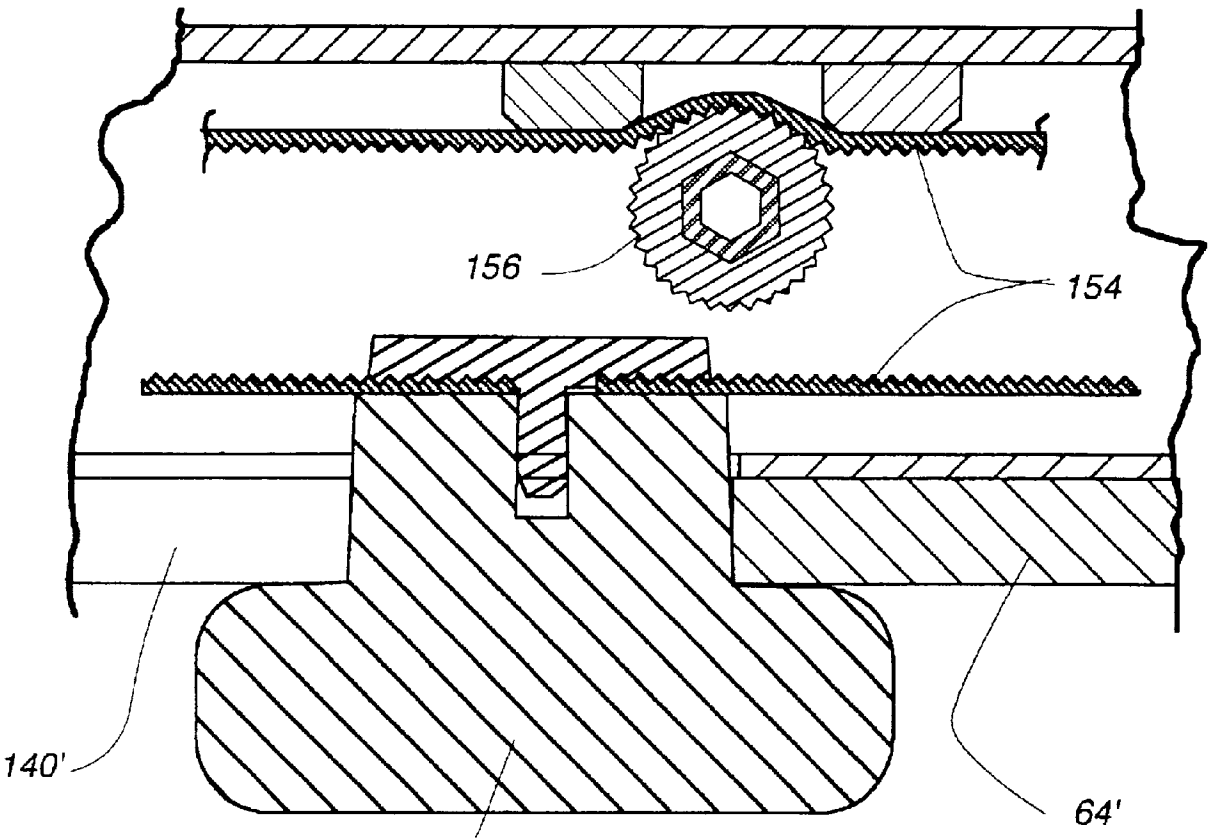
FIG. 20 is a view similar to FIG. 14 illustrating an alternative drive system utilizing a timing belt instead of a beaded chain.

Looking next at FIG. 20, an alternative drive system is illustrated to that discussed previously in connection with FIGS. 1–19 and wherein like parts have been given like reference numerals with a prime suffix. In this arrangement, the right frame member 64' is again provided with a slot 140' in which is slidably disposed a finger slide 78'. Instead of securing a beaded chain to the finger slide with a closure cap, a flexible timing belt 154 having gear teeth along one face is secured to the finger slide 78' in the same manner as the beaded chain. Instead of the dual spur gear as described previously, a toothed gear wheel 156 is provided on the drive shaft of each roller so that the toothed gear wheel is drivingly engaged with the timing belt. The operation of the covering would otherwise be identical.

Figure 21:
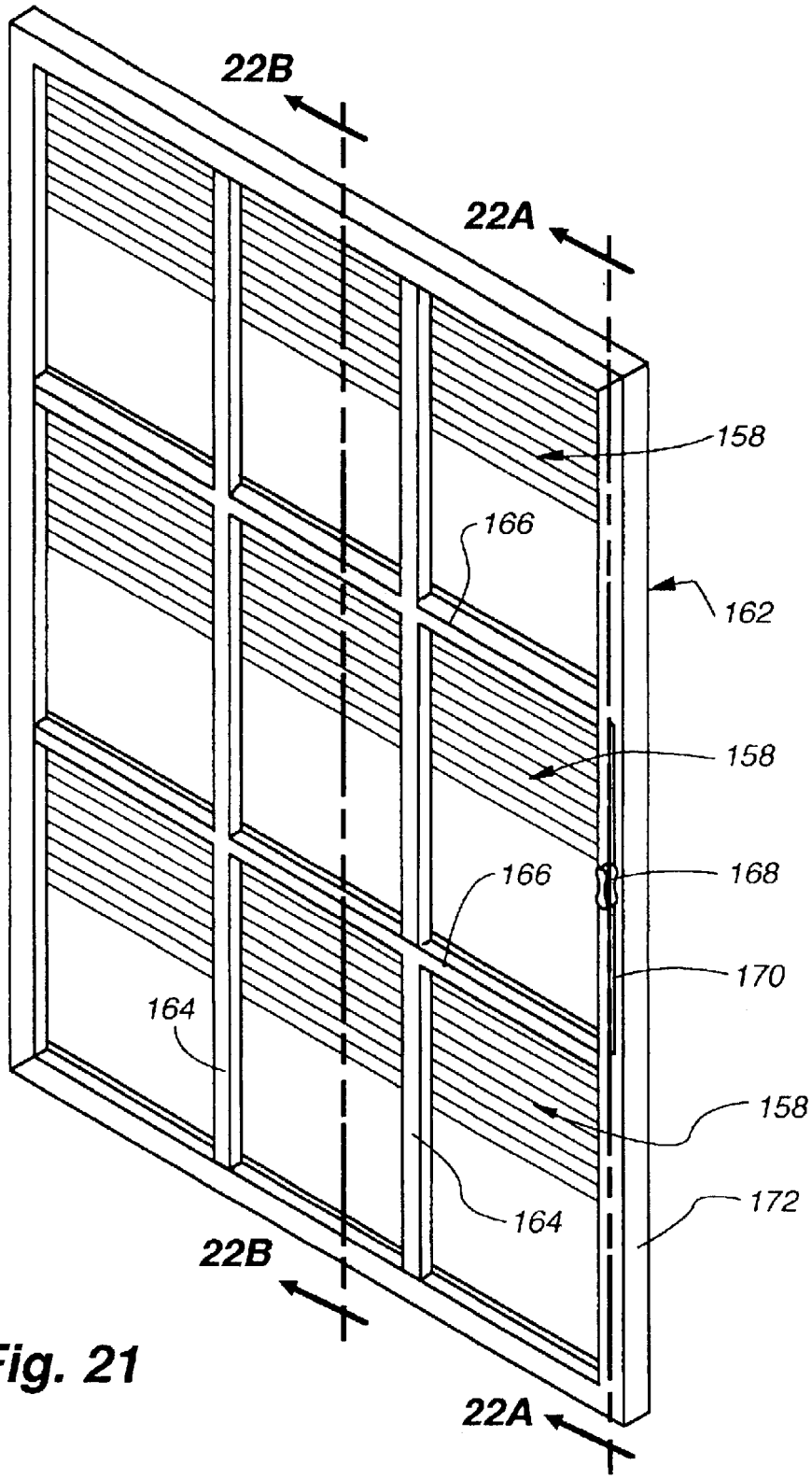
FIG. 21 is an isometric front view similar to FIG. 2 showing an alternative arrangement wherein the covering components are in the form of cellular shades.
Figure 22A:
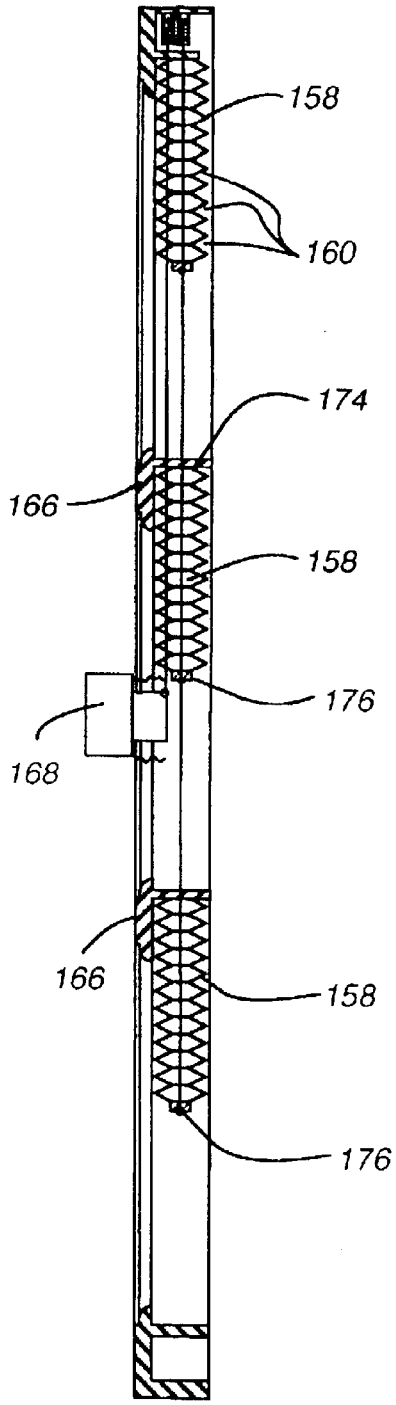
FIG. 22A is an enlarged vertical section taken along line 22A—22A of FIG. 21.
Figure 22B:
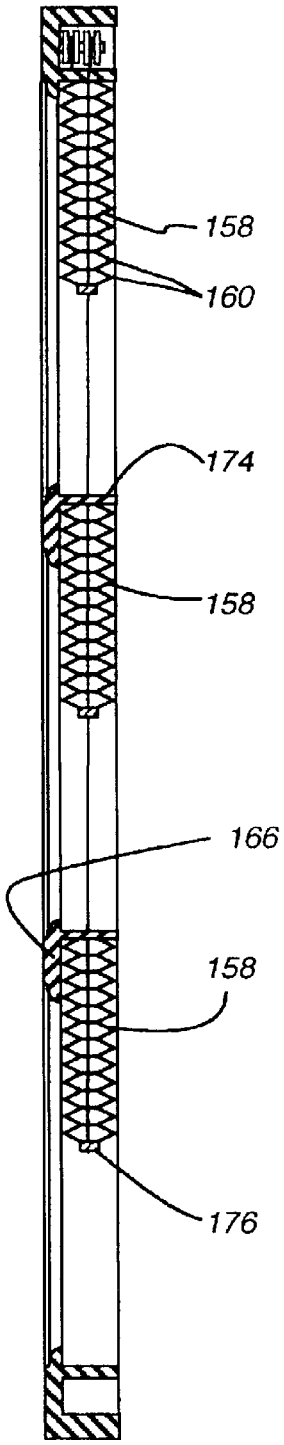
FIG. 22B is a vertical section taken along line 22B—22B of FIG. 21.
Figure 22C:
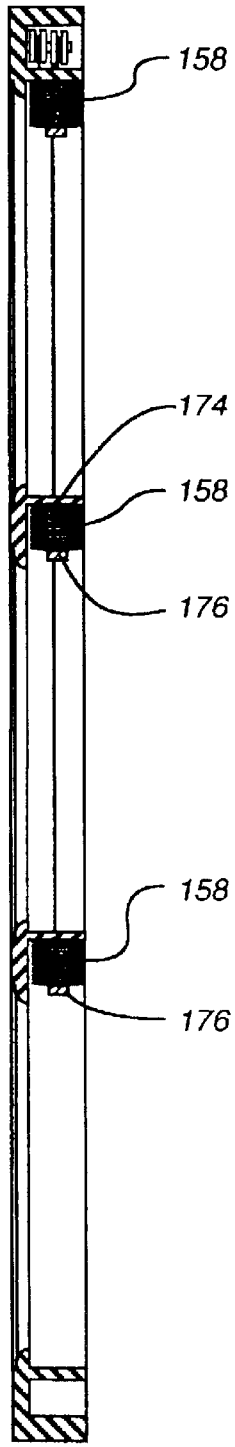
FIG. 22C is a vertical section similar to FIG. 22B with the shade components being fully retracted.
Figure 22D:
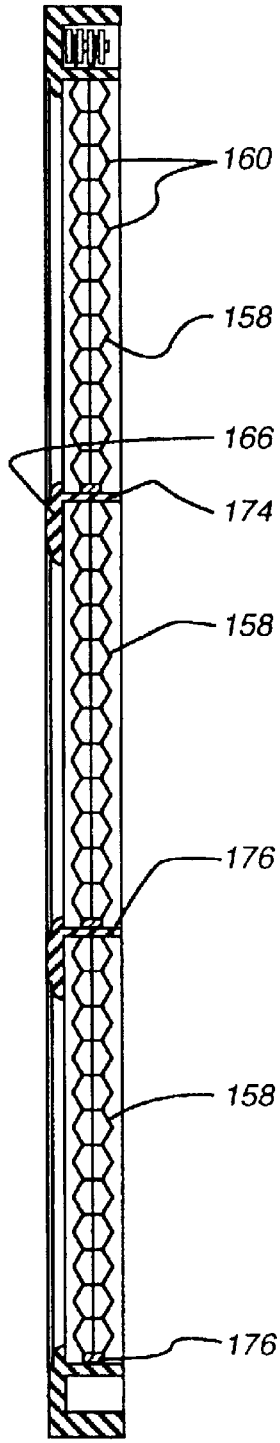
FIG. 22D is a vertical section similar to FIG. 22B with the shade components being fully extended.

FIGS. 21, 22A–22D and 23 illustrate a variation of the insert covering wherein a collapsible shade or curtain 158 is utilized as opposed to a roll-up shade. The collapsible shade or curtain is illustrated a cellular shade even though other collapsible shades such as pleated shades could be used. The cellular shade has a plurality of horizontally extending but vertically aligned and interconnected cells 160 of hexagonal cross-section which can be expanded as illustrated in FIG. 22D into a fully extended condition or retracted as illustrated in FIG. 22C with the cells completely collapsed and stacked adjacent to each other. Cellular shades of this type are well known in the art and a detailed description thereof is not deemed necessary to an understanding of the present invention.

In this embodiment, an outer or peripheral frame 162 again supports vertical and horizontal cross-frame members, dividers or muntins 164 and 166, respectively, and a drive member in the form of a finger slide 168 is again provided in a vertical slot 170 in a right frame member 172 for operating the shade components of the insert. In this embodiment, the horizontal dividers 166 have rearwardly projecting horizontal plate-like ledges 174 that support from their undersurface an associated collapsible shade component 158. The shade component can be secured to the horizontal plate-like ledges with adhesive or in any other suitable manner. Each shade component further includes a bottom rail 176 that is weighted and a plurality of vertically aligned openings (not seen) through each end of the shade component.

Figure 23:
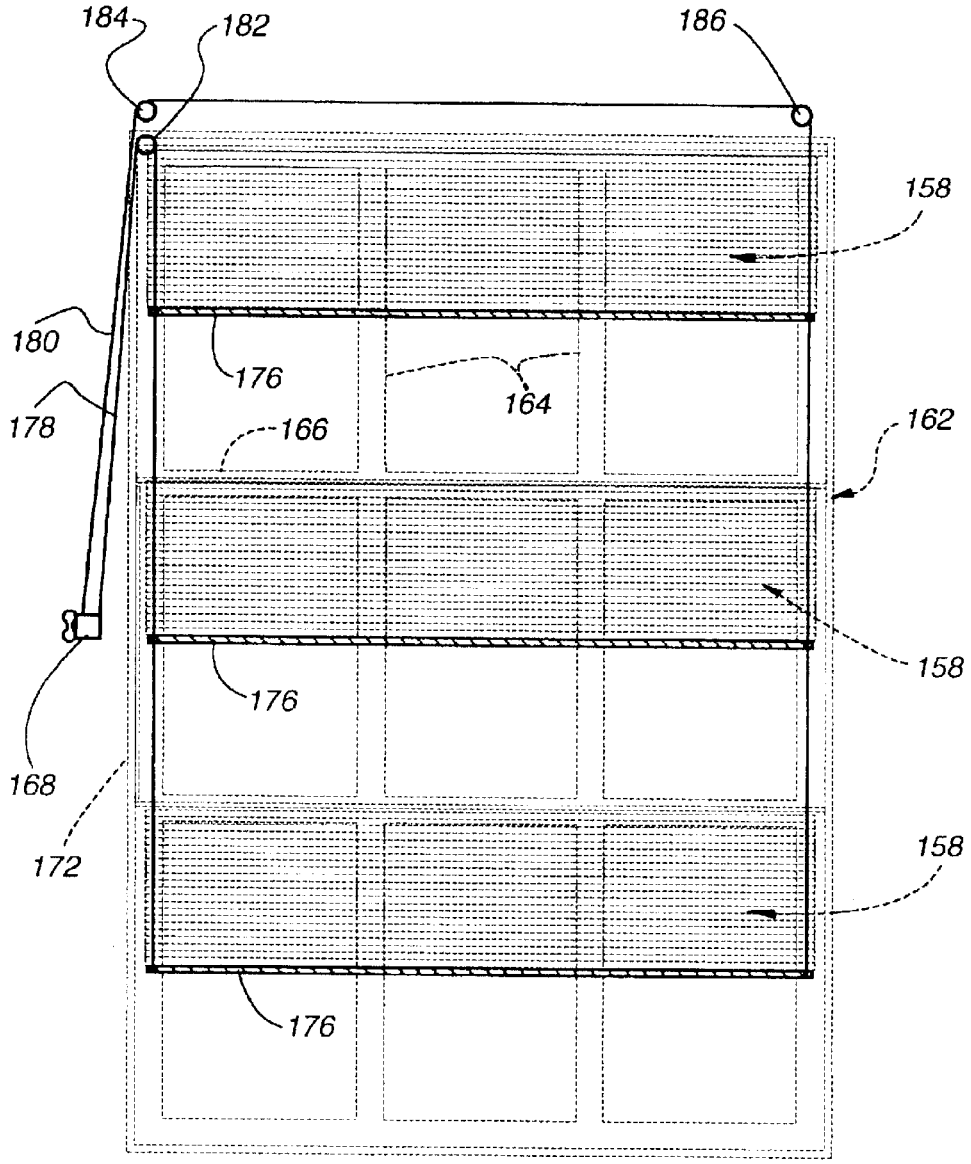
FIG. 23 is a rear diagrammatic elevation of the insert shown in FIG. 21 showing the control cord system for moving the shade between extended and retracted positions.

As best seen in FIG. 23, to operate this embodiment of the covering, a pair of cords 178 and 180 are connected to the upper end of the finger slide 168, with one cord 178 extending upwardly around a first idler pulley 182 at the right side of the insert and then downwardly through the aligned openings in the shade components along their right side. The cord is knotted or otherwise secured beneath the bottom rail 176 of each shade component as it passes therethrough so that when the cord is lifted, the bottom rail of each component is simultaneously lifted thereby collapsing the associated shade component therewith. The second cord 180 extends from the finger slide upwardly around a second idler pulley 184 at the top of the right frame member and subsequently across the upper frame member before passing around an idler pulley 186 at the top of the left vertical frame member and then downwardly through the aligned openings in the shade components on the left side of the insert. The cord 180 is also secured beneath each bottom rail 76 so that as the cord is lifted, the bottom rail lifts the associated shade component thereby collapsing the shade component adjacent to the under surface of the horizontal ledge 174 of each horizontal divider 166. It will be appreciated that movement of the finger slide causes each end of the bottom rails to move uniformly so that the shades are raised and lowered in unison and in a precise horizontal orientation.

Figure 23A:
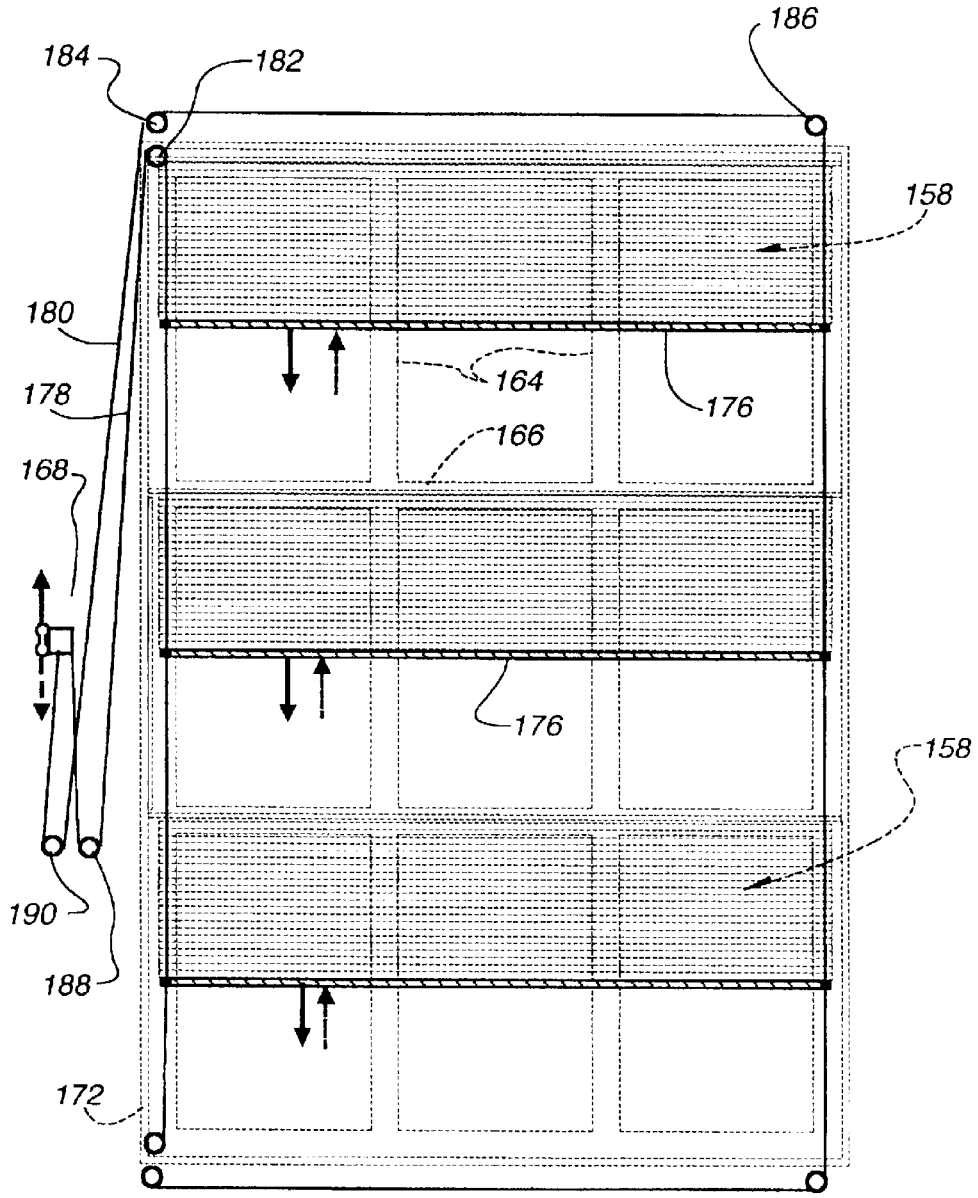
FIG. 23A is a rear diagrammatic elevation similar to FIG. 23 showing an alternative routing of the control cord.

As will be appreciated from the above system, movement of the finger slide downwardly causes the shade components to move upwardly but to reverse that motion so that downward movement of the finger slide causes a downward movement of the shade components, an extra pair of rollers could be provided in the left vertical frame member as shown in FIG. 23A so that the first cord 178 before passing upwardly around the pulley 182 would pass downwardly around the first one 188 of a pair of pulleys. Similarly, the second cord 180 before passing upwardly around the pulley 184 would pass downwardly around the second 190 of the pair of pulleys. It will be appreciated with this arrangement of the cords, that the aforedescribed movement of the shade components relative to the finger slide is accomplished.

Figure 24A:
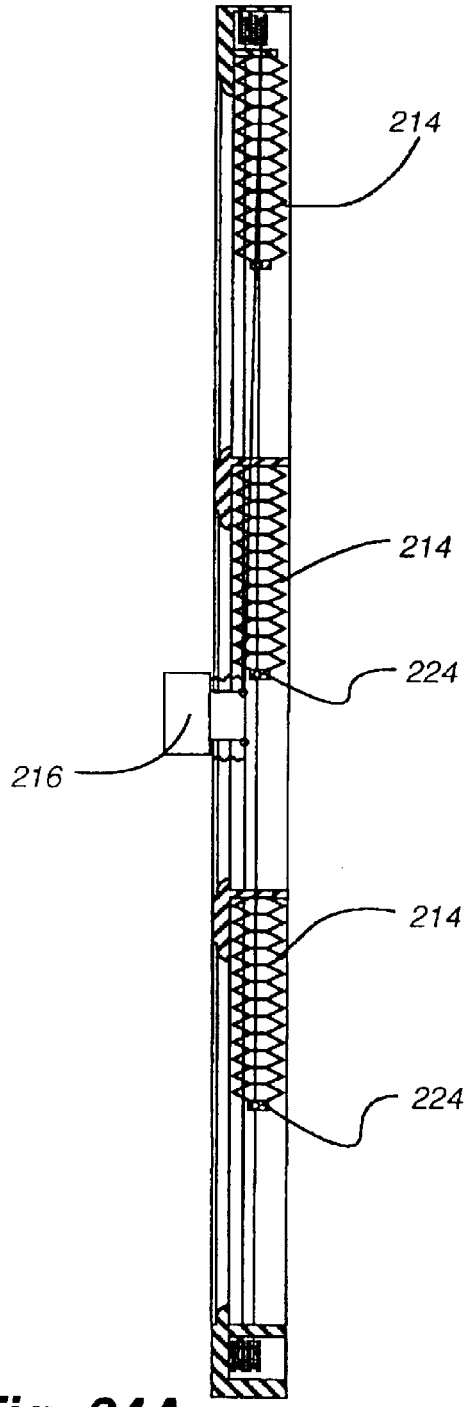
FIG. 24A is a vertical section similar to FIG. 22A but associated with the embodiment of the invention shown in FIG. 24.
Figure 24:
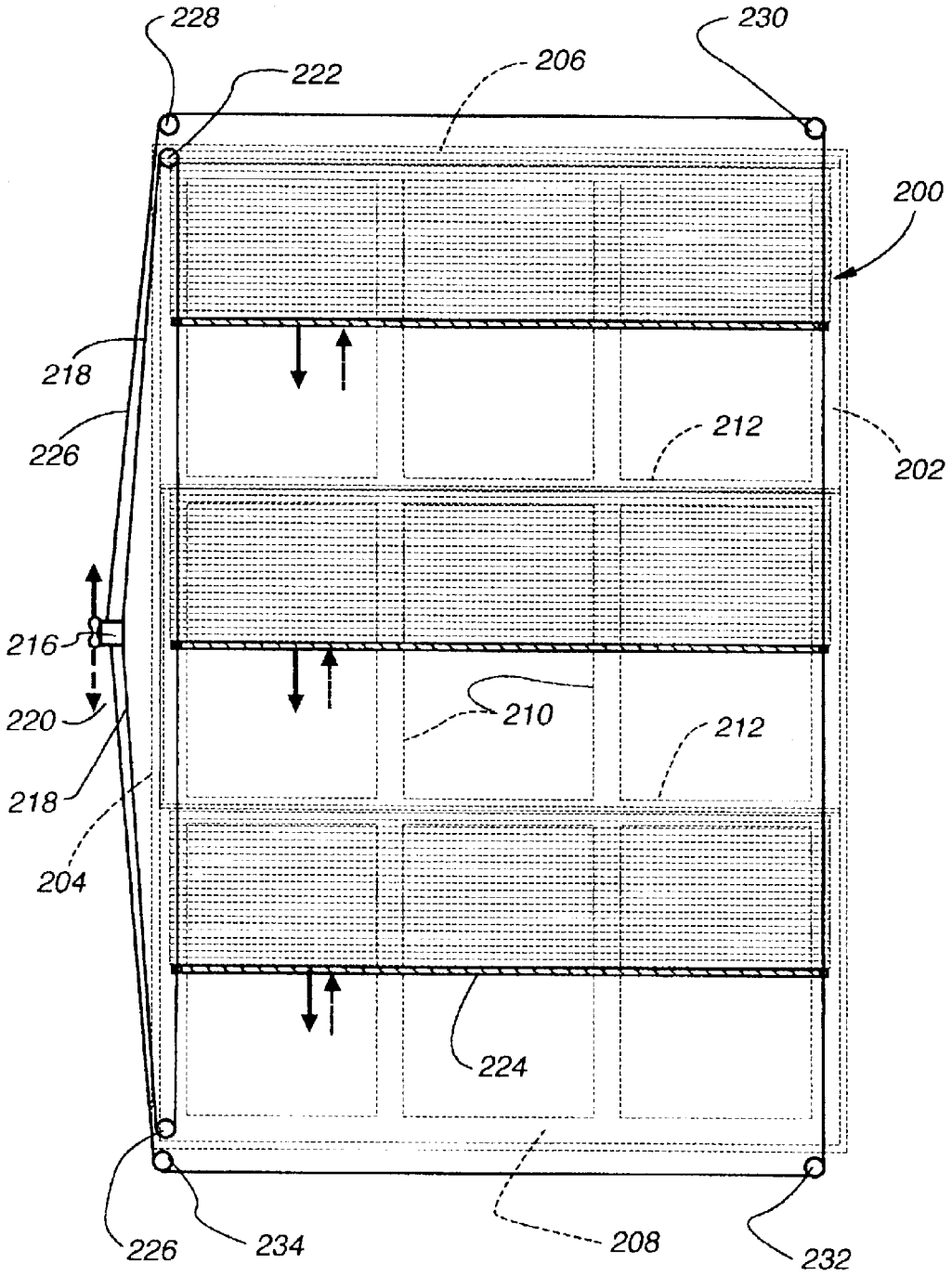
FIG. 24 is a rear diagrammatic elevation similar to FIG. 22 showing still another alternative cord control arrangement.

Another embodiment of the present invention is illustrated in FIGS. 24 and 24A with, again, the insert including an outer framework 200 with left and right vertical side frame members 202 and 204, respectively, and upper and lower frame members 206 and 208, respectively, along with vertical and horizontal dividers 210 and 212, respectively. In this embodiment, the shade components 214 are, again, cellular shades as illustrated in FIGS. 21 and 22A–22D, but the control system for moving the shade components between extended and retracted positions is slightly different. In the embodiment of FIGS. 24 and 24A, a finger slide 216 is again provided, but two endless cords 218 and 220 are secured to the finger slide. As possibly best seen in FIG. 24, a first cord 218 extends upwardly from the finger slide and around a first upper idler pulley 222 and then downwardly through aligned openings in the left side of each shade component. Again, the cord is secured to the bottom rail 224 of each successive shade components so that movement of the cord causes the shade components to move correspondingly. The cord 218 passes through the lowermost shade component and subsequently around a first lower idler pulley 226 that is vertically aligned with the first upper idler pulley 222 before the cord is returned and anchored at its opposite end to the underside of the finger slide thereby forming a first endless loop at one side of the insert. The second cord 220 has one end secured to the upperside of the finger slide and passes upwardly around a second upper idler pulley 228 that is vertically spaced above the first upper idler pulley 222, and the cord then extends horizontally across the top of the insert before passing around a horizontally aligned third upper idler pulley 230 and then downwardly through aligned openings in the right side of the shade components, with the cord again being secured to the bottom rail of each shade component. The cord extends through the lowermost shade component and subsequently around a second lower idler pulley 232 that is vertically aligned with the third upper idler pulley 230 and then horizontally across the base of the insert before passing around a third lower idler pulley 234 that is vertically aligned with the first lower idler pulley 226 so that the cord can then extend upwardly and have its opposite end secured to the underside of the finger slide. It will, therefore, be appreciated that two endless loops of drive cord are secured to the finger slide and are operatively connected to the bottom rails of each shade component so that movement of the finger slide upwardly will cause the bottom rails to move downwardly thereby extending the shade components. Downward movement of the finger slide causes the bottom rails to move upwardly thereby collapsing the shade components into their retracted position.

Figure 24B:
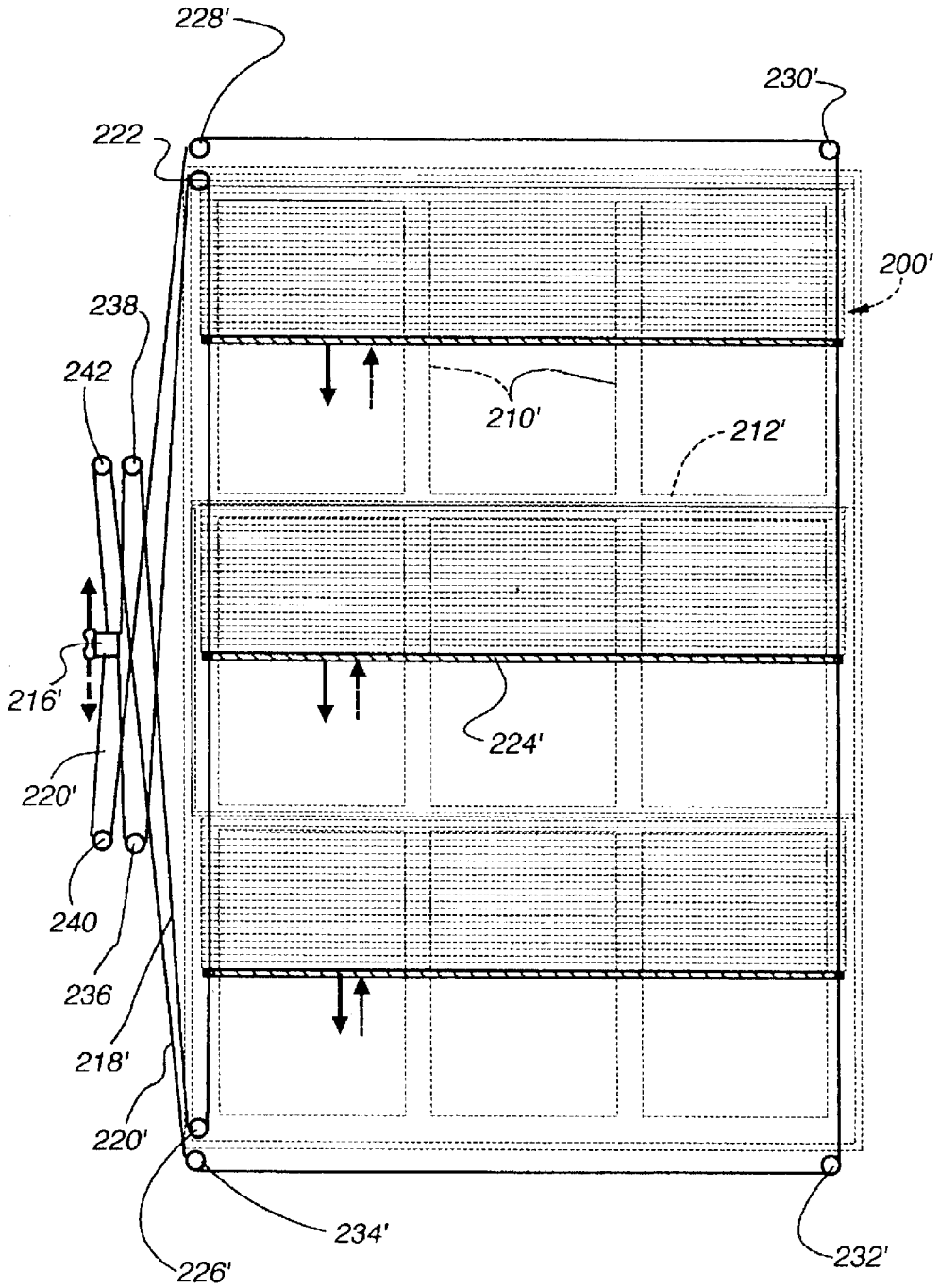
FIG. 24B is a rear diagrammatic elevation similar to FIG. 24 showing still another routing of the control cord.

FIG. 24B illustrates another embodiment of the present invention which is substantially identical to that illustrated in FIG. 24 except that the drive cords have been re-routed so that upward sliding movement of the finger slide causes upward movement of the bottom rails of each shade component and downward movement of the finger slide causes downward movement of the bottom rail of each slide segment. Corresponding parts of the insert illustrated in FIG. 24B have been given identical reference numerals to those used in FIG. 24 with a prime suffix.

As can be seen in FIG. 24B, a pair of upper and a pair of lower idler pulleys are added into the framework above and below the finger slide 216' so that the first cord 218' extends downwardly from the finger slide around an idler pulley 236 before passing upwardly and around the upper idler pulley 222' and then downwardly around the lower idler pulley 26' before extending upwardly again around an upper idler pulley 238 that is vertically aligned with the pulley 236 before returning to the finger slide for attachment thereto. Similarly, the second drive cord 220' has one end attached to the finger slide and passes downwardly around an idler pulley 240 before extending upwardly around the upper idler pulley 228' and after having passed peripherally around the insert, the cord extends upwardly around an upper idler pulley 242 that is vertically aligned with the lower pulley 240 and subsequently the cord is returned to the finger slide for attachment to the top thereof. As will be appreciated, with this arrangement, and as mentioned previously, upward movement of the finger slide 216' causes the bottom rails of each shade component to move upwardly thereby collapsing the associated shades into their retracted positions, whereas downward movement of the finger slide causes the bottom rails to move downwardly so as to expand each shade component into its extended position.

Figure 25:
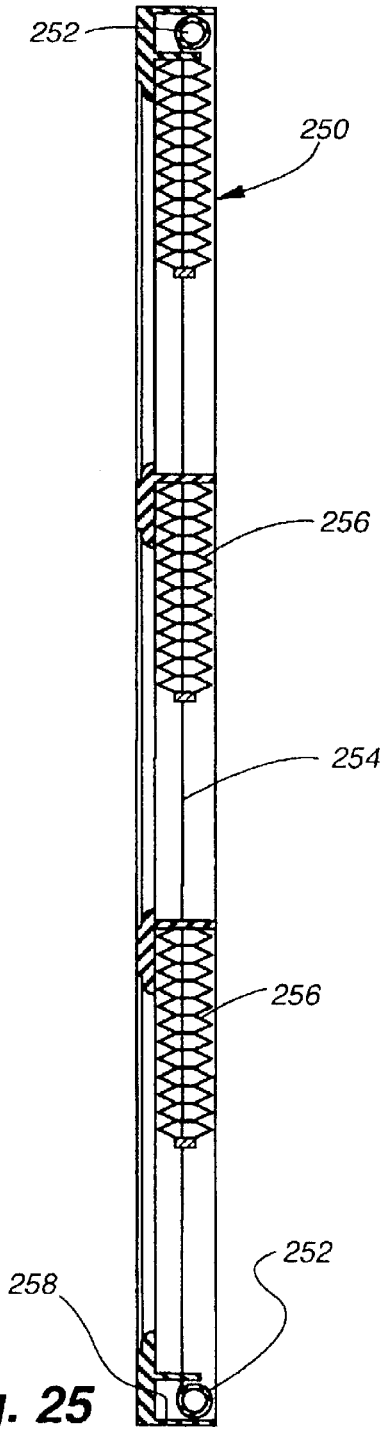
FIG. 25 is a vertical section through a shade similar to that shown in FIG. 21 showing an alternative system for moving the shade components between extended and retracted positions.
Figure 26:
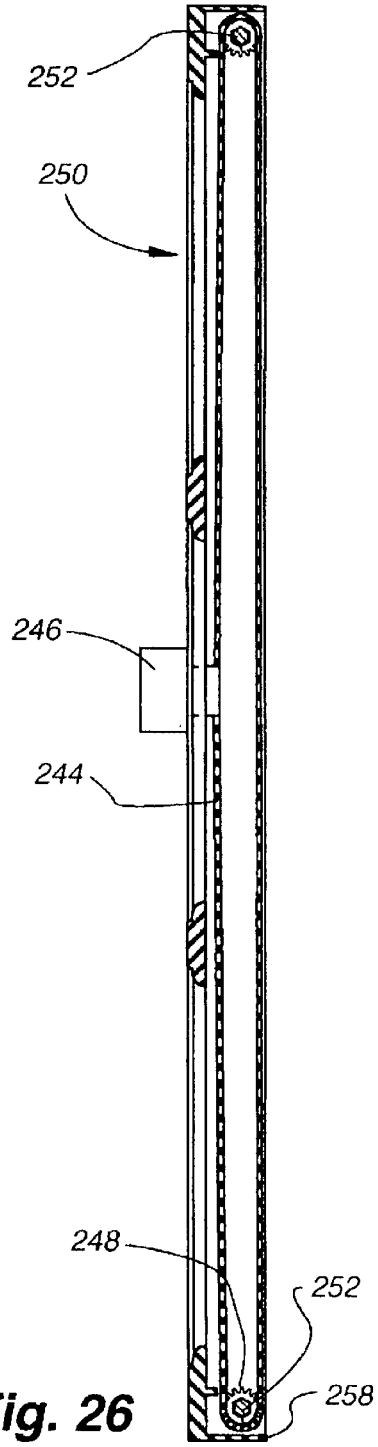
FIG. 26 is a vertical section similar to FIG. 25 showing the driving component for moving the shade components shown in FIG. 25 between extended and retracted positions.
Figure 27:
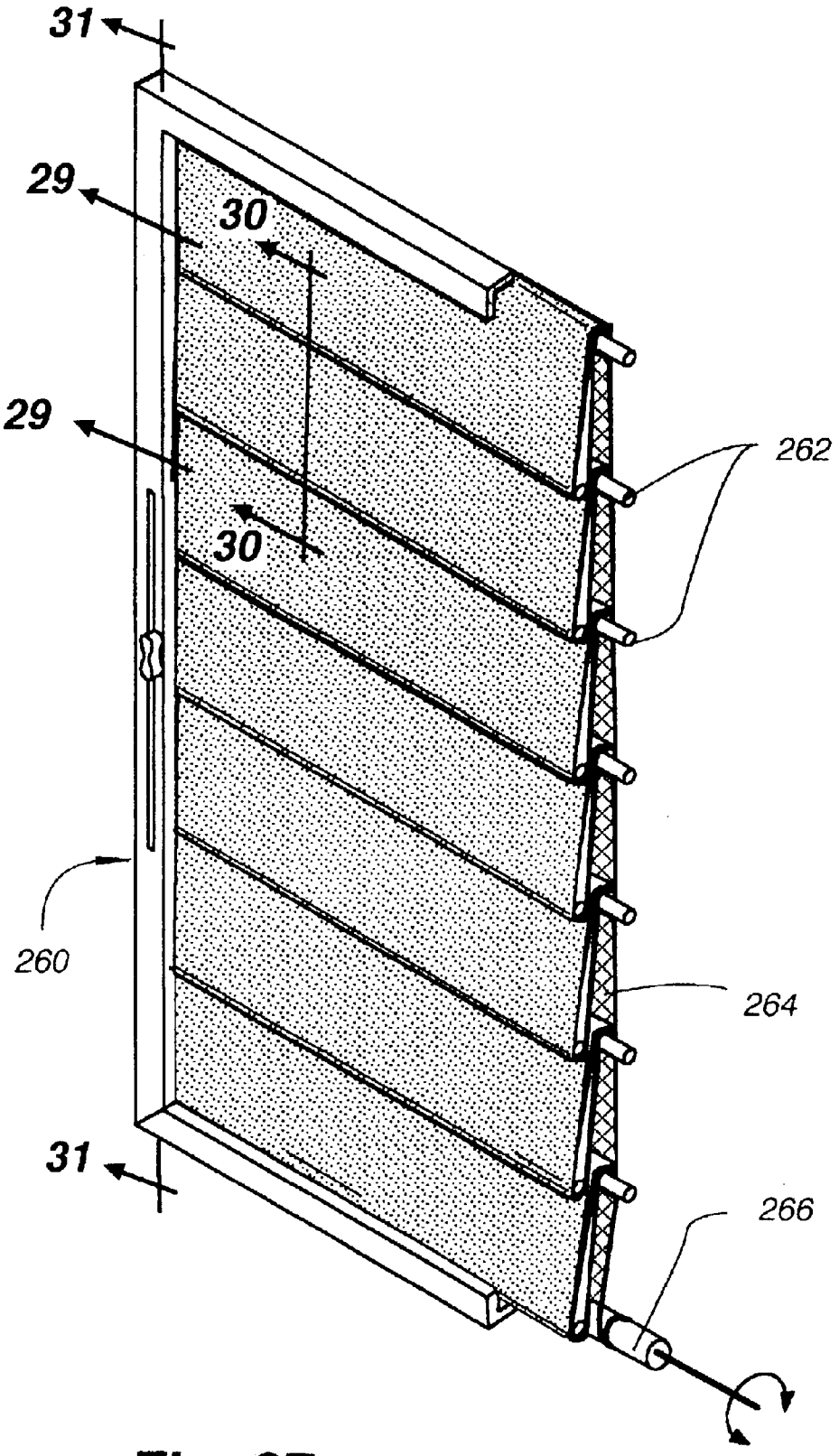
FIG. 27 is a fragmentary front isometric showing an alternative covering in accordance with the present invention.

FIGS. 25 and 26 disclose still another alternative system for moving a collapsible shade of the type shown in FIG. 21 between extended and collapsed positions. In this arrangement, the opposite ends of a timing belt 244 are secured to a finger slide 246 and the timing belt passes around gear wheels 248 at the top and the bottom of the insert covering 250, with the gear wheels being secured for unitary rotation with rotatable horizontally disposed drive rollers 252. Each roller has anchored adjacent to one end thereof a lift cord 254 which extends downwardly through associated ends of the shade components 256 and has its opposite end anchored to the lower roller. Each lift cord is secured to the bottom rail 258 of each shade component so that movement of the cord up and down causes the shades to be retracted or extended respectively. It will, therefore, be appreciated that movement of the finger guide up and down causes the upper and lower drive rollers to rotate about their horizontal longitudinal axes thereby causing the lift cord to wrap or unwrap therefrom, as the case may be, which in turn causes the shade to be retracted or extended accordingly.

Figure 28:
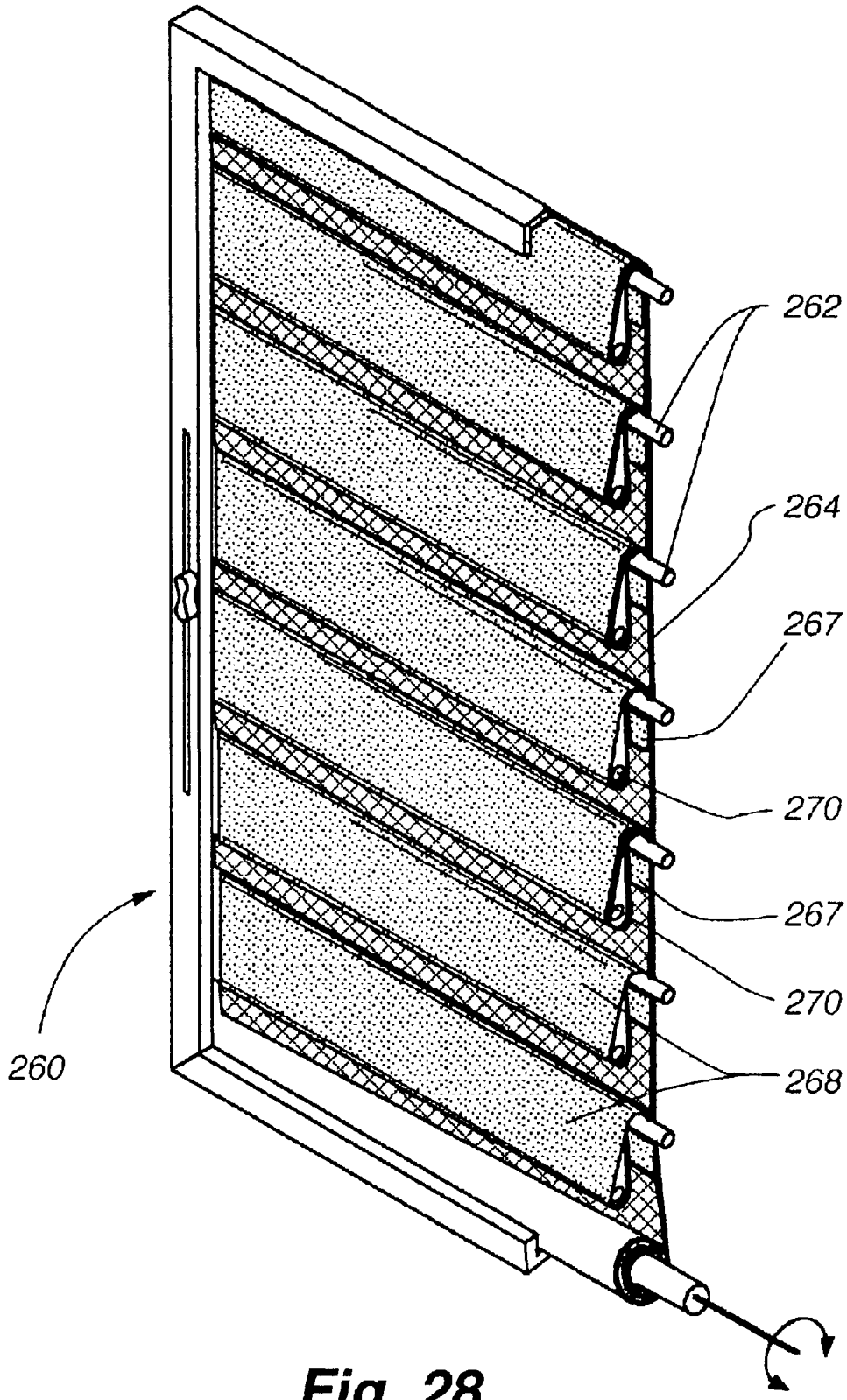
FIG. 28 is a fragmentary isometric similar to FIG. 27 with covering components in a different position.
Figure 29:
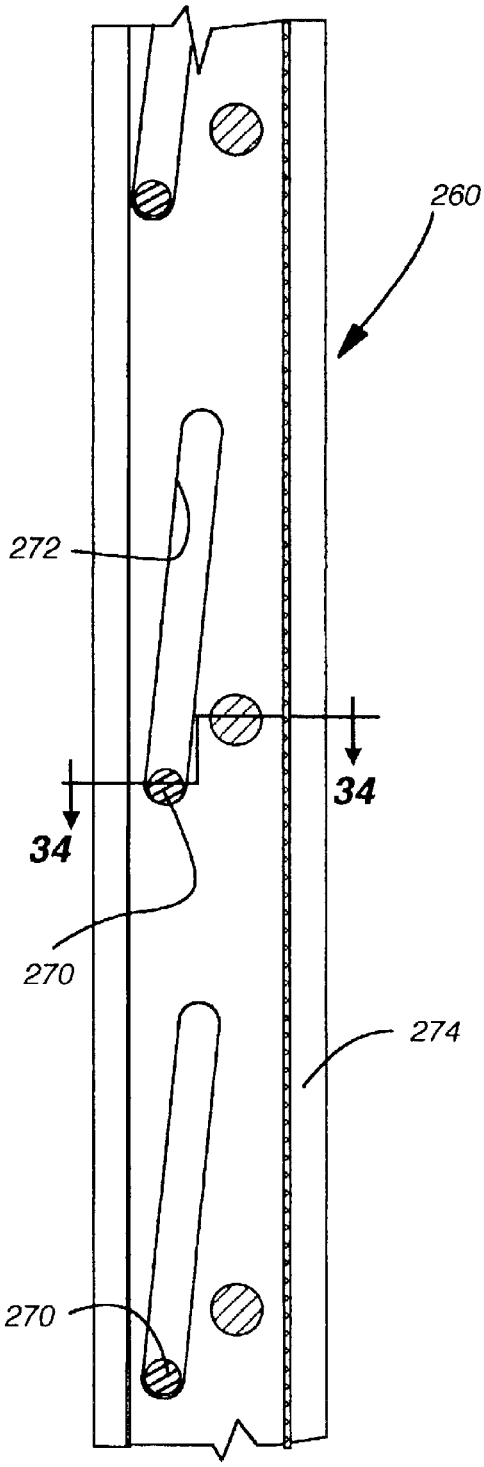
FIG. 29 is an enlarged section taken along line 29—29 of FIG. 27.
Figure 30:
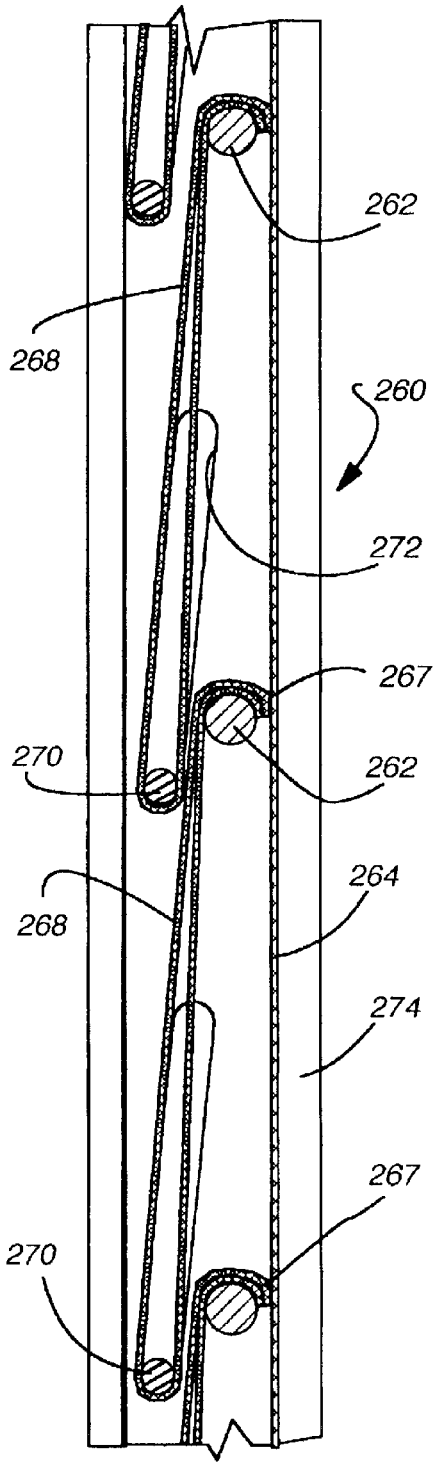
FIG. 30 is an enlarged section taken along line 30—30 of FIG. 27.

Referring next to FIGS. 27–31, another embodiment of the present invention is illustrated which could be utilized in a frame insert without muntins or dividers or might be used with dividers similar to the previously described embodiments. In this embodiment, an outer frame 260 supports a plurality of horizontally disposed fixed support rods 262. A fabric sheet 264, which might be, by way of example, a sheer, is provided having its lower edge secured to a drive roller 266 that, in turn, is rotatably mounted for rotation about its horizontal longitudinal axis. One end of the drive roller might have a drive gear thereon that is meshed with a timing belt or the like (FIG. 31) that is rotated by movement of a finger slide in a manner similar to that shown in FIG. 26. In this manner, vertical movement of the finger slide causes the drive roller 266 to rotate in a selected direction. The fabric sheet has secured thereto along equally spaced horizontal lines of attachment 267 loops 268 of fabric material which might be different from the sheer. The material for the loops could be an opaque, translucent or transparent material. Each loop of fabric carries a weighted horizontally disposed guide rod 270, the ends of which are slidably received in slots 272 provided in the right and left vertical frame members 274 of the insert at a slight angle relative to vertical. As will be appreciated, in operation of the covering, rotation of the drive roller in a counterclockwise direction, as viewed in FIGS. 27 and 28, will cause the fabric sheet 264 to unwind from the drive roller and shift upwardly due to the fact that it is being unwound from the drive roller and the weighted guide rods 270 are pulling the loops 268 of fabric downwardly by gravity thereby lifting the fabric sheet in reaction about the support rods. This movement, of course, causes the looped fabric to drop into an overlying relationship with the fabric sheet. Rotative movement of the drive roller in the opposite direction causes the fabric sheet to be wrapped therearound thereby pulling the weighted rods upwardly so that they slide vertically upwardly within the guide slots 272 until they reach the upper extent of the guide slots. At that point, as seen in FIG. 28, the looped fabric extends in an inverted U-shaped configuration with half of the looped fabric hanging downwardly from the front side of a support rod 262 and the other half hanging downwardly from the rear side of the support rod in contiguous face-to-face overlying relationship with a portion of the sheer fabric. It will be appreciated that if the looped fabric is an opaque material, for example, when the covering is in this position, half the distance between two adjacent support rods is covered by an opaque material while the other half of the distance is covered by the fabric sheet which could be sheer. Of course, in the other position where the fabric sheet is raised and the looped fabric is dropped downwardly off the front side of the fixed rods, the opaque fabric will block all vision and light through the covering. It is important to note that in the position of the covering illustrated in FIG. 30, where the weighted rods are in the lower end of the guide slots, each loop of fabric overlaps the underlying loop of fabric so that there are no gaps between adjacent loops.

Figure 32:
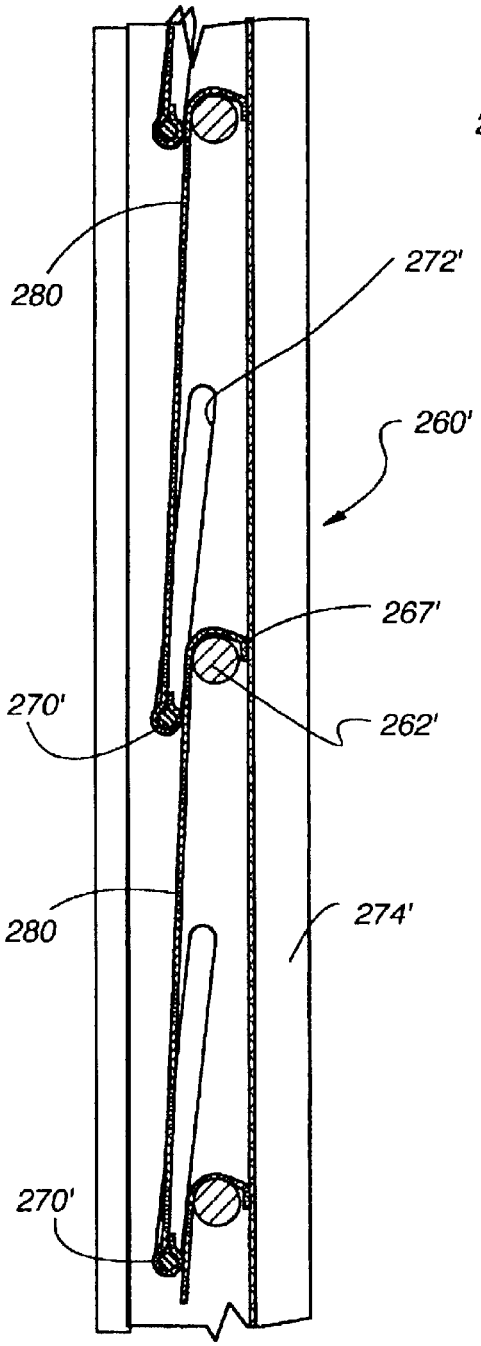
FIG. 32 is a fragmentary section similar to that shown in FIG. 30 showing an alternative arrangement for the covering illustrated in FIG. 30.
Figure 31:
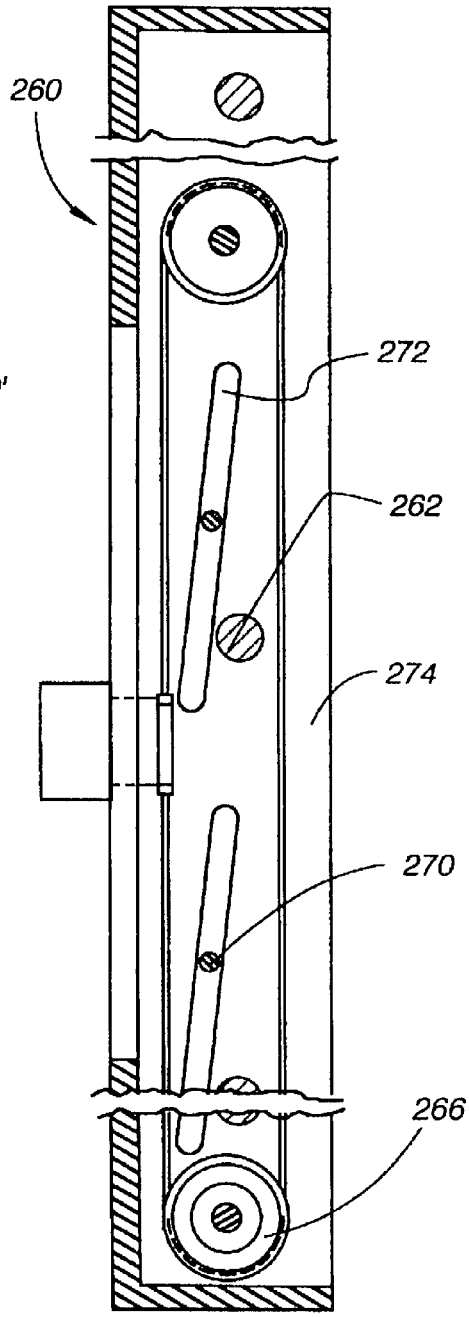
FIG. 31 is an enlarged section with parts removed taken along line 31—31 of FIG. 27.
Figure 33:
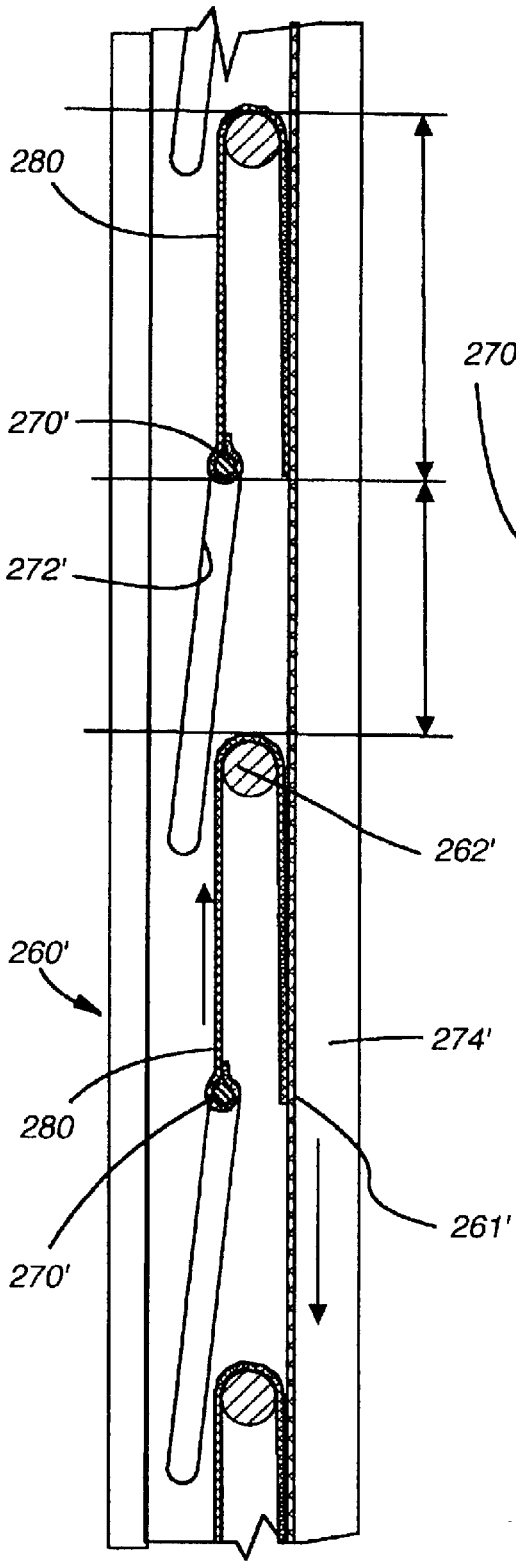
FIG. 33 is a fragmentary vertical section similar to FIG. 32 showing the covering components in a different position.
Figure 34:
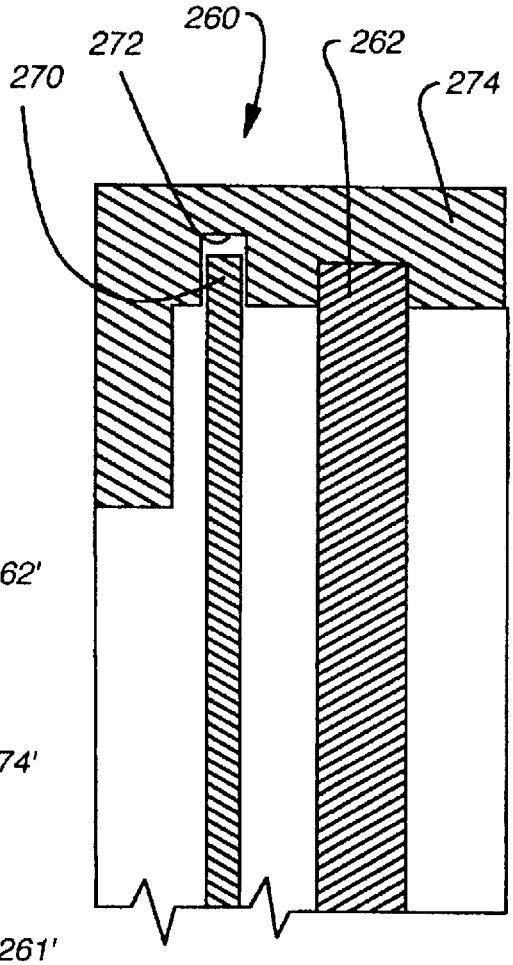
FIG. 34 is an enlarged section taken along line 34—34 of FIG. 29.
Figure 36:
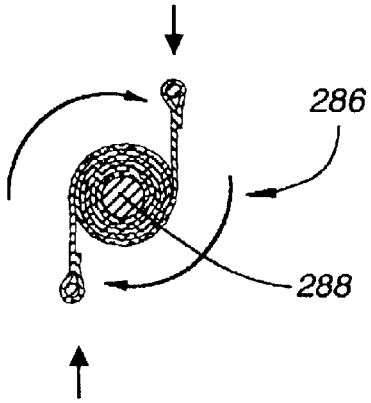
FIG. 36 is an enlarged vertical section taken through a single roller of the covering of FIG. 35.
Figure 37:
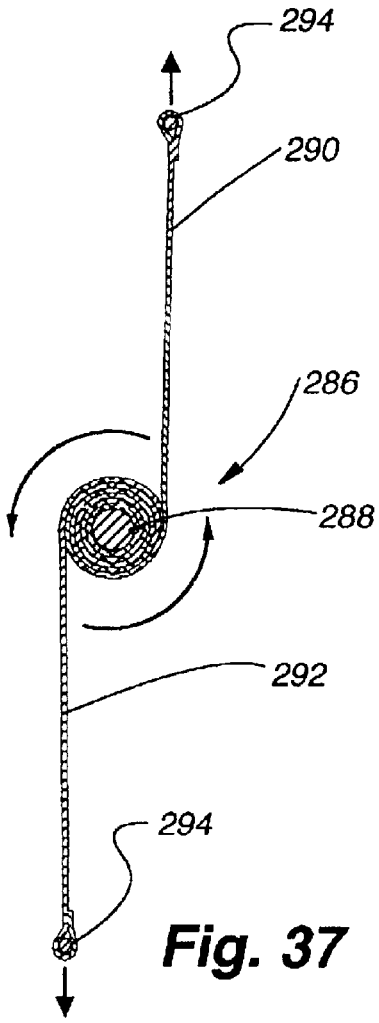
FIG. 37 is a view similar to FIG. 36 with the covering components partially unrolled from the roller.
Figure 35:
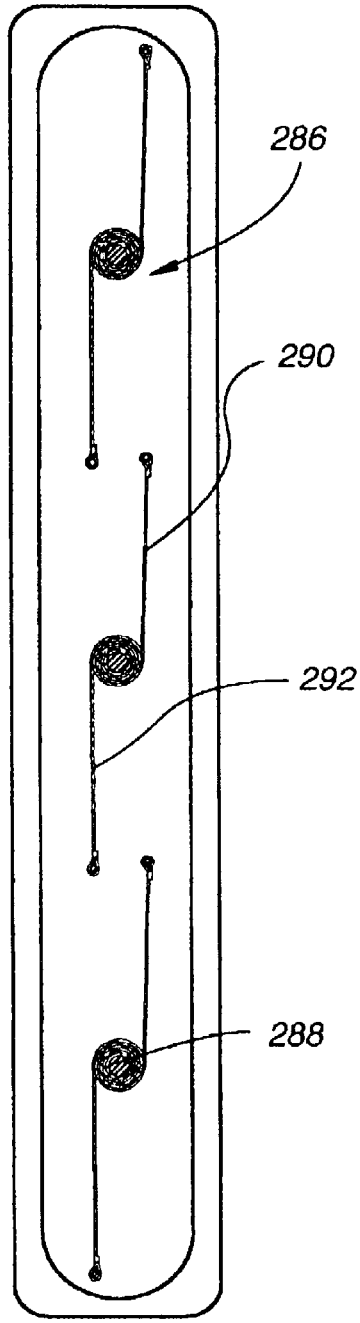
FIG. 35 is a diagrammatic vertical section showing still another embodiment of a covering in accordance with the present invention wherein the covering components are double wrapped on rollers.
Figure 39:
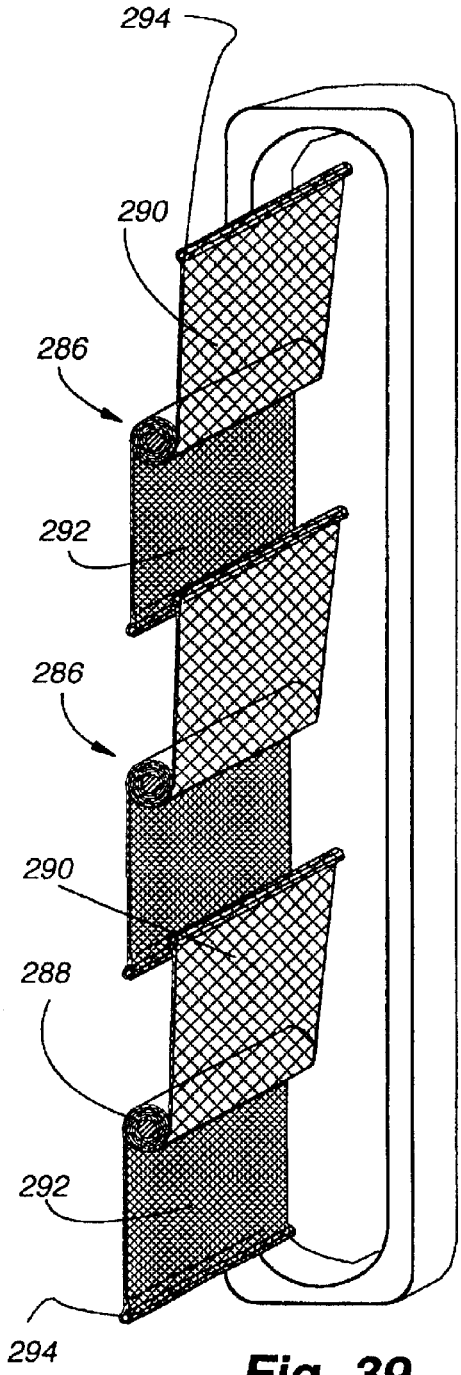
FIG. 39 is an isometric similar to FIG. 38 with the covering components shown in the position of FIGS. 35 and 37.
Figure 38:
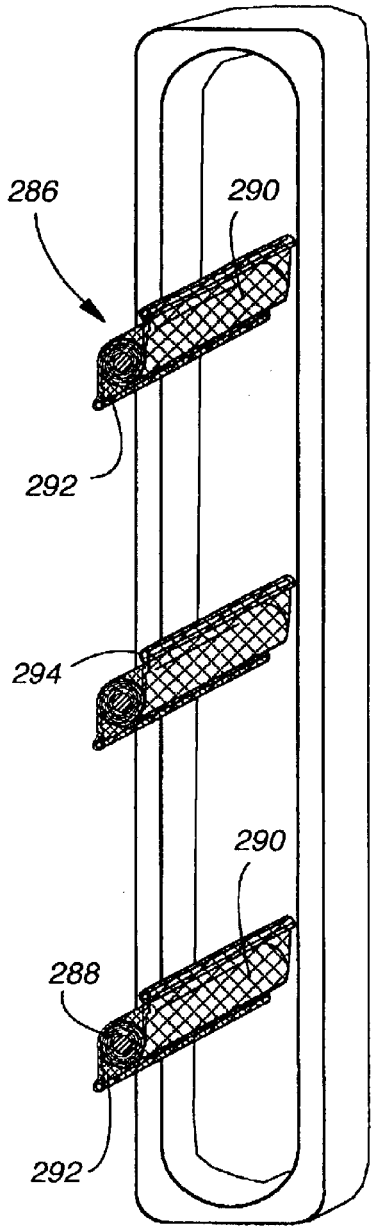
FIG. 38 is an isometric showing the shade of FIG. 35 with the rollers and covering components in the position shown in FIG. 36.

Referring to FIGS. 32–33, an alternative arrangement to that described in connection with FIGS. 27–31 is illustrated. In this arrangement, like parts have been given like reference numerals with a prime suffix and it will be appreciated that the framework 260' again supports a plurality of horizontally disposed fixed support rods 262' and weighted rods 270' are guided in inclined guide slots 272' in each vertical frame member 274'. Again, a timing belt secured to a finger slide would pass around gears at opposite ends of a drive roller (all not shown) across the bottom of the insert and at opposite ends of an idler roller (not shown) at the top end of the insert. As in the embodiment shown in FIGS. 27 through 31, the drive roller again has a sheer fabric or the like wrapped therearound so that rotation of the drive roller in one direction causes the sheer fabric to move upwardly and rotation of the drive roller in the opposite direction causes the sheer fabric to move downwardly. A plurality of strips 280 of material are secured to the sheer fabric along equally spaced horizontal lines of attachment 267', with each strip of material defining a horizontal strip that has a weighted rod hemmed into its lower edge. The weighted rod, of course, slides within the inclined guide slots of the vertical frame members. This arrangement of the insert covering functions similarly to that previously described in connection with FIGS. 27–31, with the only difference being that the strips of fabric are not looped but are rather single-layer sheets. Again, the strips of material could be identical to the sheer or could be another translucent material, an opaque material or a transparent material.

FIGS. 35–40 disclose another embodiment of the present invention, with this embodiment again utilizing an outer framework 282 with a finger slide 284 mounted in the right frame member for moving the shade components 286 between open and closed positions. Each shade component includes a horizontally disposed driven roll bar 288 which is mounted for rotation about its horizontal longitudinal axis by timing belts 289 within the right and left vertical frame members. Each roll bar has double wrapped thereon first 290 and second 292 fabric strips which extend in opposite vertical directions from the roll bar. The first and second strips could be the same material but would preferably be different materials and might preferably be transparent or translucent in one case and opaque in the other case. The drive system, which will be described hereafter, is operative to simultaneously unwrap the first strip of material from a roll bar in an upward direction and the second strip of material from the same roll bar in the downward direction.

Figure 40:
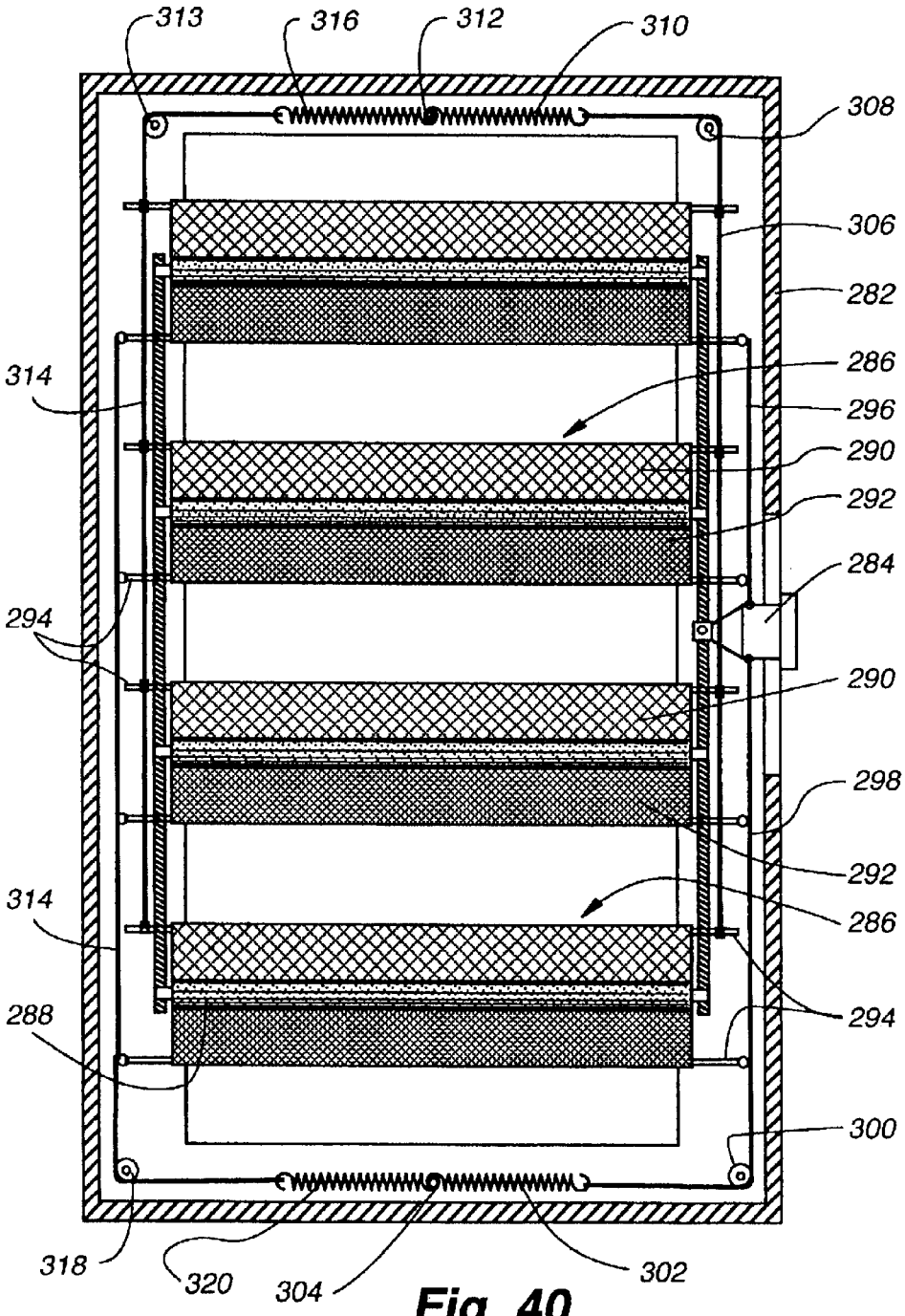
FIG. 40 is a rear elevation of the covering that is diagrammatically illustrated in FIG. 35 showing a control system for moving the covering components.

The outer edge of both the first and second strips of each shade component has a horizontal rod 294 therein which extends laterally beyond the ends of the strip to which it is attached. Pull cords operatively interconnect the horizontal rods in the following manner and as seen in FIG. 40. A first drive cord 296 is connected to the finger slide 284, which is also affixed to a timing belt 289, and is attached to the right ends of the horizontal rods associated with the second strip 292 of each shade segment above the finger slide. A second drive cord 298 extends downwardly from the finger slide and is connected to the right ends of the horizontal rods associated with the second strip 292 of each shade component beneath the slide member. The second drive cord extends beyond the lowest shade component and extends around an idler pulley 300 so that its opposite end is anchored to a first coil spring 302 that, in turn, is anchored at a centered location 304 to the lower frame member adjacent the bottom of the frame. A third drive cord 306 is connected to the right ends of the horizontal rods 294 associated with the first strips 290 of material and extends from the lowermost shade component upwardly around an idler pulley 308 at the upper right hand corner of the frame and has its opposite end secured to a second coil spring 310 whose opposite end is anchored at a centered location 312 near the top of the frame. A fourth drive cord 314 is connected to the left ends of the horizontal rods 294 associated with the first strips 290 of material and extends upwardly around another idler pulley 313 and has its opposite end connected to a third coil spring 316 that is anchored at the same location as the second coil spring 310. The fourth drive cord 314 connects the left ends of the horizontal bars associated with the second strips 292 of material and extends downwardly from the uppermost shade component around a fourth idler pulley 318 in the lower left hand corner of the frame with its opposite end anchored to a fourth coil spring 320 that is anchored at the same location to the frame as the first coil spring 302.

With this cord drive system, movement of the finger slide 284 downwardly pulls the second strip 292 of material in each shade component and the timing belt 289 downwardly thereby causing the associated rollers to rotate in a first direction, which causes each roller to allow the first strip 290 material to simultaneously unroll from the roller in an upward direction. The first strip 290 material is pulled upwardly due to the fact that the coil springs 310 and 316 at the top of the frame are biased to raise the first strips and as the strips become free to rise as they are unrolled from the associated rollers, the coil springs pull them uniformly as the second strip 292 members are being moved downwardly. Conversely, as the slide member is moved upwardly, it pulls the second strip 292 materials upwardly toward a wrapped position against the bias of the coil springs 302 and 320. It will, therefore, be appreciated that numerous conditions can be affected and if, for example, the first strip material is a translucent sheer fabric and the second strip material is an opaque fabric, movement of the slide member to its extreme lower position causes the second opaque strip member to extend from one roller to the next roller thereby totally blocking vision through the covering. Extreme movement of the slide member upwardly causes both fabrics to be wrapped around the rollers so that the covering is in a totally open condition allowing the complete passage of vision and light therethrough. Positioning of the slide member at an intermediate location provides alternating strips of opaque and sheer fabric for an unusual aesthetic look, as well as some intermediate control of the passage of vision or light through the covering. The manner in which the first and second strips of material are rolled and unrolled from the rollers is illustrated in FIGS. 35–39.

Figure 41:
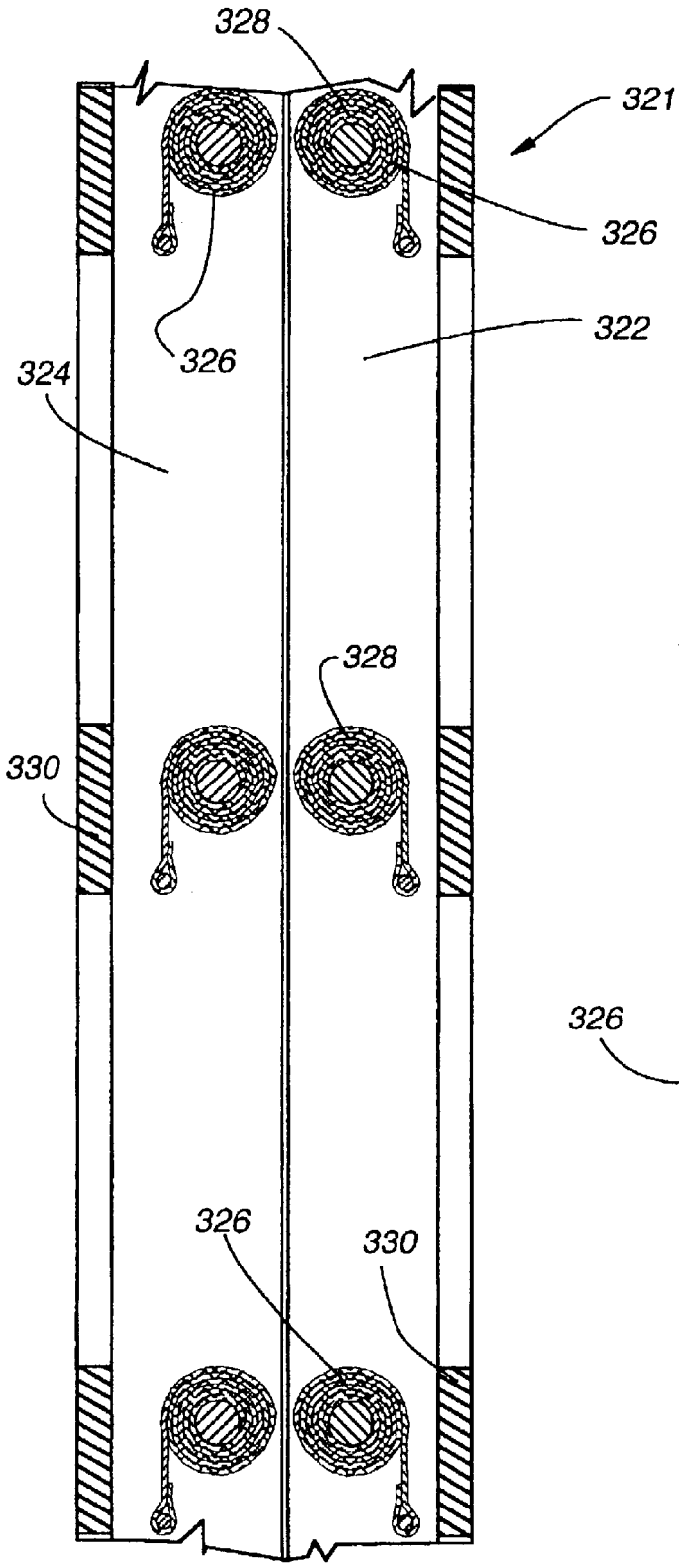
FIG. 41 is a fragmentary vertical section taken through a covering in accordance with the present invention wherein back-to-back systems are employed.
Figure 42:
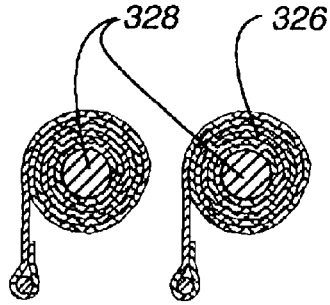
FIG. 42 is a vertical section taken through a pair of adjacent rollers in the system illustrated in FIG. 41 with the covering components coming off the same side of adjacent rollers.
Figure 43:
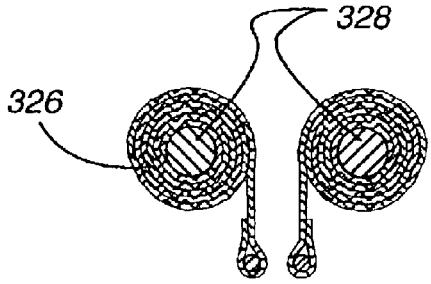
FIG. 43 is a vertical section similar to FIG. 42 showing the covering components coming off opposite sides of adjacent rollers.

Referring to FIGS. 41–43, an alternative arrangement to that described in connection with FIGS. 1–19 is illustrated. In this arrangement 321, back-to-back units 322 and 324 that might each be identical to the embodiment shown in FIGS. 1–19 are utilized. Accordingly, each unit would work identically to that previously described except that the material 326 wrapped on corresponding rollers 328 behind corresponding horizontal dividers 330 might be different. For example, in the unit 322 as shown on the right side of FIG. 41, there might be a translucent material, such as sheer, wrapped on the rollers, while on the unit 324 shown on the left side in FIG. 41, an opaque material might be used. Accordingly, the covering insert 321 could be operated so that there was no material in the openings between the dividers of the insert, as illustrated in FIG. 41, or the sheer fabric might be extended without extending the opaque fabric so that there would be some vision through the covering due to the translucency of the sheer material. The opaque material could also selectively be extended to block vision and light through the covering insert and the opaque material might be extended with or without the sheer material being extended. It will, therefore, be appreciated that various alternative options would be available with a system as shown in FIG. 41. FIGS. 42 and 43 simply illustrate that the fabric materials can be arranged to drop off the front side or the rear side or both of the rollers for different aesthetic looks.

Figure 45:
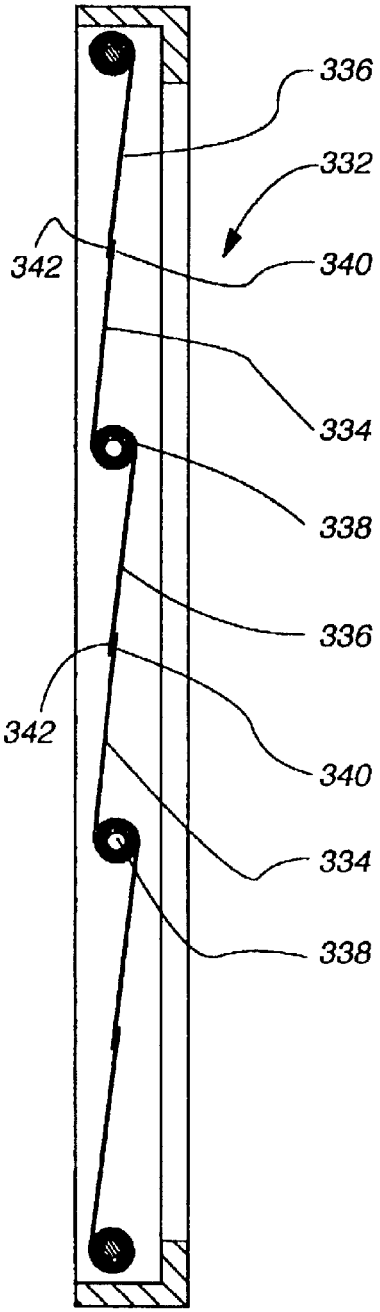
FIG. 45 is a diagrammatic vertical section taken through the covering of FIG. 44.
Figure 44:
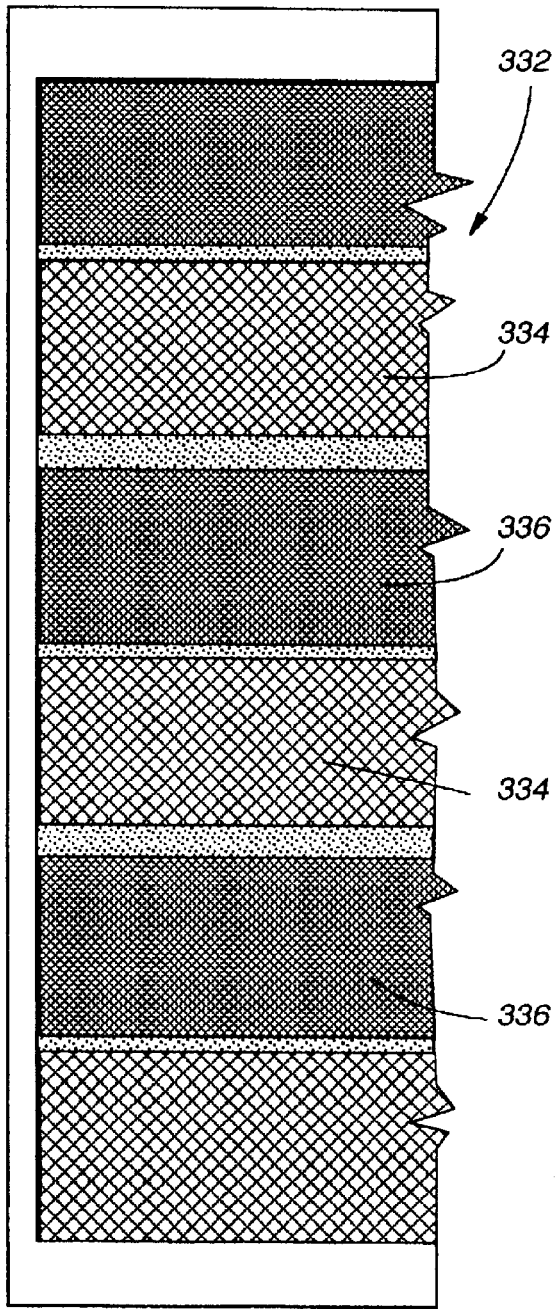
FIG. 44 is a fragmentary front elevation of a covering in accordance with the present invention that incorporates fabrics that may have different properties.

FIGS. 44 and 45 illustrate an insert covering 332 similar to that shown in FIGS. 35–40 except the first and second strips of material 334 and 336, respectively, that are double-wrapped on horizontal rollers 338 have their free edges 340 and 342, respectively, secured to the next adjacent strip of material coming off an adjacent roller. In other words, the first strip 334 of material which extends upwardly from a roller is connected along its free edge 340 to the downwardly extending free edge 342 of a second strip 336 of material that extends downwardly from the next adjacent upper roller. Similarly, the second strip 336 of material extending downwardly from one roller has its free edge 342 secured to the free edge 340 of the first strip 334 of material extending upwardly from the next adjacent lower roller. In this embodiment of a covering insert, there is always material across the architectural opening. If the first and second strips of material are different materials, the covering can be arranged so that the first strip of material extends from one roller to the next adjacent roller, or the second strip of material can extend from one roller to the next adjacent roller, or some portion of each of the first and second strips of material can bridge the space between adjacent rollers.

Figure 47:
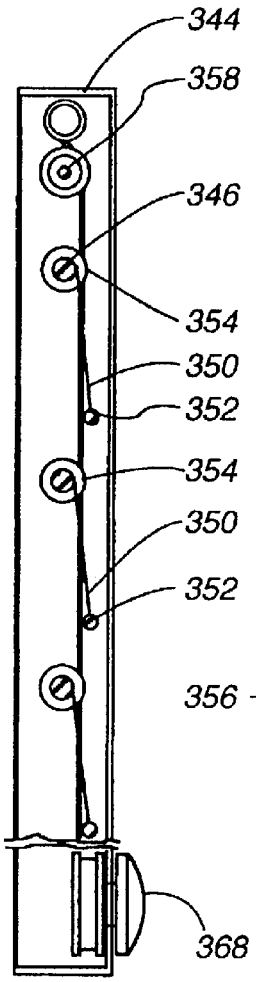
FIG. 47 is a fragmentary section taken through the covering of FIG. 46.
Figure 46:
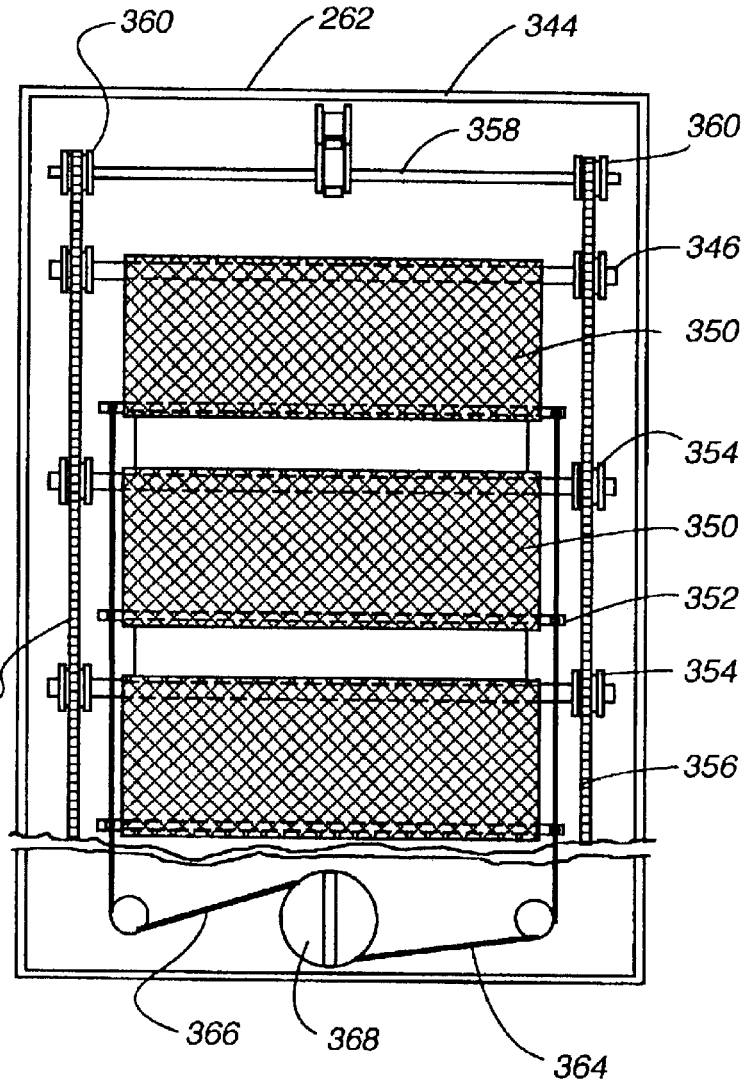
FIG. 46 is a diagrammatic front elevation of another embodiment of the present invention wherein a control cord extends covering components from their associated rollers and a belt system retracts the covering components onto the associated rollers.

FIGS. 46 and 47 illustrate another embodiment of the present invention and in this embodiment, again there is an outer framework 344 with horizontally disposed rollers 346 aligned with horizontal dividers that are not shown. Each horizontal roller has a strip of material 350 wrapped thereon, with the free edge of each strip having a weighted horizontal rod 352 retained in a hem therealong. The end of each roller has a timing gear 354 thereon that is in driving engagement with an endless timing belt 356 that is operatively engaged with an upper horizontal bias rod 358 also having timing gears 360 at opposite ends thereof. The center of the bias rod is keyed to a coiled leaf spring 362 which biases the rollers in a counterclockwise direction as viewed in FIG. 47, which is the direction in which the rollers are rotated to wrap the associated strips of material thereon. There are, in addition, two control cords 364 and 366, with one control cord 364 being connected to the right end of each of the horizontal rods 352 and the second control cord 366 connected to the left end of each horizontal rod 352 and with the opposite ends of the control cords anchored to a rotatable knob 368 that is hand manipulated. Clockwise rotation of the knob 368 as viewed in FIG. 46 causes the control cords to wrap therearound pulling the horizontal rods 362 downwardly so as to unwrap the strips of material 350 from their associated rollers. Of course, rotation in this direction is against the bias of the spring 362, but the spring is not so strong that it overcomes the unrolling of the strips of material. Rotation of the knob in the opposite counterclockwise direction frees the lower edge of each strip of material so that the spring can rotate the rollers thereby causing the strips of fabric to be wrapped around their associated rollers.

Figure 49:
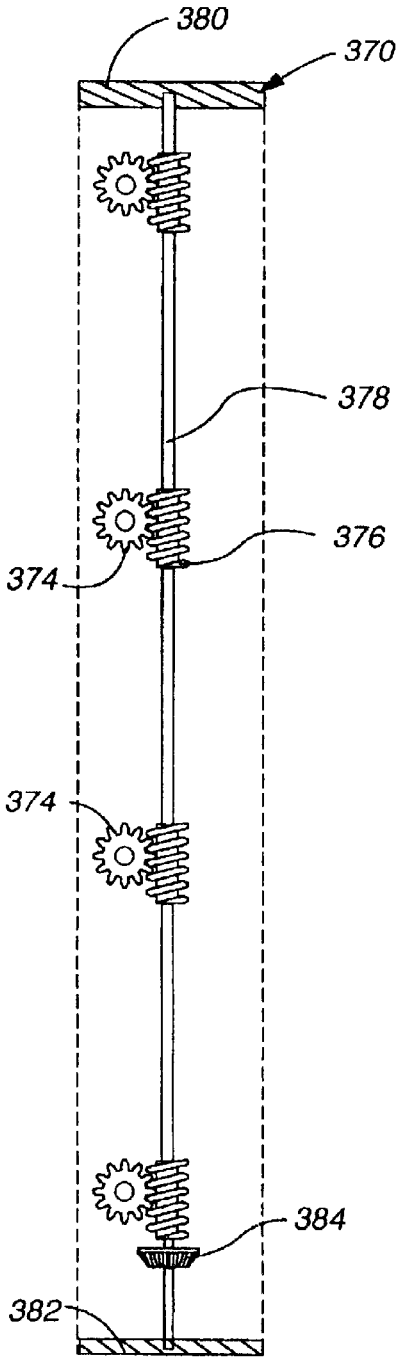
FIG. 49 is a diagrammatic section taken through the covering shown in FIG. 48.
Figure 48:
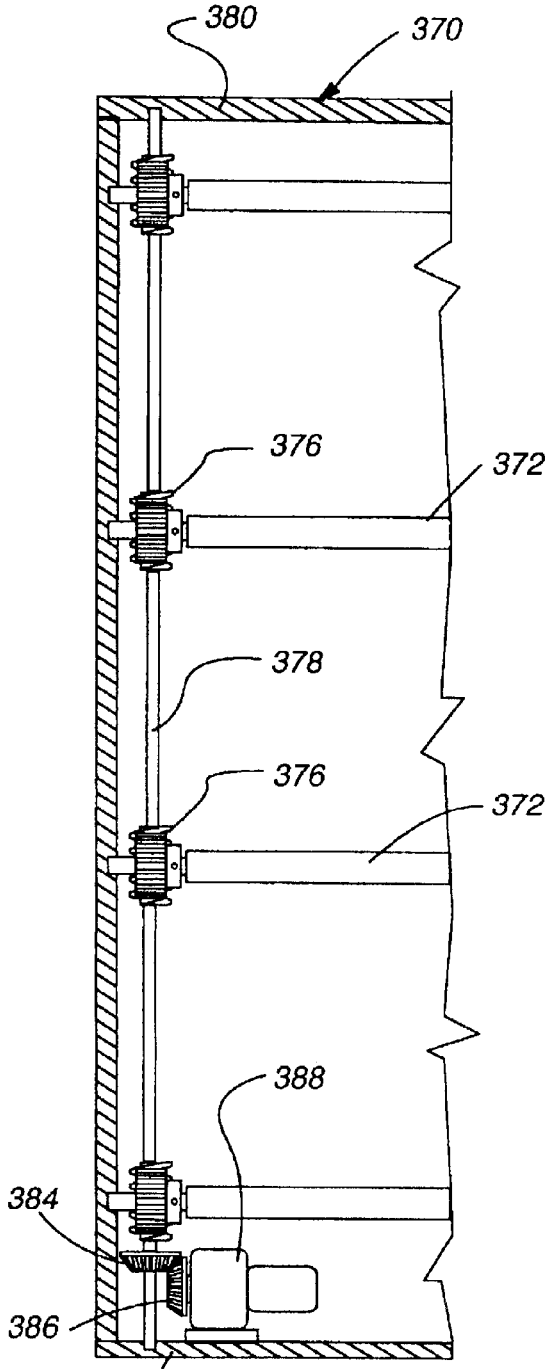
FIG. 48 is a fragmentary rear elevation showing an alternative drive system for rotating rollers in a covering of the type disclosed in FIG. 1.

FIGS. 48 and 49 illustrate an alternative way for operating a system of the type disclosed in FIGS. 1–19 and in this arrangement there is, again, an outer framework 370 with horizontally mounted rollers 372 that support flexible strips of material (not shown) that can be wrapped around the rollers. One end of each roller has a spur gear 374 thereon which is in meshed engagement with aligned worm gears 376 spaced along the length of a vertical drive rod 378 that is rotatably supported in upper and lower frame members 380 and 382, respectively. The vertical drive rod carries a bevel gear 384 near its lower end which is meshed with a bevel gear 386 on the drive shaft of an electric motor 388 such that rotation of the drive shaft in one direction causes the rollers associated with each shade component to rotate in one direction, and rotation of the drive shaft in the opposite direction causes an opposite directional rotational movement of the rollers. Of course, the electric motor could be remotely controlled or manually switched on and off to affect an operation of the covering.

Figure 51:
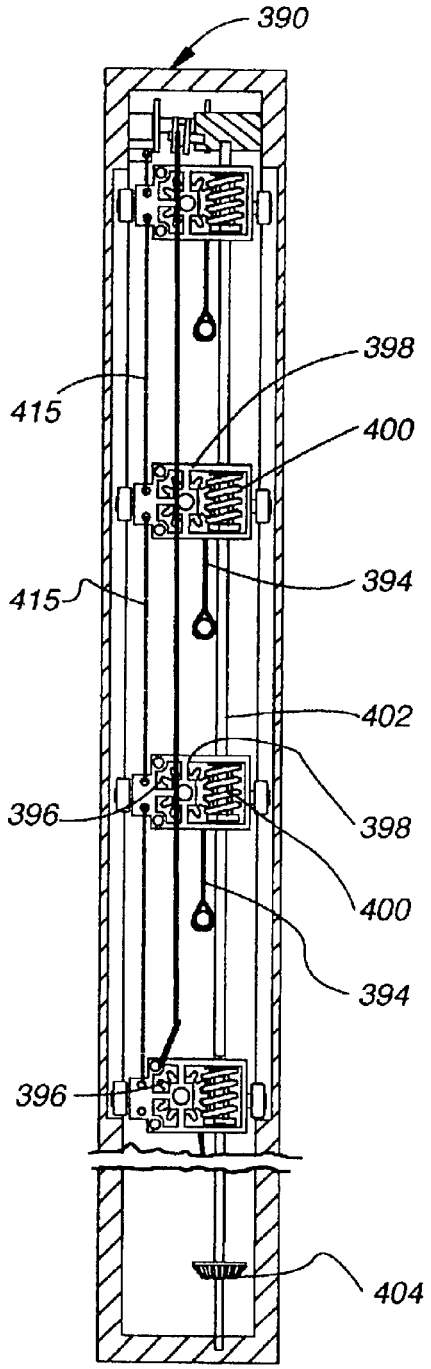
FIG. 51 is a fragmentary vertical section taken through the covering shown in FIG. 50.
Figure 50:
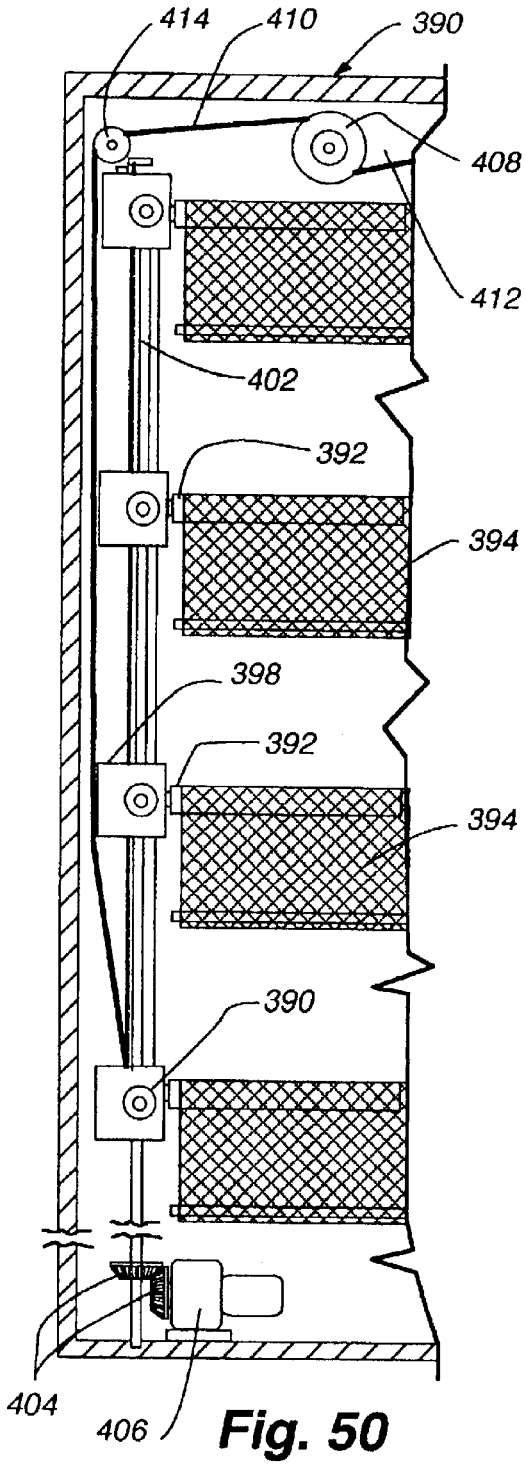
FIG. 50 is a fragmentary front elevation showing still another embodiment of a covering in accordance with the present invention wherein vertically aligned rollers with covering components thereon cannot only be extended and retracted but the rollers with the covering material thereon can be stacked adjacent the top of the covering.

FIGS. 50 and 51 illustrate another embodiment similar to that shown in FIGS. 48 and 49 where, again, there is an outer framework 390 with horizontally disposed rollers 392 supporting flexible strips of material 394. The rollers, of course, would preferably be hidden behind horizontal dividers which are not shown. Each roller carries on its end a spur gear 396 that is rotatably mounted in a rectangular cage 398 in meshed engagement with a worm gear 400 also in the cage. The worm gear is slidably mounted on a vertical drive rod 402 for unitary rotation with the rod and this could be accomplished by providing the drive rod with a non-circular cross-section that mates with a passage through the worm gear. It will be appreciated that rotational movement of the drive rod, which can be affected through bevel gears 404 by an electric motor 406, will cause the strips of material 394 to extend or retract. A rotatable knob 408 is mounted in the upper end of the framework and has first and second pull cords 410, 412 associated therewith. Only one pull cord 410 is fully illustrated and it extends to the left from the rotatable knob and passes over an idler pulley 414 before extending downwardly to be connected to the cage 398 associated with the lowermost roller. The second drive cord 412 extends to the right and is connected in a similar manner to a carriage associated with the opposite end of the lowermost roller. Rotation of the knob causes the pull cords to be wrapped therearound thereby pulling the cage associated with the lowermost roller upwardly and it, in turn, engages the cage immediately above and this sequentially occurs until each cage and associated roller and strip material is stacked adjacent the top of the frame. The stacking, of course, can be accomplished with or without first retracting the strips of material with the electric motor. Spacer cords 415 interconnect each adjacent cage so that when the knob is rotated in an opposite direction and the cages are lowered it will have a predetermined spacing.

Figure 53:
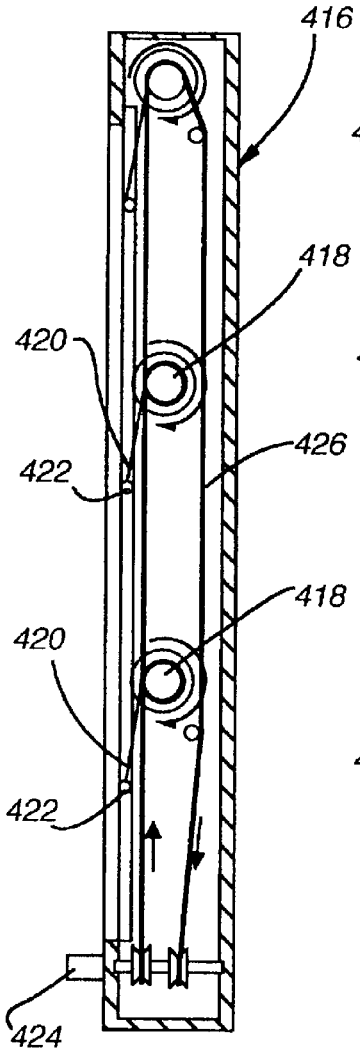
FIG. 53 is a vertical section taken through the covering of FIG. 52.
Figure 52:
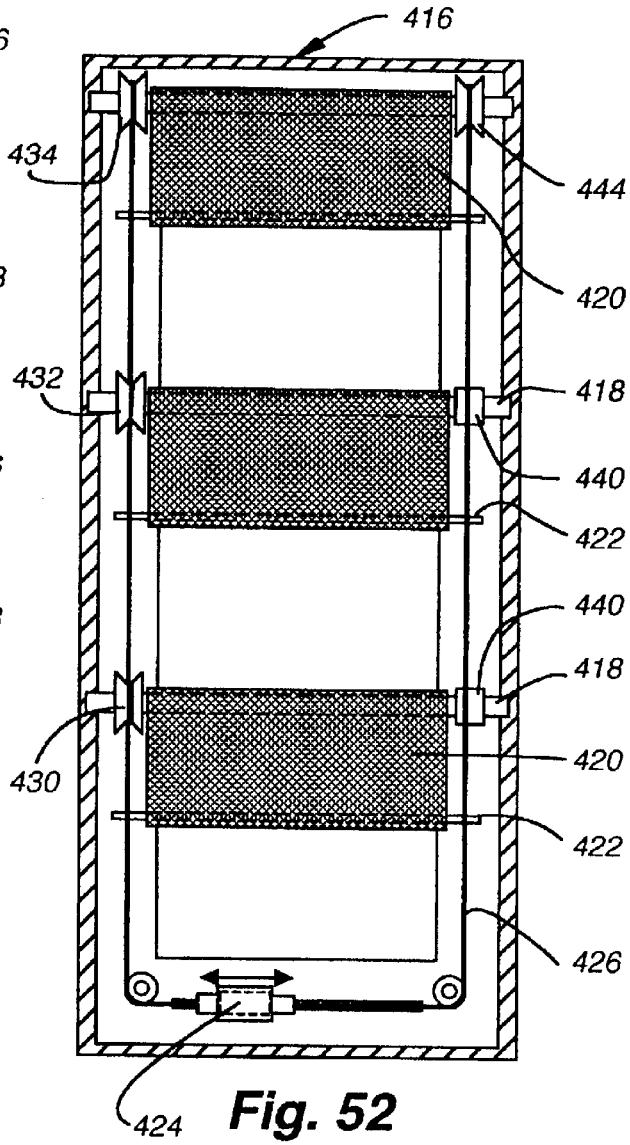
FIG. 52 is a diagrammatic front elevation of another embodiment of a covering in accordance with the present invention showing a different control system for moving the covering components between extended and retracted positions.
Figure 54:
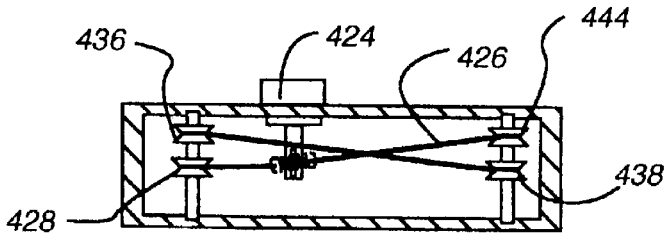
FIG. 54 is a horizontal section taken through the covering of FIG. 52.

FIGS. 52–54 illustrate another embodiment of a shade that is similar to the embodiment shown in FIGS. 1–19. In this embodiment, there is an outer framework 416 and horizontal rollers 418 supporting strips of material 420 that can be wrapped or unwrapped from the roller. The free edge of each strip of material has a weighted rod 422 that pulls the strip of material downwardly as it is unrolled from its associated roller. A finger slide 424 is mounted in the lower frame member for sliding movement in a horizontal direction and one continuous drive cord 426 that operatively interconnects the rollers with the finger slide. The cord is connected at one end to the finger slide and extends around a rear idler pulley 428 of a first pair of idler pulleys in the lower left hand corner of the framework, as viewed in FIGS. 52 and 54, and then extends upwardly where it is wrapped around a drive pulley 430 associated with the lowermost roller. The pulley 430 is keyed to the lowermost roller 418 so that rotation of the pulley causes rotation of the roller. After having been wrapped around the pulley 430, the cord extends upwardly and is wrapped around a drive pulley 432 associated with the next adjacent upper roller and sequentially until it reaches the top roller, and after having been wrapped around the drive pulley 434 associated with the uppermost roller, the drive cord extends downwardly and is passed around the front idler pulley 436 of the first pair of idler pulleys in the lower left hand corner of the frame as best seen in FIG. 54. From there the cord extends laterally to the lower right side of the frame where it passes around the rear pulley 438 of a second pair of idler pulleys. The cord then extends upwardly adjacent to guide cylinders 440 on each roller, with the cord ultimately passing around an idler pulley 442 associated with the uppermost roller at the top of the device and then downwardly again around the front pulley 444 of the second pair of pulleys in the lower right hand corner before again being anchored to the finger slide 424. It will be appreciated with this arrangement, that sliding movement of the finger slide in one direction causes the rollers to simultaneously rotate in one direction which unwinds the strips of material therefrom and due to the weighted rods, the strips of material continue to fall downwardly. Movement of the slide member in the opposite direction causes the rollers to rotate in the opposite direction thereby wrapping the strips of material therearound and lifting the weighted rods 422.

It will be appreciated from the description above that numerous arrangements of coverings for architectural openings have been described which are specifically suited for covering individually or in multiples the relatively small panels formed in simulated divided light windows. The systems would not have to be used in simulated divided light windows but do find a unique application therein. It will also be apparent to those skilled in the art that various combinations of features found in the embodiments described could be employed so that there would be numerous other arrangements derivable from the embodiments disclosed herein. Also, the manner in which the covering components are manipulated could take various forms other than those illustrated.

It will also be appreciated that with systems of the type described, the entire architectural covering is substantially hidden from view or is invisible to a viewer when the system is fully retracted as the shade components are hidden behind the muntins and the finger slide is substantially unnoticeable with the operating components associated with the slide being hidden within the frame members of the insert. It will also be appreciated that the covering of the present invention is adapted for use with various types of retractable coverings such as roller shades, collapsible cellular shades, Venetian blinds, vertical blinds, etc. It is also to be appreciated that the covering can be fully extended and retracted with a relatively short stroke of the finger slide, with the short stroke being less than the entire height or width of the architectural opening in which the covering is mounted.

It should also be pointed out that the various embodiments of the insert previously described can be mounted in windows or the like in various other ways. For example, the insert can be affixed, as with adhesive, directly to the main or base panel of glass in a window or can be inserted between panels of glass in double pane windows. In some windows a removable glass panel is provided for seasonal or other use with an example being a removable panel window currently sold under the Pella™ trademark. These windows have a base panel of glass or even a double panel of glass and, in addition, the removable panel. The insert of the present invention could replace the removable glass panel or it could be secured to the removable glass panel or the base panel with adhesive or by other means so that the insert was positioned between the base panel and the removable panel. Whether the insert was secured to the base panel or the removable panel, the removable panel could still be selectively removed.

Figure 55:
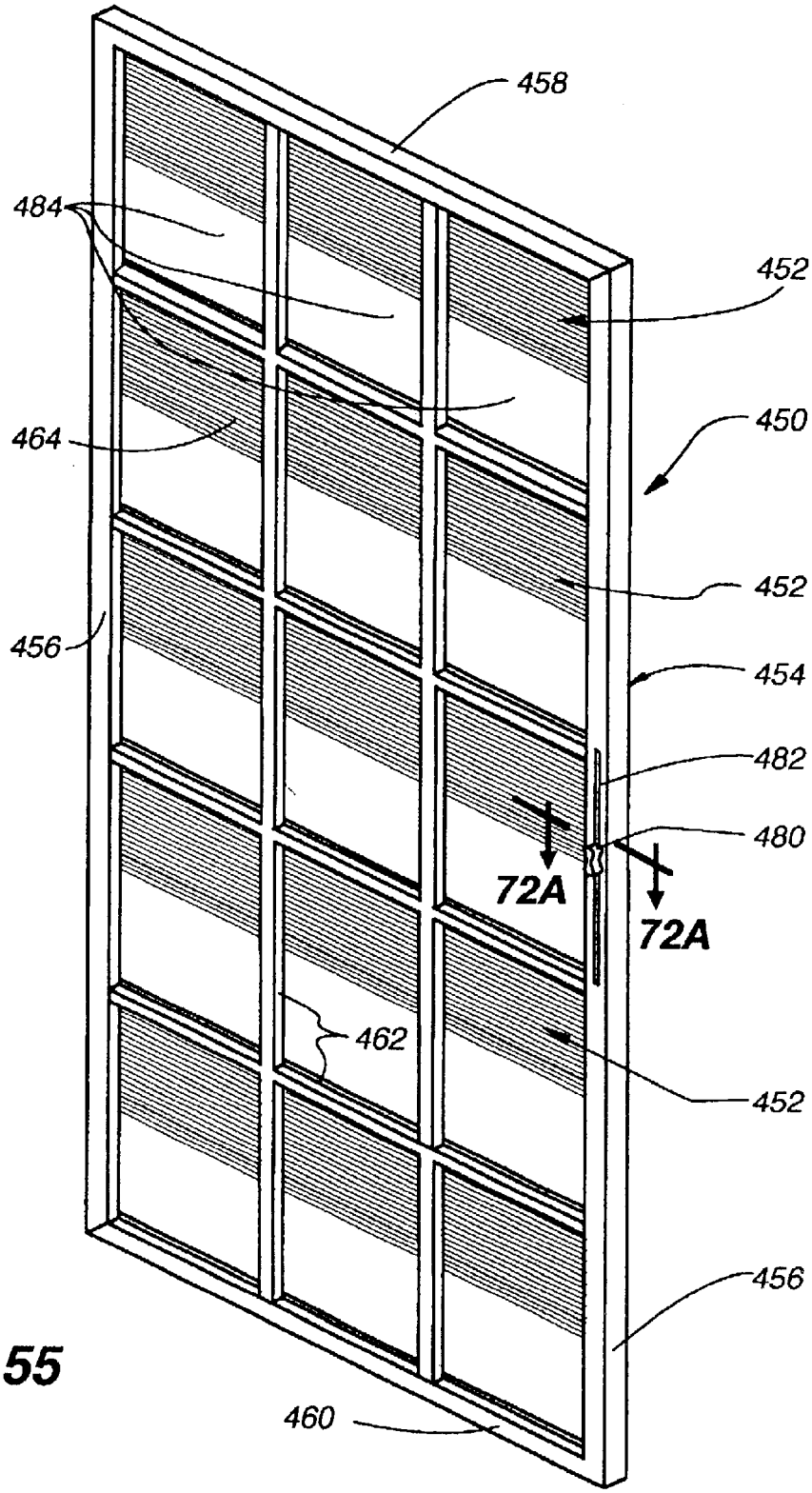
FIG. 55 is a front isometric view of still another embodiment of the present invention with a plurality of collapsible shades shown mounted in a divided window frame in a partially extended position.
Figure 56:
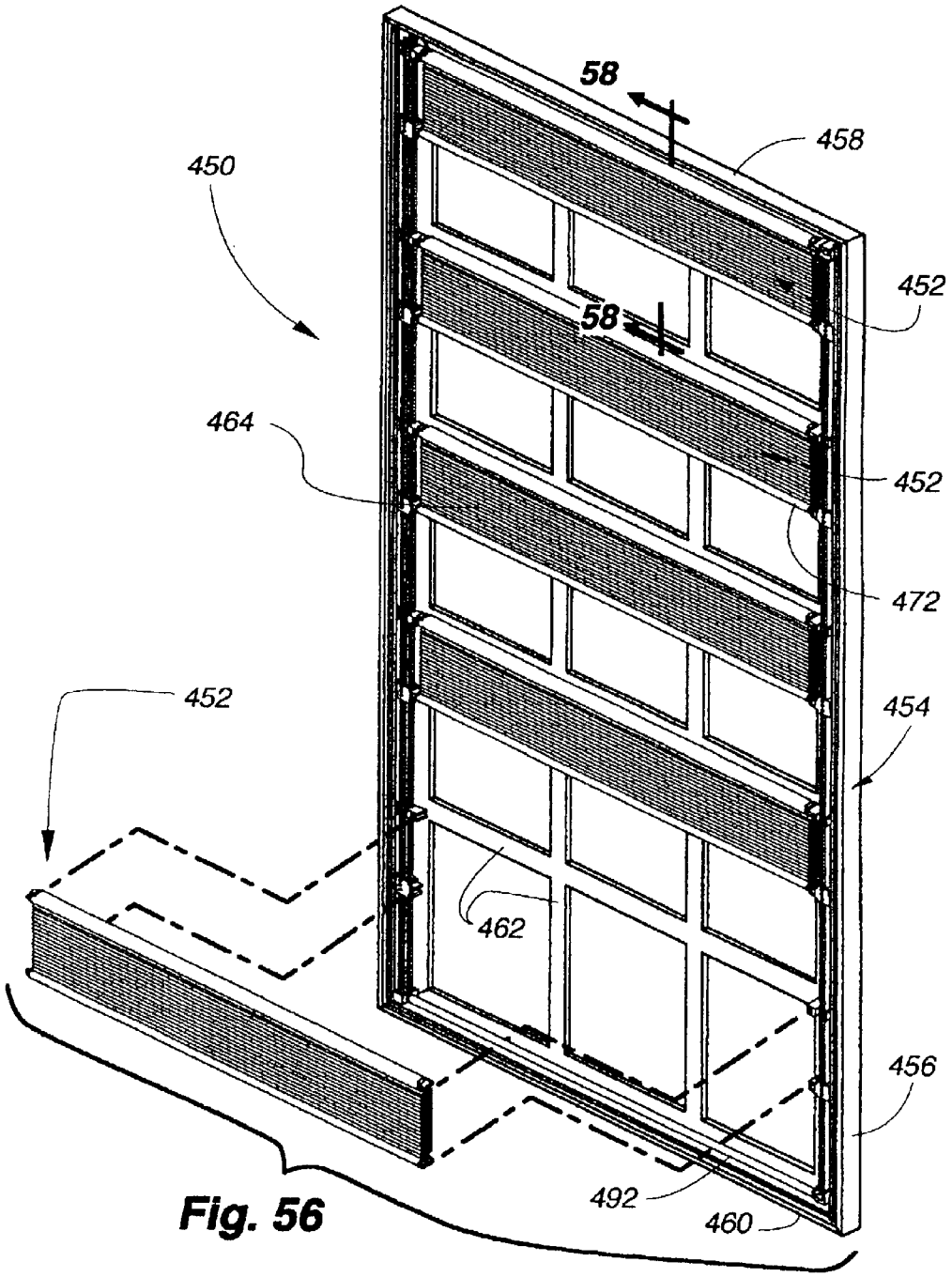
FIG. 56 is an isometric view looking at the rear of the covering shown in FIG. 55 with one of the shade components having been removed.
Figure 57:
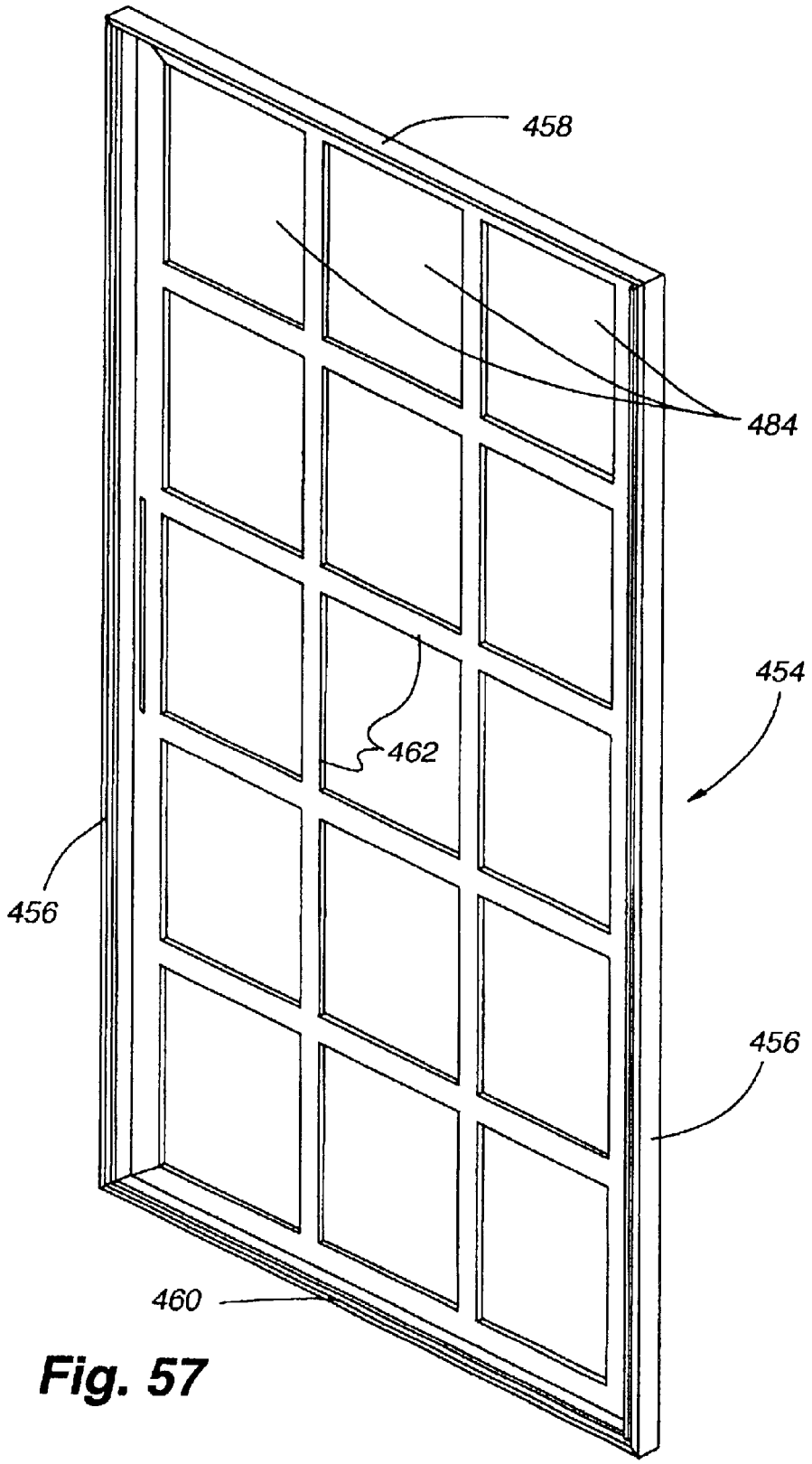
FIG. 57 is an isometric looking at the rear of the frame portion of the covering shown in FIG. 55.

Another embodiment 450 of the present invention is shown in FIGS. 55–94 and with reference first to FIG. 55, the embodiment can be seen to include a plurality of shade components 452 mounted on a framework 454 having an outer peripheral frame with two vertical side frame members 456 and a top 458 and bottom 460 frame member. A plurality of vertical and horizontal cross frame members or muntins 462 are also provided. A shade component 452 is associated with each horizontal muntin as well as the top frame member and as will be explained in more detail later, the shade components are removably mounted so that they can be replaced or removed for cleaning purposes or the like. FIG. 56 shows the lowermost shade component having been removed.

Figure 59:
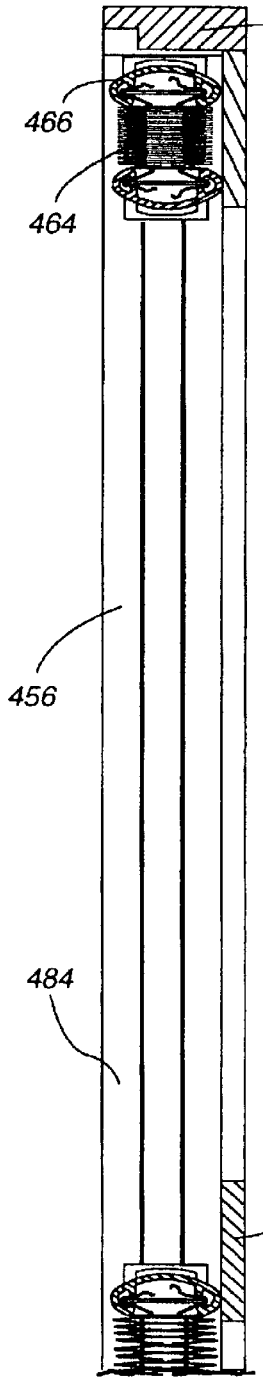
FIG. 59 is a fragmentary vertical section similar to FIG. 58 with the collapsible shade in a fully retracted position.
Figure 58:
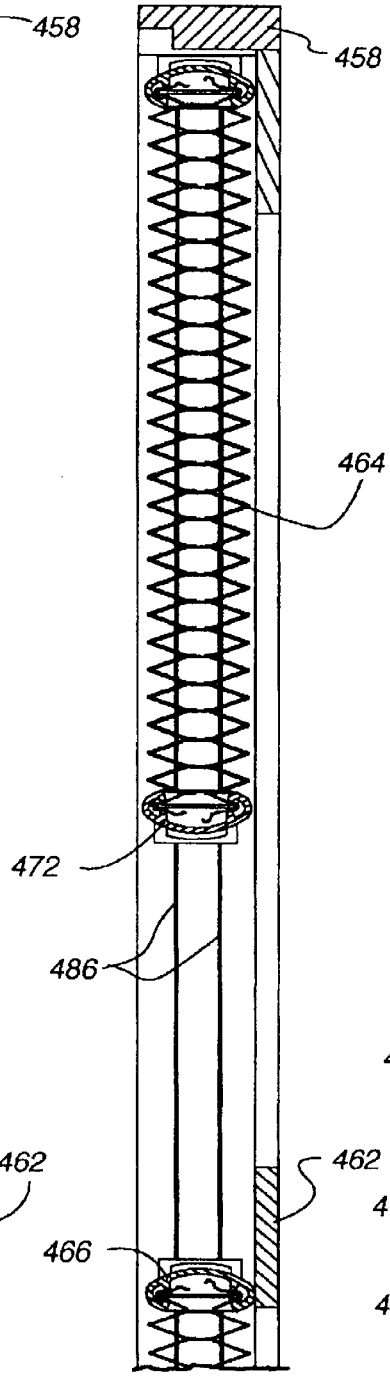
FIG. 58 is an enlarged fragmentary vertical section taken along line 58—58 of FIG. 56.
Figure 60:
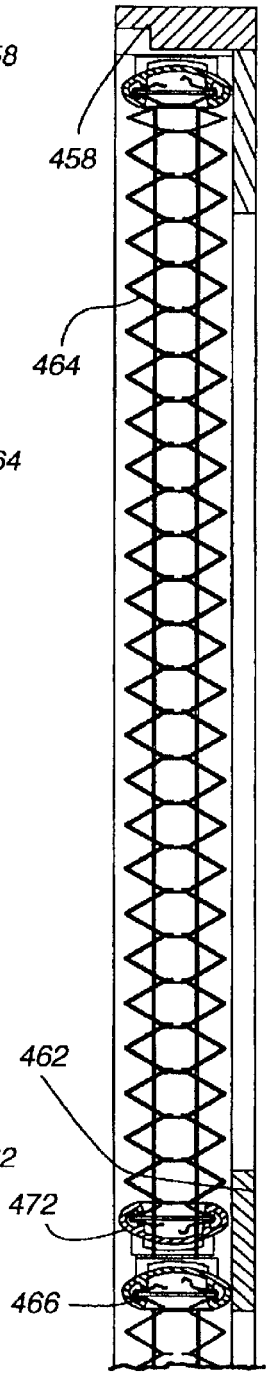
FIG. 60 is a section similar to FIG. 58 with the retractable shade in a fully extended position.
Figure 88:
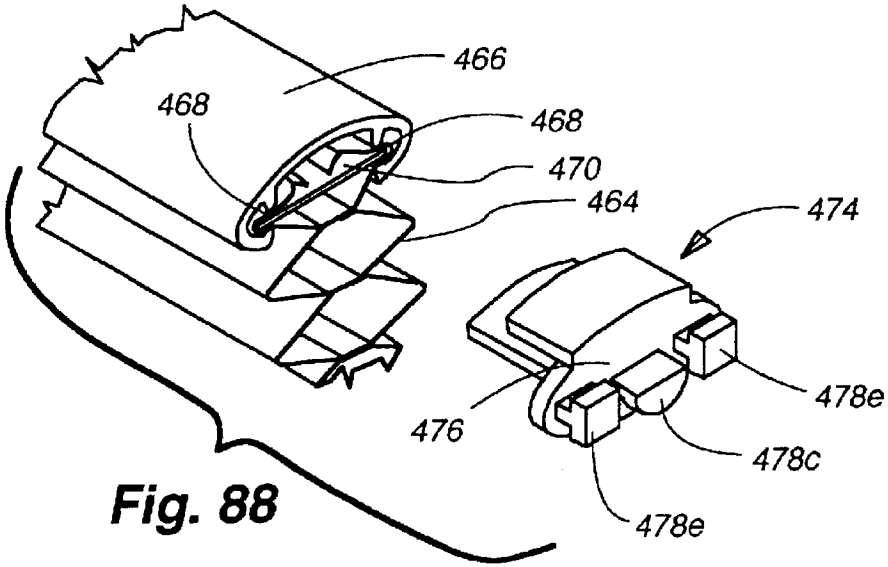
FIG. 88 is a fragmentary isometric view of the end of a top rail with an end cap shown in exploded relation thereto.
Figure 90:
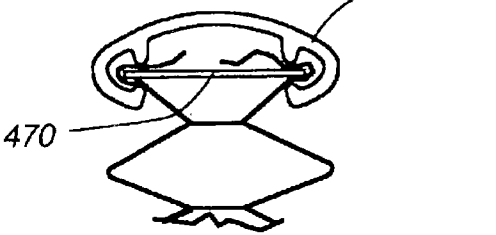
FIG. 90 is a fragmentary end elevation of the top rail as shown in FIG. 88.

Referencing FIGS. 58–60, a curtain 464 used in the shade component is illustrated as a collapsible shade of the cellular type, it being recognized that any collapsible shade could be utilized such as a pleated shade or the like. The collapsible shade or curtain 464 has an uppermost cell which is secured in a downwardly opening channel-shaped top rail member 466 as shown in FIG. 88. The channel-shaped top rail can be seen to include a pair of opposed open grooves 468 along each side edge so that the uppermost cell of the curtain can be inserted into the open channel and a long rigid or semi-rigid strip 470 inserted into the interior of the uppermost cell. The edges of the strip are received in the open grooves 468 to hold the uppermost cell in the top rail. The remaining depending cells hang vertically downwardly and the lowermost cell is attached to a bottom rail 472 which is identical to the top rail except that it has been inverted. The attachment, of course, of the lowermost cell to the bottom rail is identical to the uppermost cell to the top rail.

An end cap 474, as probably best seen in FIGS. 88, 89, 91 and 92, is inserted into each open end of both the top rail 466 and the bottom rail 472 and includes a face plate 476 having three cooperating tabs 478 utilized to connect the end of the top and bottom rails to a transfer system for moving the shade between a retracted (FIG. 59) and expanded (FIG. 60) position. There are three tabs with the outermost or end tabs 478*e* being of generally T-shaped cross section and a center tab 478*c* of semi-cylindrical configuration. The tabs cooperate in a manner to be described hereafter.

Each shade component 452, therefore, includes a top rail 466, a bottom rail 472 and a collapsible curtain 464 therebetween and as will be explained later, the top rail is releasably fixed to the outer frame in cooperation with a transfer system and the bottom rail is releasably attached to transfer system which is adapted to move the bottom rail toward and away from the top rail in synchronization with the bottom rails of the other shade components. The transfer mechanism is mounted in the two vertical side frame members 456 and is operated by a finger slide 480, as seen in FIG. 55, that is disposed for movement in a slot 482 formed in the right side frame member so that as the finger slide is moved up and down in the slot, the shade components 452 are retracted and extended simultaneously and in synchronism.

Looking again at FIGS. 58–60, the uppermost shade component 452 can be seen fully retracted in FIG. 59 with the next lowermost shade component also in a retracted position. In FIG. 58, the upper shade component has been partially extended across three horizontally adjacent openings 484 of the divided light architectural opening and as partially shown, the next lower shade component is expanded to the same degree. In FIG. 60, the upper shade component is shown fully expanded across the three horizontally adjacent divided light openings across the top of the frame and as will also be appreciated, the top 466 and bottom 472 rails are positioned in a concealed position behind the horizontal muntin 462 associated therewith.

Figure 61:
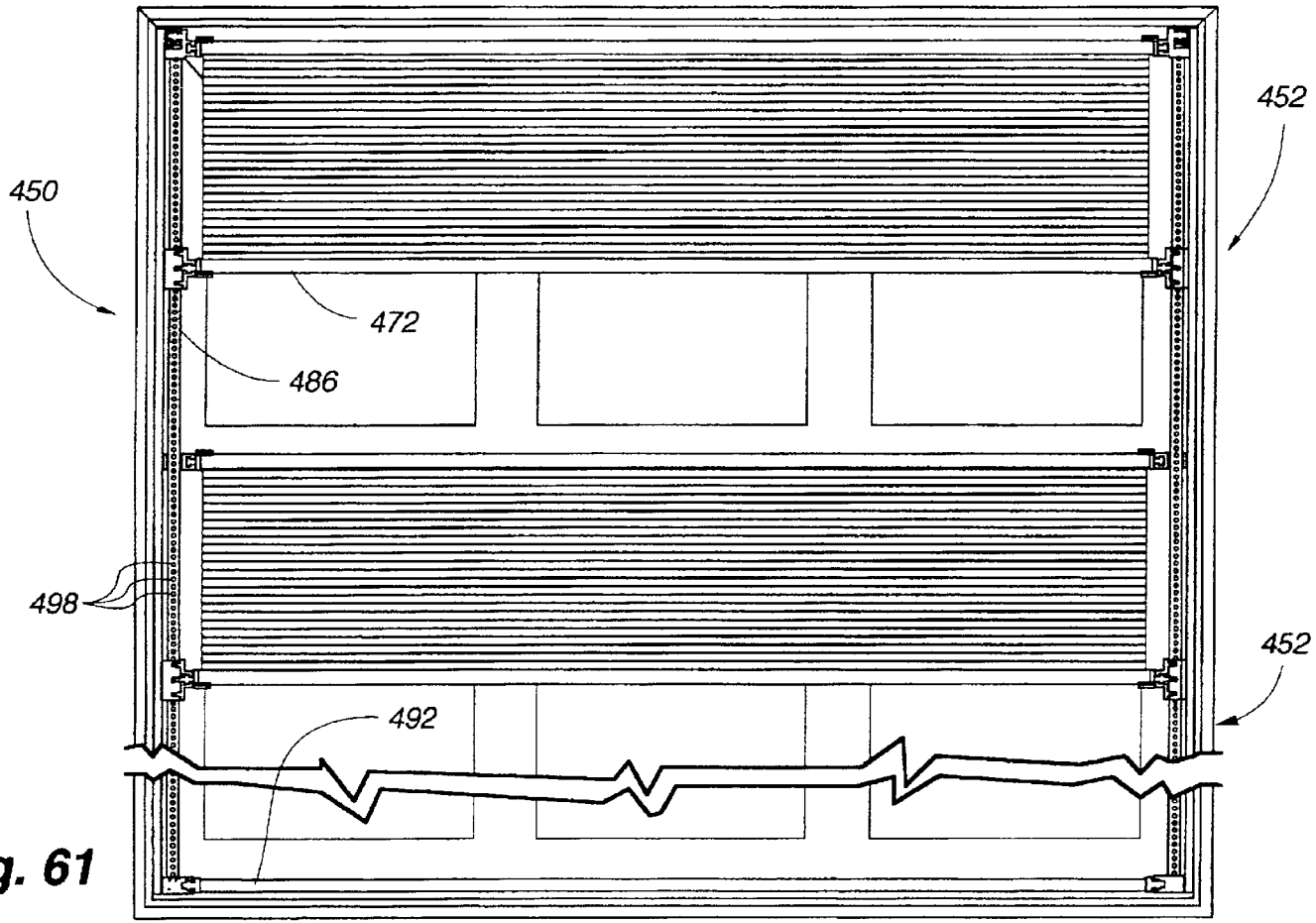
FIG. 61 is an enlarged fragmentary rear elevation of the covering as shown in FIG. 56.
Figure 63:
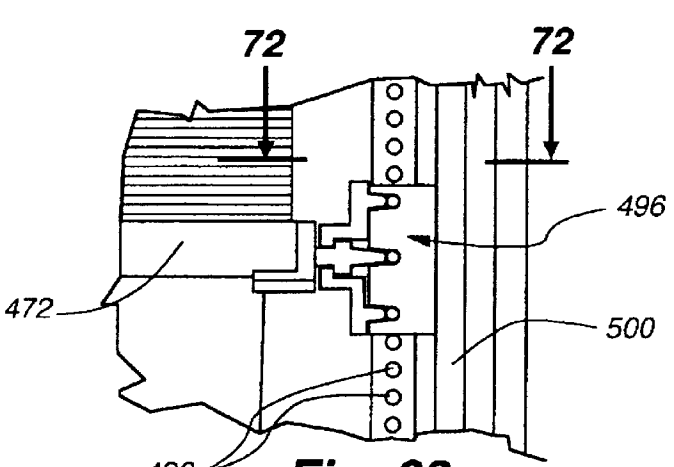
FIG. 63 is an enlarged fragmentary rear elevation showing a bottom rail of a shade component connected in the right frame member of the covering as shown in FIG. 56.
Figure 65:
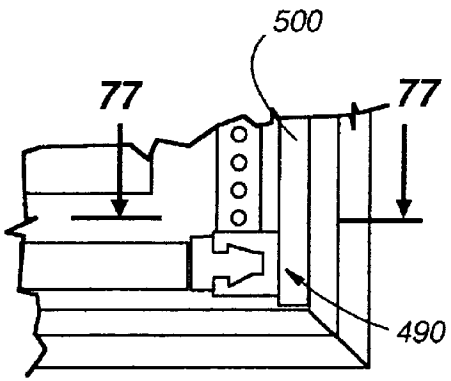
FIG. 65 is an enlarged fragmentary rear elevation of the bottom right-hand corner of the covering as shown in FIG. 56.
Figure 62:
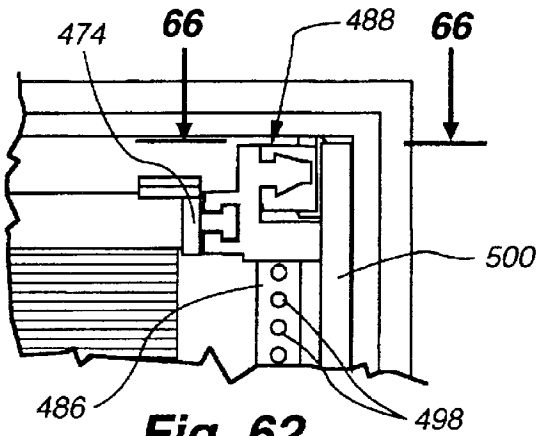
FIG. 62 is an enlarged fragmentary rear elevation of the upper right-hand corner of the covering as shown in FIG. 56.

The transfer mechanism for moving the shade components between the extended and retracted positions is probably best generally seen in FIG. 61, as well as FIGS. 58–60, to include a transfer or drive belt 486 positioned in each of the vertical side frame members 456 with the belt being an endless belt that passes around concealed rollers or pulleys at the top and bottom of the frame. Upper 488 and lower 490 fixed mounting brackets support the rollers with the upper mounting bracket also releasably supporting the top rail 466 of the uppermost shade component and the lower bracket also operatively supporting a transfer rod 492 that extends across the bottom of the frame within the bottom frame member 460. The transfer rod is provided to synchronize movement of the transfer belts on both sides of the frame.

The top rails 466 of all but the uppermost shade component are releasably, but securely, fixed to the side frame members with another connector bracket 494 and the bottom rail 472 of each shade component is connected to the transfer belt with a releasable slide bracket 496. As can probably best be seen in FIG. 61, the transfer belt 486 is a flat, non-elastic but flexible belt, having a plurality of uniformly spaced openings or holes 498 along its length and as will be appreciated with the description that follows, the openings are adapted to cooperate with bead-like protrusions on the rollers at the top and bottom of the frame to synchronize and positively drive the belts.

Figure 66:
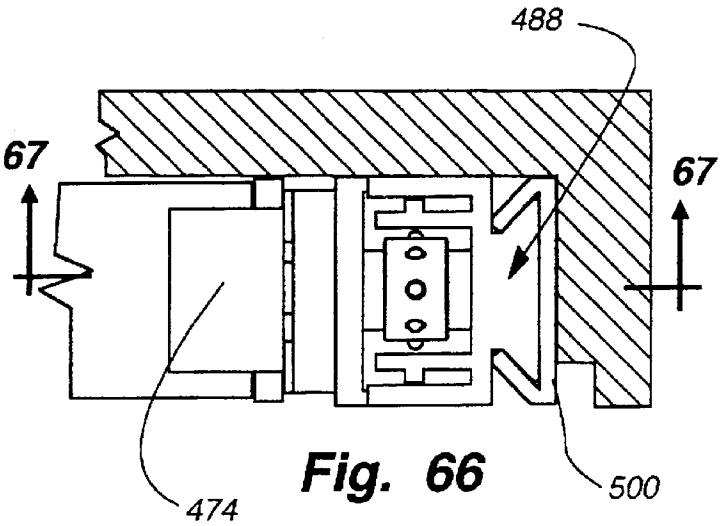
FIG. 66 is an enlarged fragmentary section taken along line 66—66 of FIG. 62.
Figure 67:
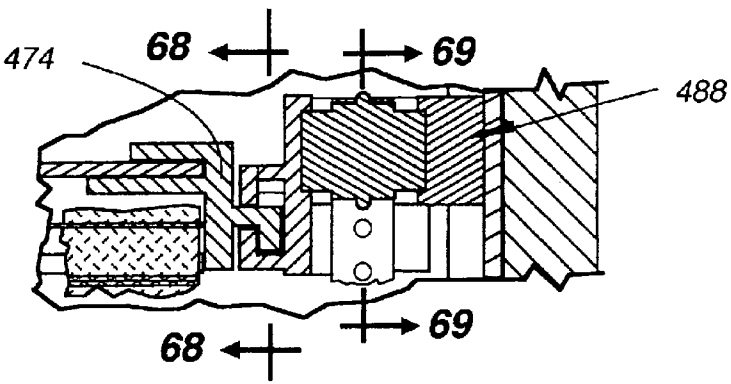
FIG. 67 is a fragmentary section taken along line 67—67 of FIG. 66.
Figure 72:
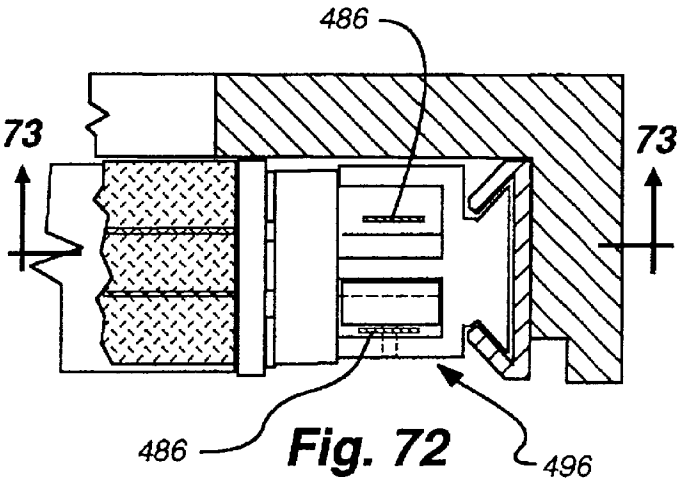
FIG. 72 is an enlarged fragmentary section taken along line 72–72 of FIG. 63.

Vertically extending channel guides 500, as probably best seen in FIGS. 66 and 72, extend upwardly along the inner surface of the left and right side frame members 456 and open inwardly while defining a generally trapezoidal shaped channel therein. The channel guides are adapted to guide movement of the various components of the transfer system and also serve as a mounting for some of those components. The channel guides can be adhesively or mechanically secured to the side frame members so as to define a positive guide track for the transfer system.

Figure 81:
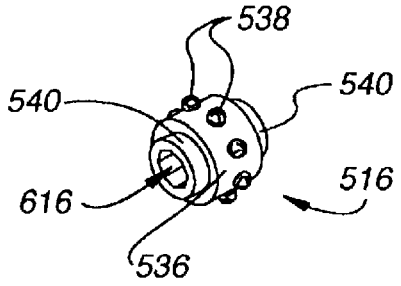
FIG. 81 is an isometric view of a roller used at the top and bottom ends of the transfer belt in the left and right side frame members.
Figure 82:
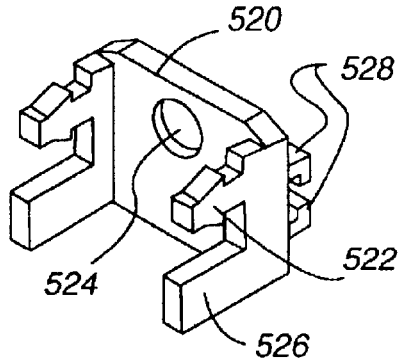
FIG. 82 is an isometric of the rear side of the male bracket member used to releasably mount one end of the top rail of the uppermost shade component in the covering of FIG. 55.
Figure 83:
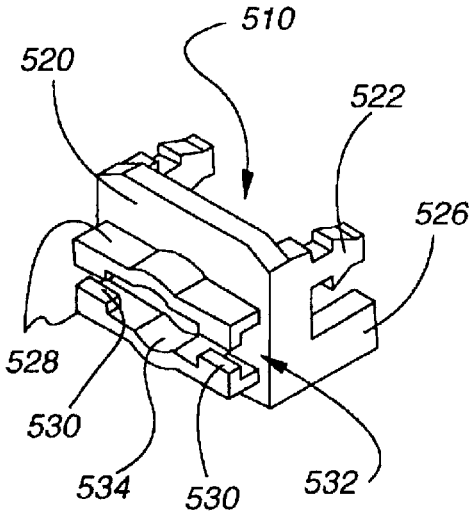
FIG. 83 is a front isometric view of the bracket shown in FIG. 82.
Figure 84:
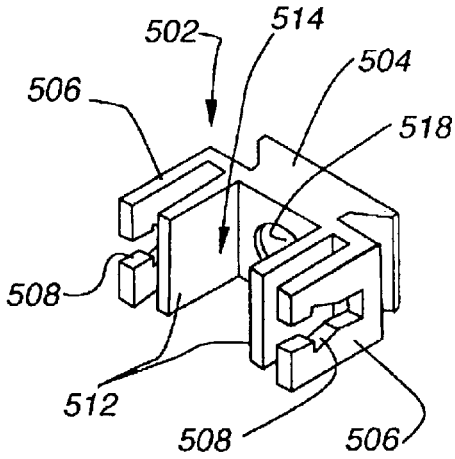
FIG. 84 is a rear isometric view of the female bracket used to mount the top rail of the uppermost shade component and to mount the transfer rod at the bottom of the covering shown in FIG. 55.

The uppermost mounting bracket 488 is probably best seen in FIGS. 62, 66–69 and 81–84 to include a female component 502 (FIG. 84) having a base connector 504 of generally trapezoidal configuration adapted to conform with and be received in the associated channel guide 500 and is adhesively or otherwise secured in position at the top of the channel guide. The female component has parallel outer arms 506 projecting inwardly and defining generally arrow-shaped slots 508 for releasably receiving the male component 510 of the bracket (FIGS. 82 and 83). Spaced inwardly from the outer arms are a pair of parallel inner arms 512 which define a vertically extending groove 514 adapted to rotatably receive the roller member 516 shown in FIG. 81. A blind hole 518 is provided in the groove that opens inwardly and is adapted to rotatably receive the roller member to provide a bearing support therefor.

The male component 510 of the upper bracket 488 has a base plate 520 with a pair of arrow-shaped catch arms 522 projecting outwardly and adapted to be aligned with and releasably received in a snap lock relationship in the arrow-shaped slots 508 in the outer arms of the female component. On the outer face of the base plate, a circular blind hole 524 is provided that is adapted to be aligned with the blind hole 518 in the female component and the blind holes are designed to rotatably support the roller 516, as will be described hereafter. A pair of support arms 526 extend beneath but are spaced from the catch arms 522 and are adapted to protrude beneath the outer arms 506 of the female component to rigidify the connection between the two components. On the inner face of the base plate 520 of the male component, a pair of spaced horizontal catch plates 528 are provided which have end protuberances 530 that are spaced from the base plate and thereby define a channel 532 between the catch plates and the base plate. At the center of each catch plate an arcuate recess 534 is provided. The catch plates are adapted to releasably receive the end cap 474 of the top rail 466 of the uppermost shade component by sliding the tabs 478 protruding from the end cap into an open end of the channel 532 defined between the catch plates and the base plate of the male component. The semi-cylindrical or center tab 478*c* on the end cap becomes nested within the arcuate recess 534 of the lower catch plate to cooperate with the T-shaped tabs 478*e* in releasably retaining the end cap between the catch plates.

The pulley or roller 516 which is in essence a timing cog roller and seen best in FIG. 81, includes a main cylindrical body 536 with a plurality of hemispherical beads 538 equally spaced circumferentially therearound. A pair of stub shafts 540 protrude axially from the main cylindrical body in opposite directions and are adapted to be rotatably received in the blind hole 524 in the male component and the blind hole 518 in the female component. The roller is adapted to receive the uppermost run of the timing belt with the beads, of course, being operatively received in the spaced holes 498 in the drive belt so that there is no slippage in rotation of the drive belt.

Figure 64:
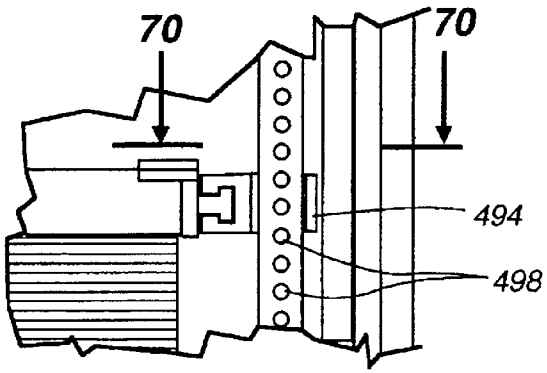
FIG. 64 is an enlarged fragmentary rear elevation showing the top rail of a shade component (other than the uppermost shade component) connected in the right frame member of the frame as shown in FIG. 66.
Figure 68:
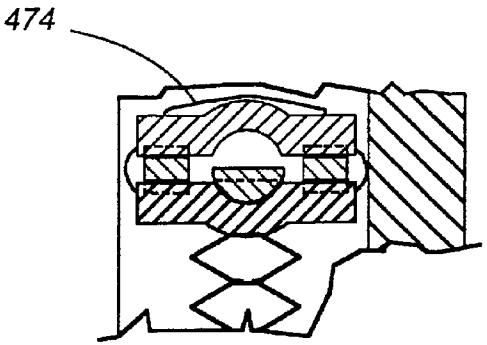
FIG. 68 is a fragmentary section taken along line 68—68 of FIG. 67.
Figure 69:
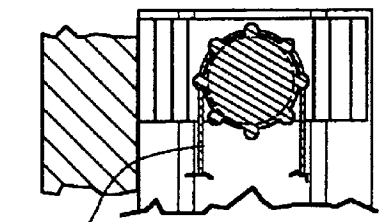
FIG. 69 is a fragmentary section taken along line 69—69 of FIG. 67.
Figure 71:
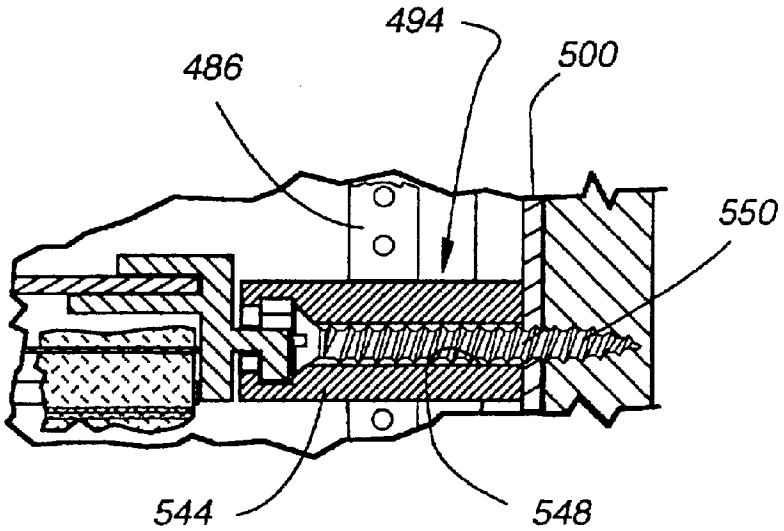
FIG. 71 is a fragmentary section taken along line 71—71 of FIG. 70.
Figure 70:
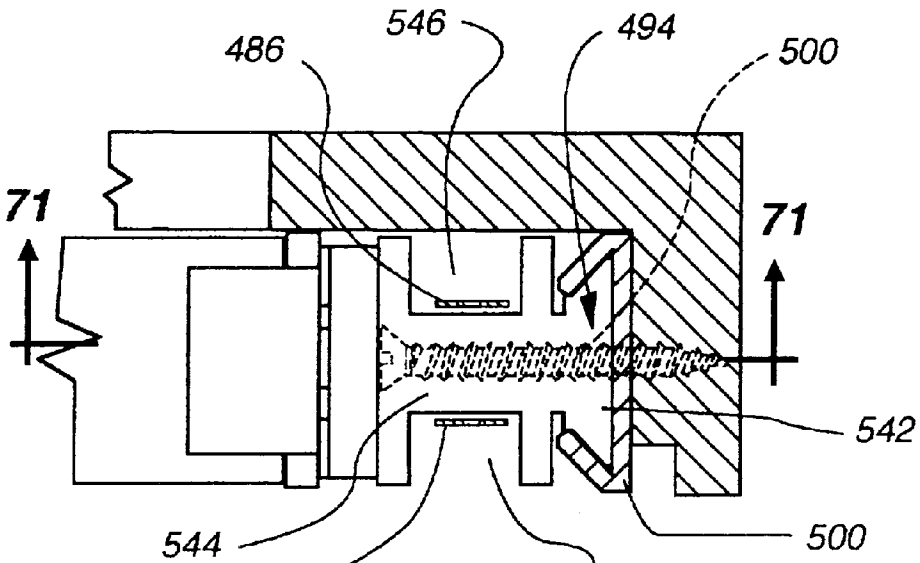
FIG. 70 is an enlarged fragmentary section taken along line 70—70 of FIG. 64.

The top rail 466 of each shade component 452, except the uppermost shade component, is releasably secured to the side frame members 456 with the bracket 494, as best seen in FIGS. 64, 70 and 71. The bracket 494 has a generally trapezoidal-shaped main body 542 that can be slid longitudinally along the length of the channel guide 500 until it is positioned at a desired elevation, for example, in alignment with a horizontal muntin 462 of the frame. Protruding inwardly from the trapezoidal main body is a channel-shaped body 544 that is of generally H-shape in horizontal cross section, as best seen in FIG. 70. The H-shaped cross section defines a channel 546 on each side of the bracket adapted to receive one of the vertical runs of the timing belt 486. The innermost end of the bracket 494 has a pair of spaced catch plates 528 identical to those shown on the male component of the upper bracket and as shown in FIG. 83. The catch or attachment plates thereby define a system by which the end cap 474 of a top rail 466, other than the top rail of the uppermost shade component, can be releasably received by sliding the tabs 478 in the end cap horizontally into the channel 532 defined between the catch plates. A horizontal cylindrical passage 548 is provided through the bracket to receive a screw-type fastener 550 which is adapted to pass not only through the bracket but also the channel guide 500 and into the side frame member 456 at the desired elevation which, as mentioned above, is desirably in alignment with a horizontal muntin 462. It will, therefore, be appreciated that when the top rails of the associated shade components are releasably connected to the brackets, they are positively positioned at a predetermined elevation and horizontally disposed.

Figure 75:
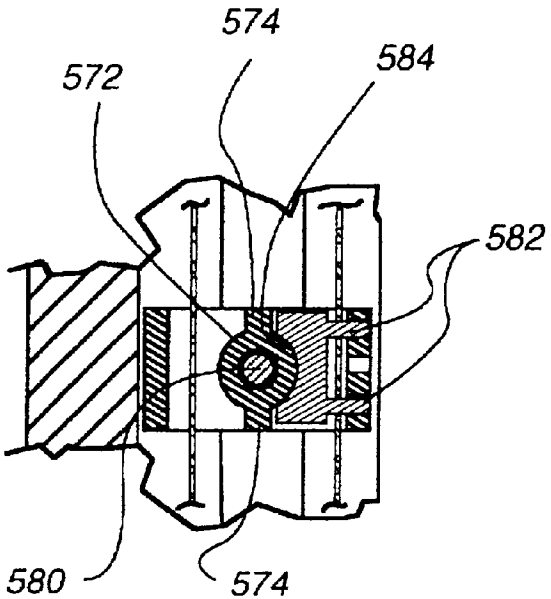
FIG. 75 is a fragmentary section taken along line 75—75 of FIG. 73.
Figure 74:
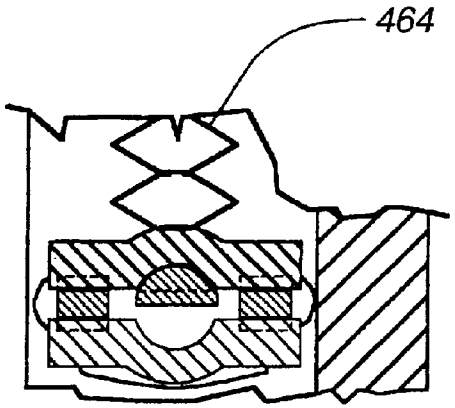
FIG. 74 is a fragmentary section taken along line 74—74 of FIG. 73.
Figure 79:
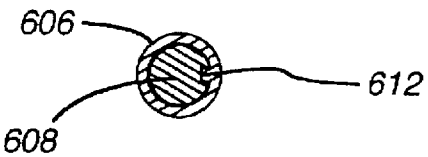
FIG. 79 is a section taken along line 79—79 of FIG. 78.
Figure 80:
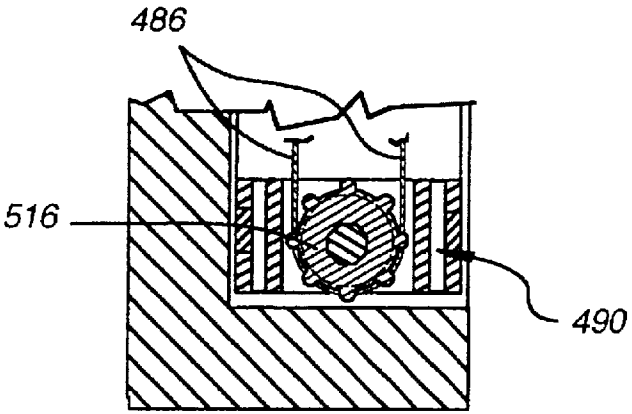
FIG. 80 is a fragmentary section taken along line 80—80 of FIG. 78.
Figure 85:
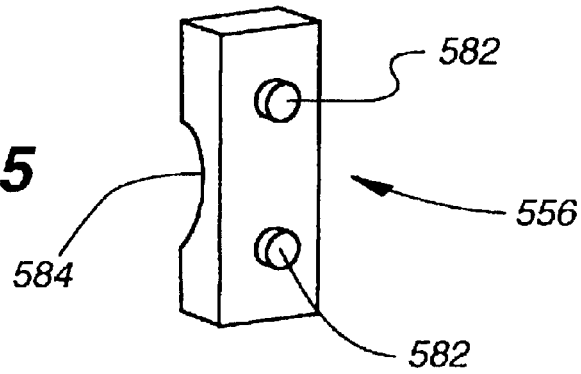
FIG. 85 is an isometric view of the anchor block used to secure the timing belt to a slide bracket used in connecting a bottom rail to the side frame members in the covering of FIG. 55.
Figure 87:
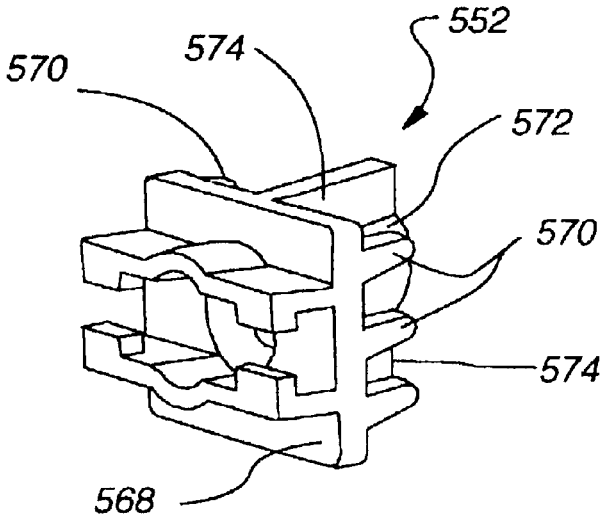
FIG. 87 is a front isometric of the male component of the slide bracket used to connect the bottom rails to a side frame member.

The bottom rail 472 of each shade component 452 is connected to the slide bracket 496 that is best seen in FIGS. 63, 72–76 and 85–87. The slide bracket has a male component 552 (FIG. 87), a female component 554 (FIG. 86) and an anchor block 556 (FIG. 85). The female component has a generally trapezoidal shaped base 558 with a vertical channel 560 therethrough and with the base being adapted to slide within the channel guide 500 vertically along an associated side frame member 456. A base plate 562 that supports the trapezoidal base 558 on one side has a pair of side plates 564 protruding in the opposite or inward direction with each side plate having three generally U-shaped notches 566 therein which open inwardly or toward the opposite side frame member. The male component 552 (FIG. 87) has a base plate 568 having on its innermost face (the face that is directed toward the opposite side frame member) a pair of the catch plates 528 identical to those defined previously in connection with the male component of the uppermost bracket 488. The catch plates are, again, designed to releasably receive the end cap of a bottom rail. A plurality of generally U-shaped fingers 570 project outwardly from opposite ends of the base plate and are in alignment with the notches 566 of the female component. The fingers are slightly shorter than the depth of the notches for a purpose to be described later. Also projecting outwardly from the base plate is a generally cylindrical hub 572 having upwardly and downwardly projecting vertical gussets 574. The hub has a cylindrical horizontal passage 576 therethrough. The passage is aligned with a hole 578 in the base plate of the female member so that a screw-type fastener 580 can be extended therethrough to secure the male component to the female component, as probably best seen in FIG. 73. The anchor block 556 is designed to be disposed between the male and female components, as probably best seen in FIG. 75, with the anchor block having a pair of laterally protruding cylindrical pin-like projections 582 on one side and a cylindrical groove 584 on the opposite side. The cylindrical groove is adapted to mate with the hub 572 on the male component and the pin-like projections are adapted to be received in aligned notches 566 of the female component and held in position by the fingers 570 of the male component, as best seen in FIG. 75. The cylindrical or pin-like projections also project through a pair of holes 498 in the timing or transfer belt 486 so that the slide bracket 496 is securely fixed to the drive belt for unitary movement therewith.

Figure 76:
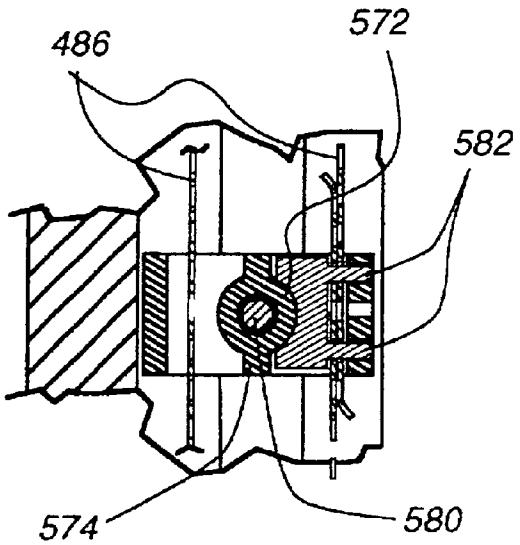
FIG. 76 is a fragmentary section similar to FIG. 75 showing a splice location for the endless transfer belt utilized in the covering of FIG. 55.

The drive belt 486, as mentioned previously, is an endless belt, but it is formed from a strip of flexible material and the two ends of the material can be spliced at one of the slide brackets 496 as illustrated in FIG. 76 so as to form the endless belt. As seen in FIG. 76, the pin-like projections 582 from the anchor block 556 are extended through two layers of the belt at opposite ends of the strip from which the belt is made so that the ends cannot move relative to each other and the belt thereby becomes effectively endless.

Figure 72A:
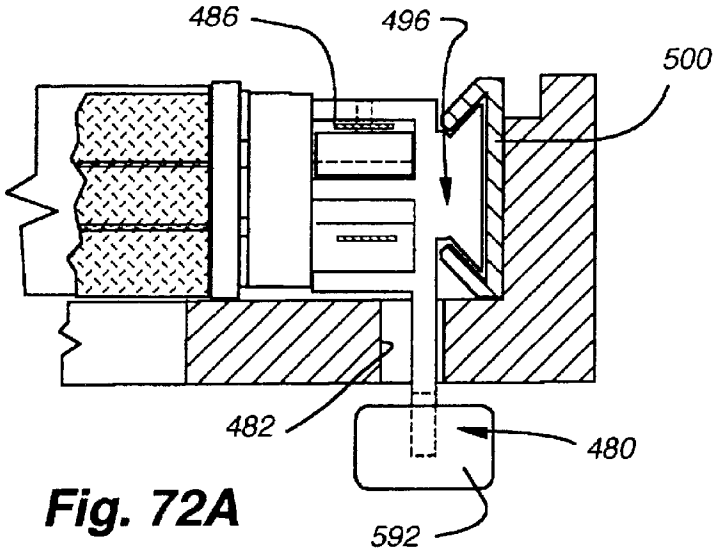
FIG. 72A is an enlarged fragmentary section taken along line 72A—72A of FIG. 55.
Figure 73:
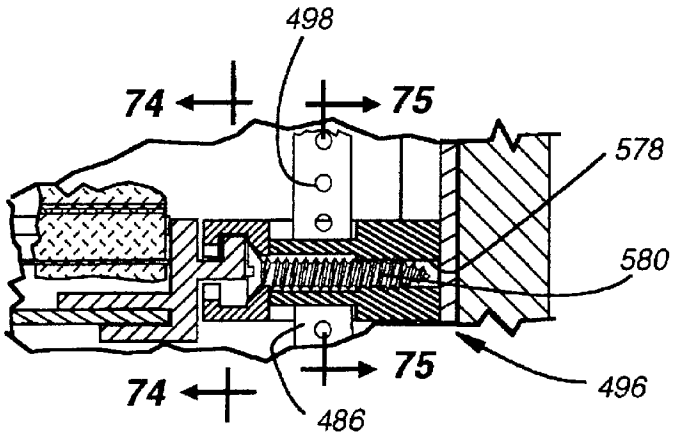
FIG. 73 is a fragmentary section taken along line 73—73 of FIG. 72.
Figure 86:
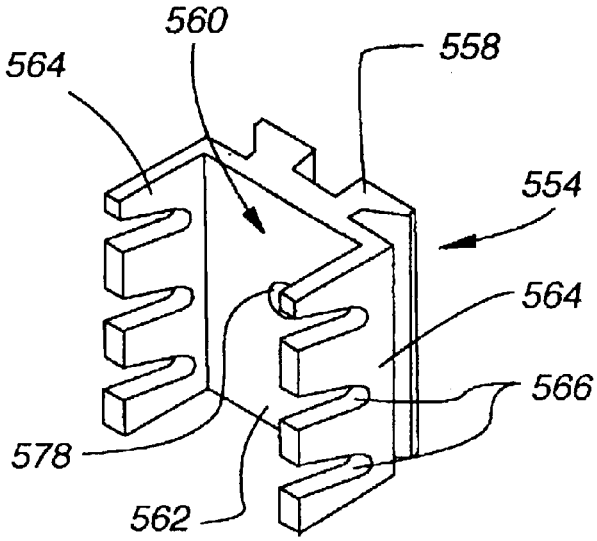
FIG. 86 is a rear isometric view of the female component of the slide bracket used to mount the bottom rail in the side frame members of the covering of FIG. 55.
Figure 86A:
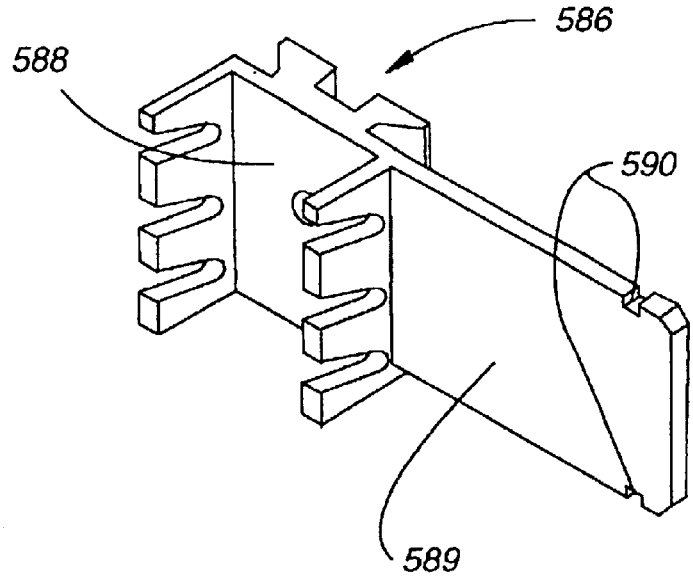
FIG. 86A is an isometric of a variation of the component illustrated in FIG. 86.
Figure 86C:
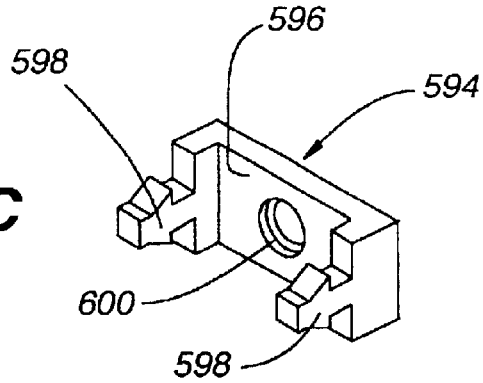
FIG. 86C is an isometric of the rear of the component shown in FIG. 86B.
Figure 86B:
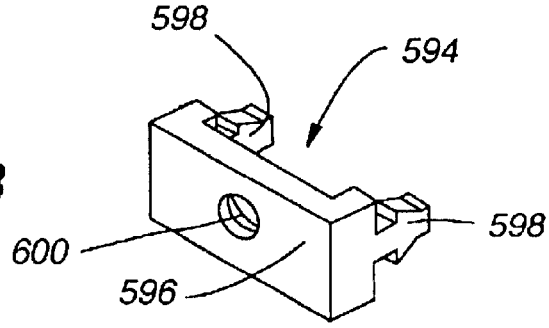
FIG. 86B is an isometric of the front of a male component used with the female component shown in FIG. 84 at the bottom of the frame to mount the transfer rod.
Figure 89:
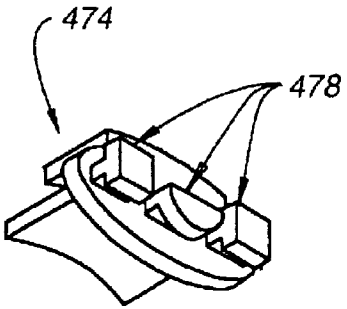
FIG. 89 is an isometric view of the end cap shown in FIG. 88.
Figure 92:
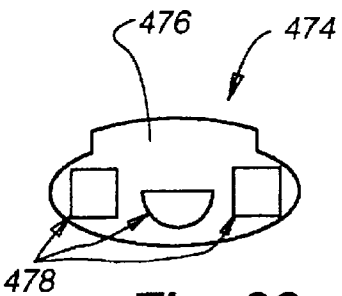
FIG. 92 is an end elevation of the end cap shown in FIG. 89.
Figure 91:
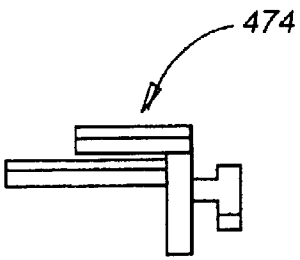
FIG. 91 is a side elevation of the end cap shown in FIG. 89.

The slide bracket 496 on the right end of the shade component that is third down from the top has a modified female component 586 which is illustrated in FIG. 86A. As will be appreciated in FIG. 86A, the base plate 588 of the female component 586 is extended at 589 in a direction toward the front of the frame 454 so that the base plate protrudes forwardly through the slot 482 in the right side frame member 456. A pair of opposed notches 590 are provided in the top and bottom edge of the extension of the base plate which are adapted to releasably receive in a snap-like manner a cap 592 as shown in FIG. 72A which can be grasped by a user of the covering.

Figure 77:
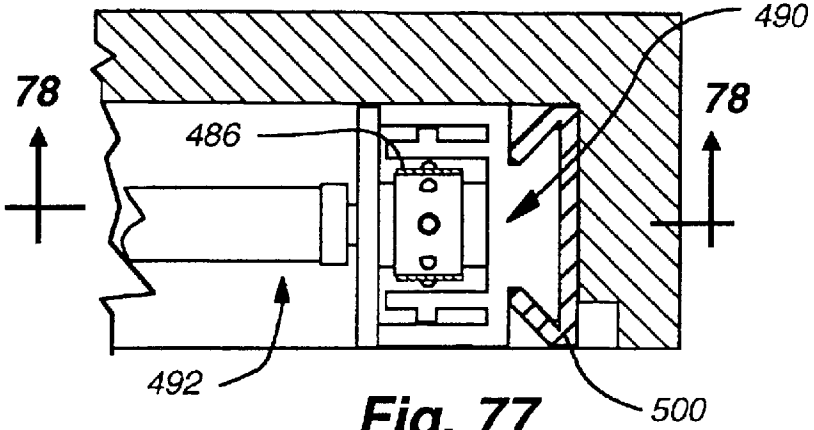
FIG. 77 is an enlarged fragmentary section taken along line 77—77 of FIG. 65.
Figure 78:
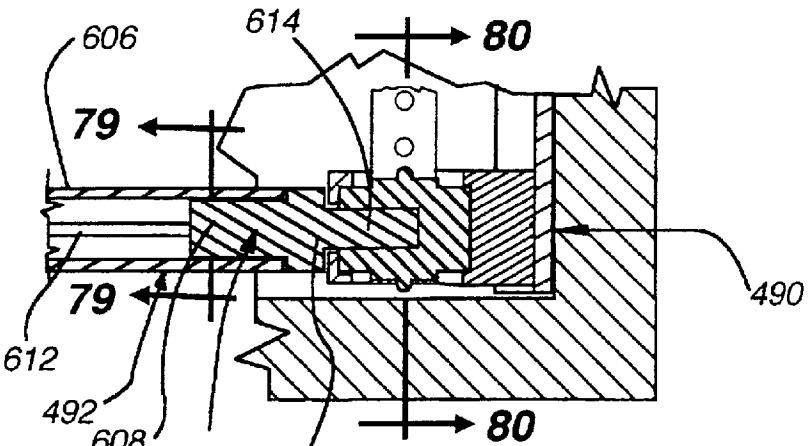
FIG. 78 is a fragmentary section taken along line 78—78 of FIG. 77.
Figure 94:
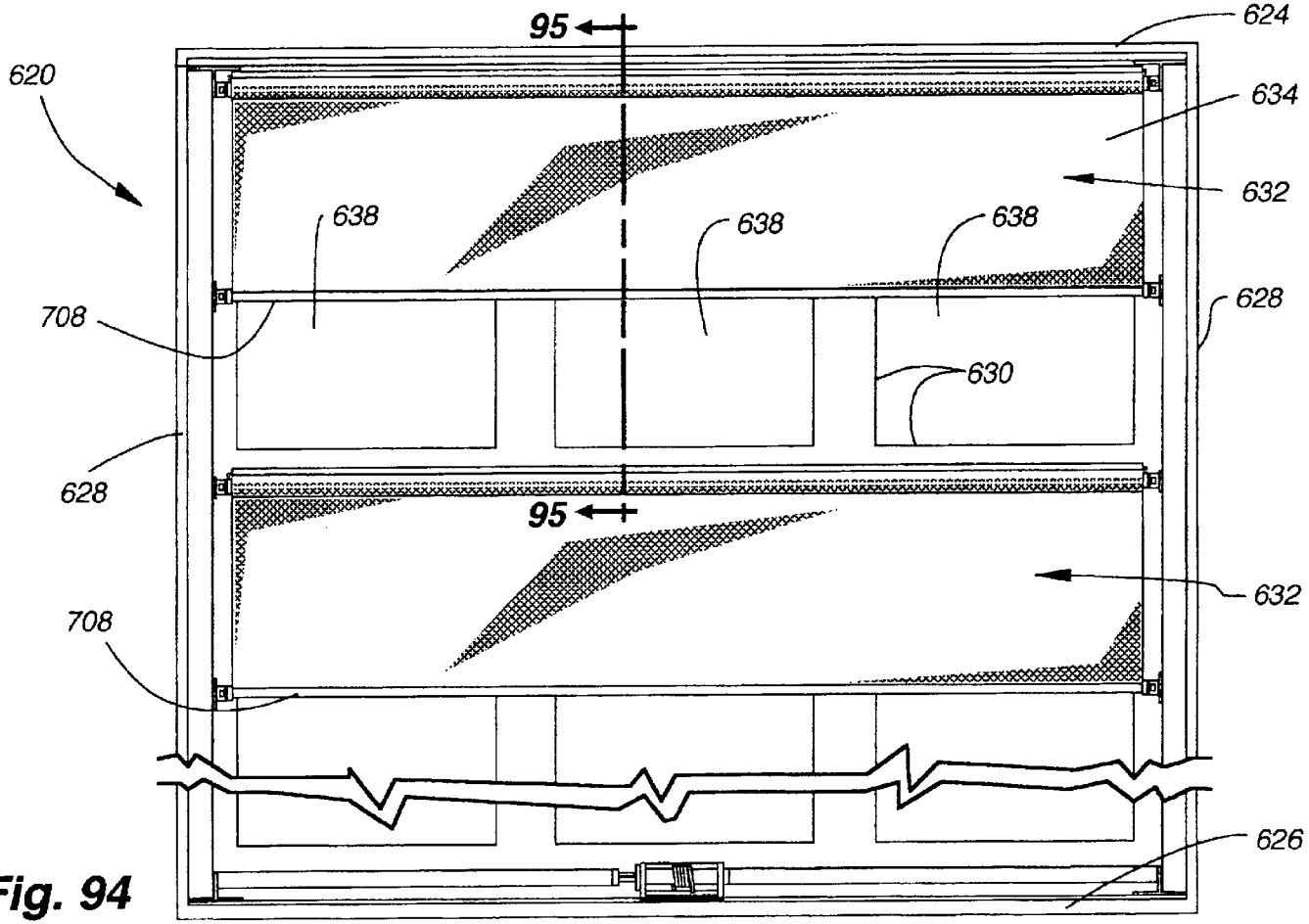
FIG. 94 is an enlarged fragmentary rear elevation of the covering shown in FIG. 93.

The bracket 490 at the bottom of the frame 454 that rotatably supports the lower pulley or roller 516 associated with the drive belt is best seen in FIGS. 65, 77–80, 84, 86B and 86C. The female component 502 of the bracket at the bottom of the frame is identical to the female component 502 of the bracket at the top of the frame and that being the bracket illustrated in FIG. 84. The male component 594, however, is different and is best seen in FIGS. 93 and 94 to comprise a base plate 596 having a pair of arrow-shaped catch arms 598 projecting outwardly toward the female component and adapted to be received in the arrow-shaped slots 508 of the outer arms of the female component. The female component, of course, is again mounted in the channel guide 500 so as to be secured thereto and can be adhesively or otherwise secured in position. A cylindrical opening 600 extends through the base plate of the male connector and as best seen in FIGS. 77, 78, the cylindrical opening is adapted to receive a stub shaft 602 on the end cap 604 of the cylindrical transfer rod 606 that extends across the bottom of the frame within the bottom frame member 460. The stub shaft has a relatively large cylindrical body 608 that is adapted to be received in the open end of the cylindrical transfer rod with the cylindrical body 608 having a longitudinally extending groove (not seen) defined therein. The groove is adapted to receive and, therefore, be keyed to a longitudinal bead 612 in the inner surface of the cylindrical transfer rod so that the transfer rod and stub shaft 602 rotate in unison about the longitudinal axis of the transfer rod. The stub shaft has a smaller portion 614 of octagonal transverse cross-section that cooperates with an octagonal central blind axial opening 616 in the pulley or roller 516. The smaller cylindrical portion 614 of the stub shaft is thereby keyed to the roller when the roller is positioned between the male and female components of the bottom bracket 490, as illustrated in FIG. 78. The bead-type projections on the circumferential surface of the roller are, again, engagable with the holes in the transfer belt 486 to positively drive the belt. It will, therefore, be appreciated that by movement of the finger slide 592 the connected run of the transfer belt is moved upwardly or downwardly and simultaneously rotates the transfer rod at the bottom of the frame so that the belts on both sides of the frame are moved simultaneously and in synchronism.

It will be appreciated from the above that a covering for an architectural opening has been described which can be mounted within an outer framework and is insertable into an architectural opening and secured therein in any suitable manner. When the shade components of the covering are completely retracted, they are hidden behind an associated horizontal muntin and, therefore, concealed from view in one direction. A simple sliding movement of a finger slide over a relatively short distance, i.e., the height of one divided light opening, causes the entire architectural opening to be covered by the plurality of shade components which move synchronisely between retracted and extended positions.

Another embodiment 620 of the covering of the present invention is shown in FIGS. 93–136, and as best seen in FIG. 93, the covering 620 includes an outer framework 622 with top 624 and bottom 626 frame members and left and right side frame members 628 in addition to a plurality of horizontal and vertical cross frame members or muntins 630. The frame supports a plurality of horizontally disposed and vertically spaced shade components 632. As will be described in more detail later, each shade component is in the form of a roll-down shade of the type having a spring biased roller to which a top edge of a curtain in the form of a flexible sheet of material is secured and a bottom edge is secured to a bottom rail that can be pulled downwardly to unroll the flexible sheet material from the roller against the spring bias.

Figure 95:
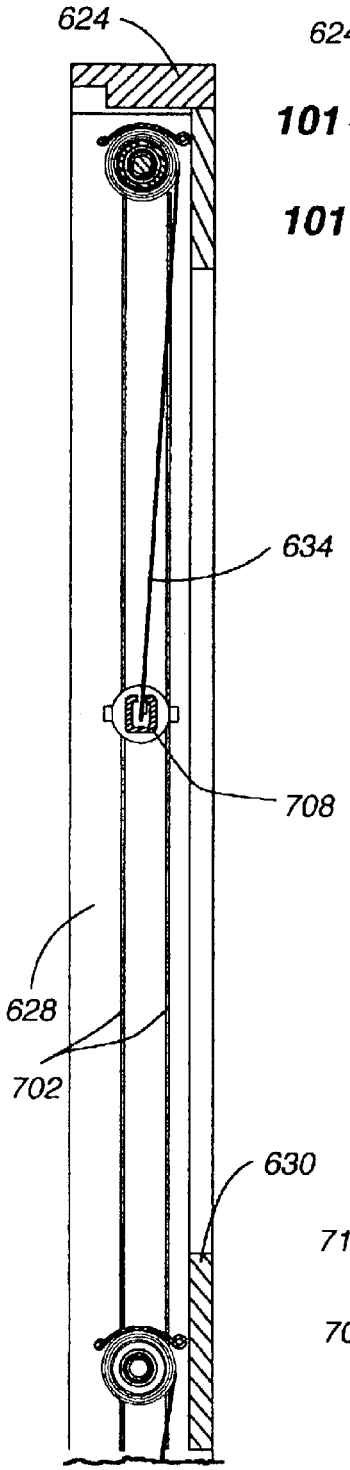
FIG. 95 is an enlarged section taken along line 95—95 of FIG. 94.
Figure 96:
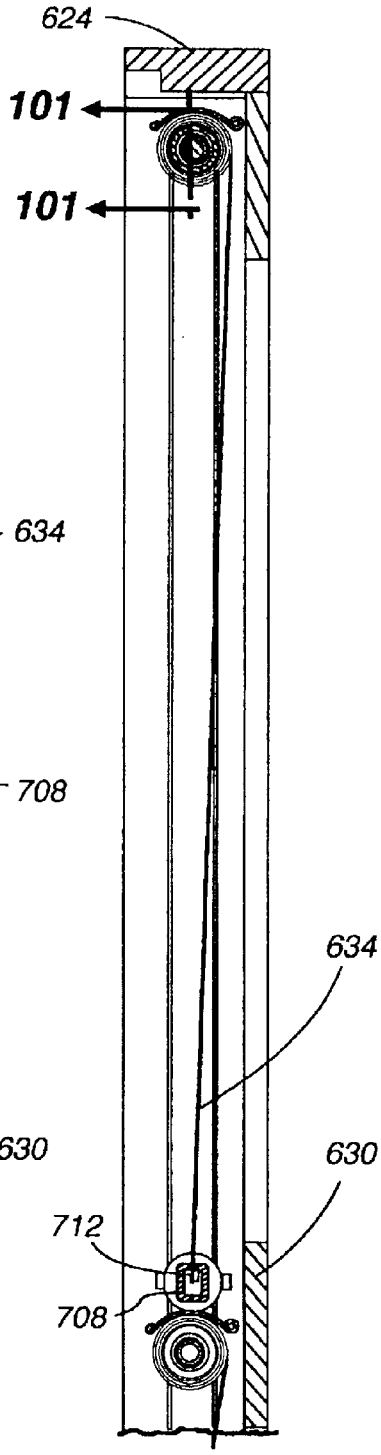
FIG. 96 is a section similar to FIG. 95 with the shade components shown in a fully extended position.
Figure 97:
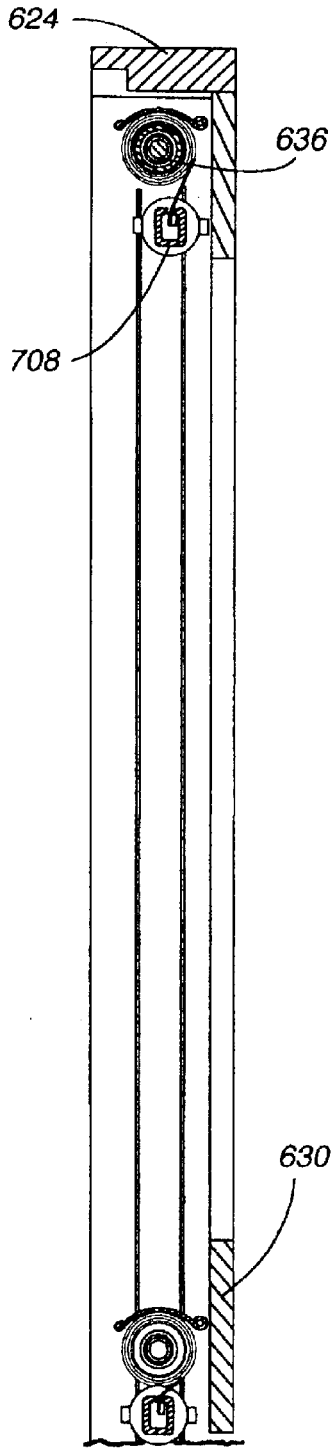
FIG. 97 is a section similar to FIG. 95 with the shade component in a fully retracted position.

The uppermost shade component 632 is shown in several different positions in FIGS. 95–97, with FIG. 97 showing the shade component totally retracted with the flexible sheet material or curtain 634 associated therewith wrapped around its associated roller 636, FIG. 95 showing the shade component in a partially extended position and FIG. 96 with the shade component fully extended across three horizontally aligned divided openings 638 in the frame.

Figures 100, 101, 102, 103, 104:
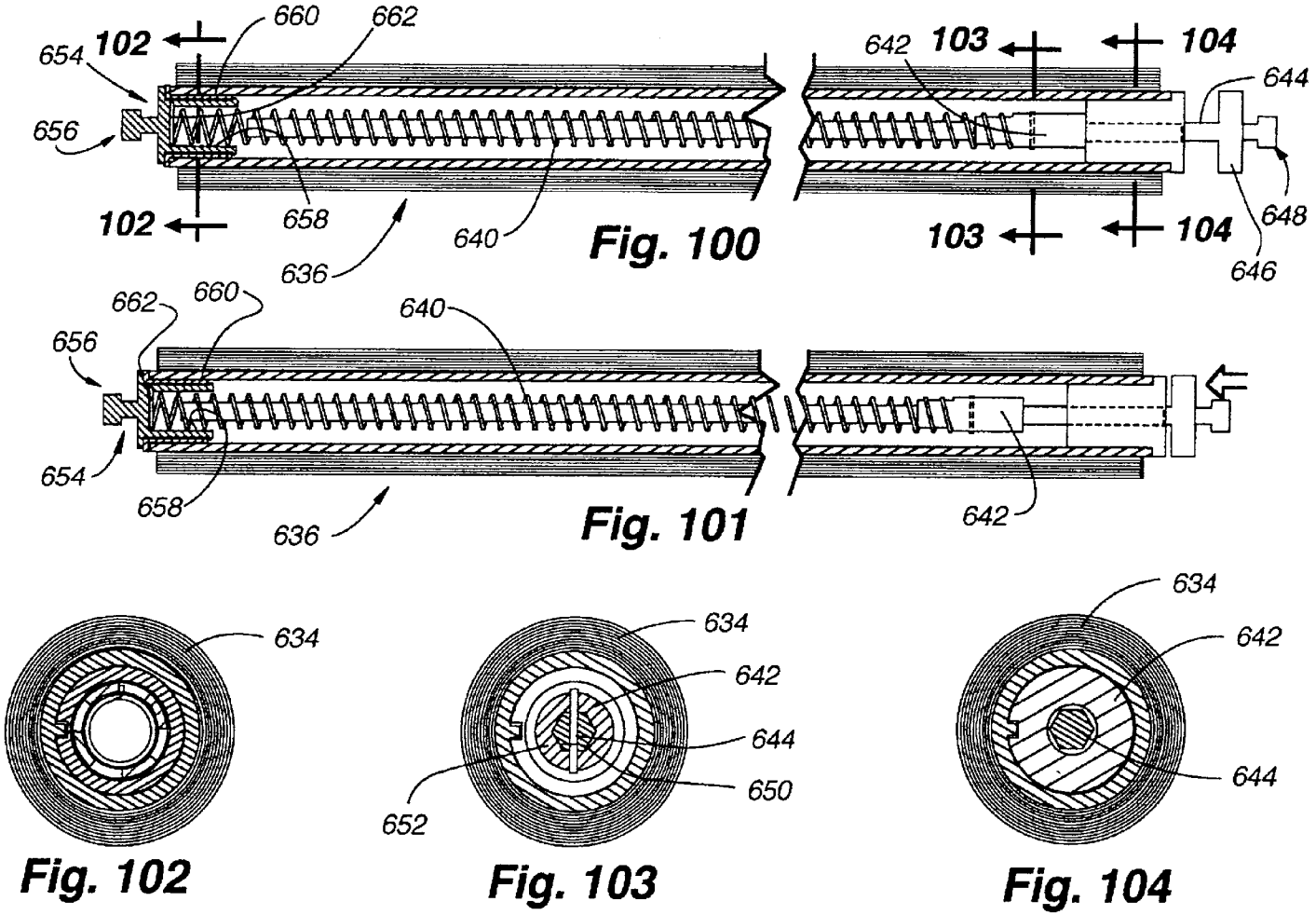
FIG. 100 is a fragmentary longitudinal section taken through a roller on which a flexible curtain is wrapped with the roller being shown in a neutral position.
FIG. 101 is a fragmentary section taken along line 101—101 of FIG. 96 with the roller in a shortened condition which it assumes when mounted in the frame of the covering of FIG. 93.
FIG. 102 is an enlarged section taken along line 102—102 of FIG. 100.
FIG. 103 is an enlarged section taken along line 103—103 of FIG. 100.
FIG. 104 is an enlarged section taken along line 104—104 of FIG. 100.
Figure 106:
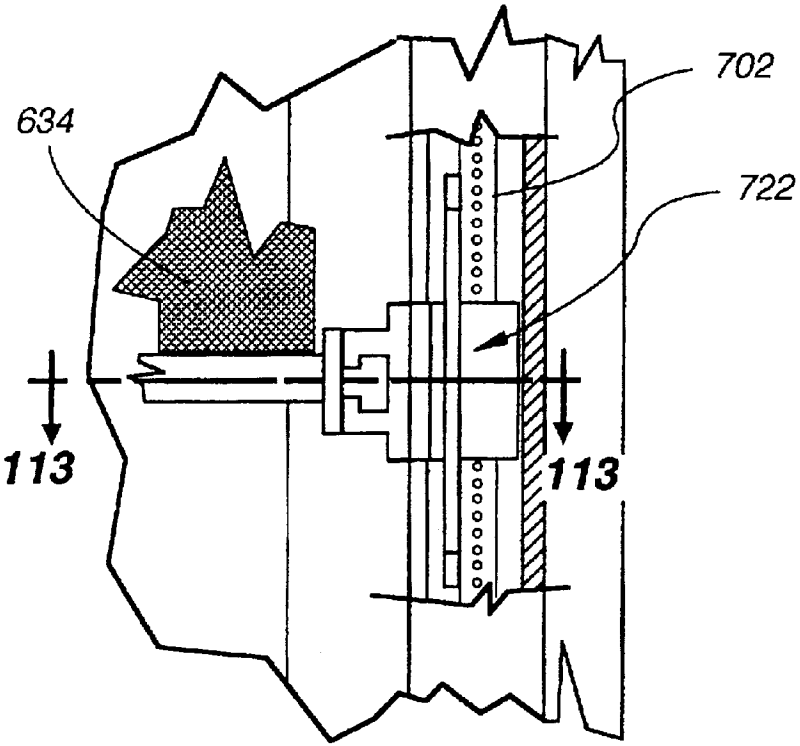
Figure 105:
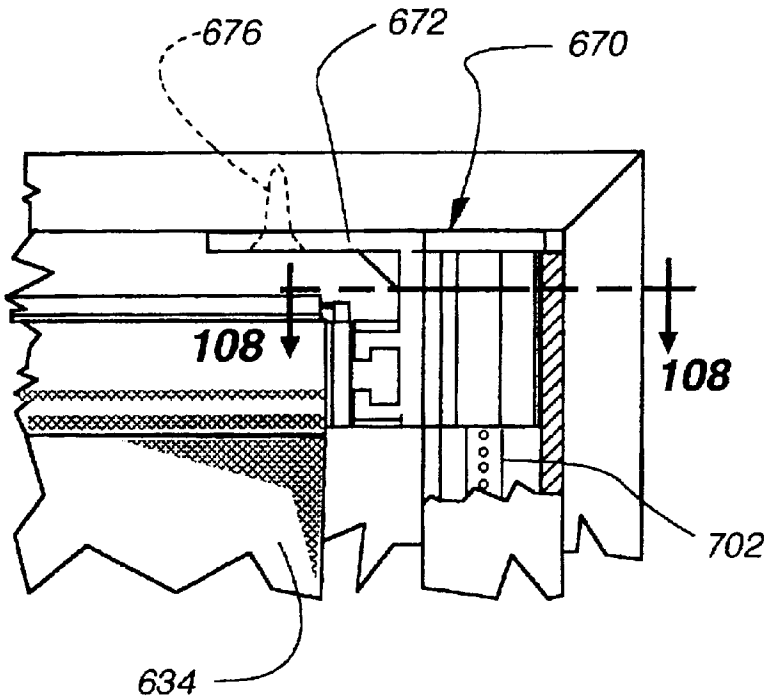

As is probably best seen in FIGS. 100–104, each shade roller 636 includes a cylindrical roll bar 638 to which one edge of the flexible sheet material 634 is secured so as to be wrappable therearound, and a coil spring 640 that also functions as a torsion spring disposed therein. At the right end of each roller, as viewed in FIGS. 100 and 101, the spring is supported on a slide collar 642 that is keyed to a shaft 644 that has on its outermost end a disk-like head 646 that has a three tab releasable mounting system 648 identical to that described previously in regard to the embodiment illustrated in FIGS. 88 and 89. The shaft disc-like head and mounting system constitute an end cap 649 of the roller. The shaft 644 is slidably received in a cylindrical bearing 646 received in the right end of the roll bar with the bearing having a cylindrical passageway 648 therethrough that permits free rotation of the shaft 644 relative thereto. The shaft is of hexagonal transverse cross section and the slide collar 642 has a hexagonal passage 650 therethrough adapted to mate with the shaft to fix the collar relative to the shaft. A transverse pin 652 also extends through the slide collar and the shaft to prevent axial movement. It will, therefore, be appreciated that the collar is fixed both axially and with regard to rotation relative to the shaft. The left end of the roll bar receives an end cap 654 with a three tab mounting system 656 on its outer surface and having an inwardly extending cylindrical sleeve 658 adapted to be received within the open end of the roll bar. A bearing 660 is received in the left end of the roll bar and cooperates with a tong 662 on the end of the spring 640 so that the left end of the spring rotates with the bearing 660 which is fixed to the roll bar so as to rotate with the roll bar. Accordingly, as the roller 636 rotates in one direction, i.e., the direction in which the sheet material is unwrapped therefrom, the left end of the spring is rotated but the right end of the spring remains stationary thereby establishing a torsional bias in the spring biasing the roller toward a position wherein the sheet-like material is fully wrapped thereon. The roller 636 is axially movable as illustrated in FIGS. 100 and 102 between a neutral extended position in FIG. 100, and a depressed position, as shown in FIG. 100 wherein the coil spring 640 is compressed. The position of FIG. 100 is the neutral position of the right end, but for mounting the right end within the frame 622 the shaft 644 at the right end of the roller is depressed into the position of FIG. 101 in which it remains while the roller is inserted into the frame, as will be explained more clearly later.

Figure 99:
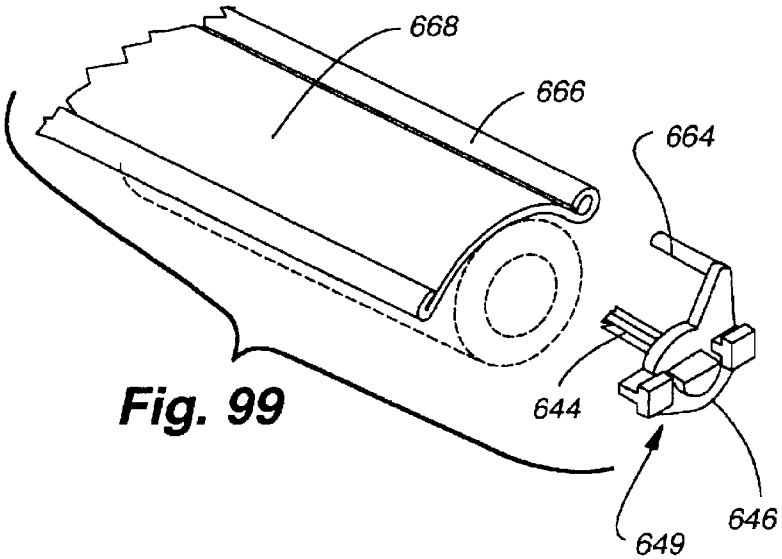
FIG. 99 is a fragmentary isometric similar to FIG. 98 with the end cap exploded from the plate portion of the dust cover and with the roller shown in dashed lines.
Figure 98:
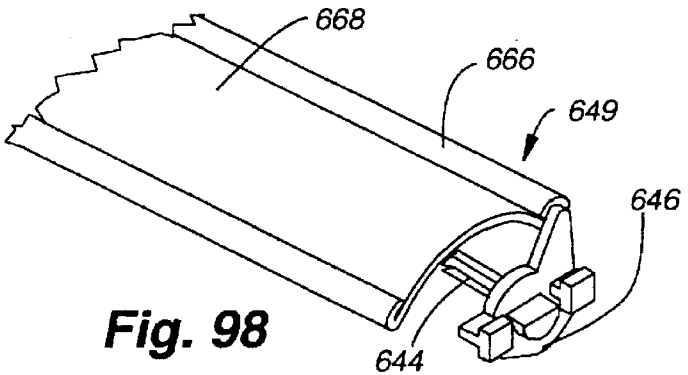
FIG. 98 is a fragmentary isometric showing one end of an end cap and dust cover for a roller used in the covering shown in FIG. 93.

As seen in FIGS. 98 and 99, the end cap 654 and the disc 646 at opposite ends of the roller also have a horizontally protruding cylindrical finger 664 which is insertable into a cylindrical sleeve 666 on a plate like dust cover 668 that extends longitudinally of the roller 636 but at a radial distance from its central longitudinal axis which is greater than the outer wrap of the flexible sheet 634 on the roller. The fingers support the dust cover in a pivotal manner so that the dust cover can simply overlay the wrapped sheet material on the roller but follow the varying radial thickness of the roller as the sheet is rolled or unrolled therefrom.

The roller 636 for the uppermost shade component 632 has its opposite ends supported by identical mounting brackets 670 shown best in FIGS. 105, 108, 110, 128 and 129. In those views, it will be appreciated that the bracket 670 includes a top plate 672 having a screw slot 674 adapted to receive a screw-type fastener 676 to secure the bracket to the top frame member 624 in the associated corner thereof. Depending from the top plate is an outer plate 678 having a pair of vertically extending and outwardly projecting legs 680 and a central hub 682. Spaced inwardly from the outer plate 678 is an inner plate 684 having forwardly and rearwardly directed but vertically extending guide ribs 686. The guide ribs are spaced from another inwardly spaced plate 688 so as to define a pair of vertically extending grooves 690 therebetween. The plate 688 has mounted on its innermost face a pair of vertically spaced horizontally disposed catch plates 690 of the type previously described in connection with the end caps illustrated in FIGS. 88 and 89 of a previous embodiment. Of course, the catch plates are adapted to releasably receive the tabs on the end caps 654 and the disc 646 of the roller in the manner previously described. A generally rectangularly shaped pocket 692 is formed in the top bracket with the pocket opening through the top plate as best seen in FIG. 129. The rectangular pocket has notches 694 formed in inner and outer side walls thereof with the notches being vertically aligned with generally U-shaped grooves 696 formed in the confronting faces of the outer plate 678 and the inner plate 684. The pocket is adapted to removably receive a roller 698 identical to that illustrated in FIG. 81 of a prior embodiment and as will be appreciated, the roller has a pair of axially extending stub shafts 700. The stub shafts are adapted to be rotatably supported in the U-shaped grooves 696, as probably best illustrated in FIG. 110. Accordingly, the roller is rotatably supported within the top bracket 670 in a position to receive a timing or drive belt 702 of the type also described in connection with the previous embodiment shown in FIG. 55 with the timing belt having a plurality of longitudinally spaced holes 704 therein adapted to mate with beads 706 that are circumferentially spaced around the perimeter of the roller 698. The timing belt, as will be described in more detail later, is effectively endless and extends along both the right and left side frame members 628 while passing around rollers 698 at the top and bottom of each side frame member.

Figure 99B:
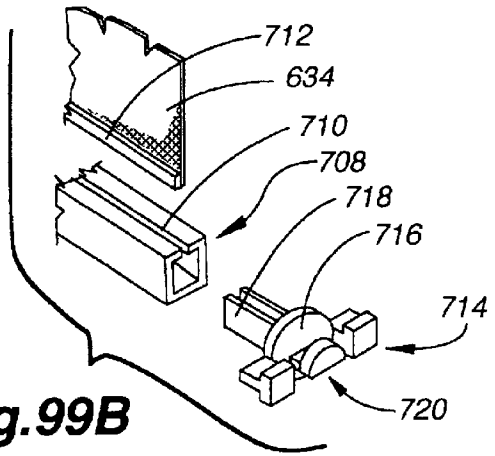
FIG. 99B is an exploded fragmentary isometric corresponding with FIG. 99A.
Figure 99A:
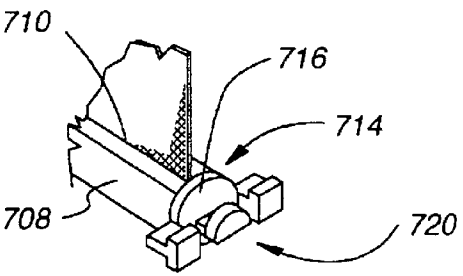
FIG. 99A is a fragmentary isometric showing the end of a bottom rail with an end rap thereon.

The free edge of the sheet of flexible material or curtain 634 wrapped on each roller has a bottom rail 708 secured thereto which, as best seen in FIGS. 95–97 and 106, is a hollow tubular bar of quadrangular cross section. The tubular bar has a slot 710 formed along its length adapted to receive the free edge of the flexible sheet material and a bead of glue or other such means 712 can be FIG. 99B of fixed to the end of the flexible sheet material to retain the edge within the hollow interior of the hollow bar. Each hollow bar has an end cap 714 at opposite ends thereof having a disk-like plate 716 with a square extension 718 therefrom adapted to be frictionally received within the open end of the hollow bar. The outer face of the plate 716 has a set of the three releasable lock tabs 720 of the type previously described in connection with the end caps for the rollers 636. The bottom rails are adapted to be releasably connected to a slide bracket 722 which is probably best illustrated in FIGS. 106, 113, 114 and 117. The slide bracket is adapted to slide vertically within a generally U-shaped channel guide 724 mounted on the inside of each right and left frame member 628 with the U-shaped channel having inturned lips 726 along its innermost open side.

Figure 113:
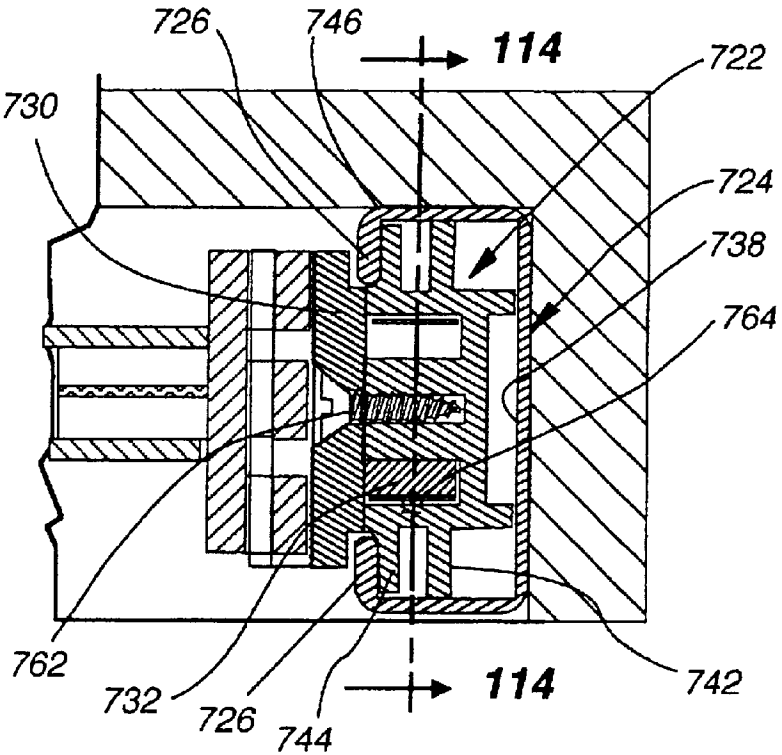
Figure 114:
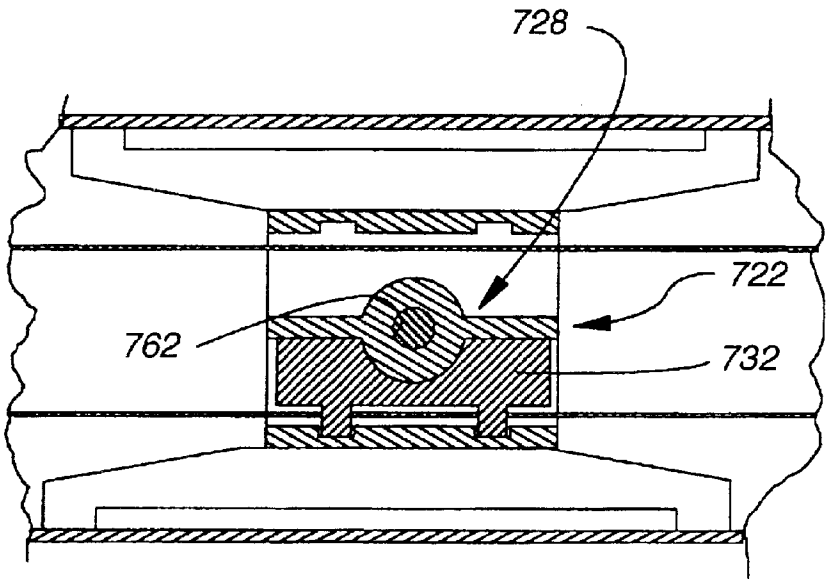

As is probably best seen in FIGS. 130–132, the slide bracket 722 has three component parts, a main body 728 shown in FIG. 132, an inner closure body 730 shown in FIG. 130 and an anchor block 732 shown in FIG. 131. The main body has an outer plate 734 with outwardly directed vertically extending elongated legs 736 along each side edge adapted to slidingly engage the inner surface of the outer wall 738 of the channel guide as seen in FIG. 113. The bracket also includes two side walls 740 that are integral with forwardly and rearwardly extending side slide arms 742 and also forwardly and rearwardly extending guide plates 744. The outer edges of the slide arms are adapted to slidingly engage side walls 746 of the channel guide and the guide plates are adapted to engage the inturned lips 726 of the channel guide so that the main body 728 of the slide member is disposed for vertical and guided sliding movement along the length of the channel guide. The main body further includes a central hub 748 with a blind hole 750 therein that opens inwardly. Vertical extension plates or gussets 752 extend upwardly and downwardly from the central hub and cooperate with the hub in defining a pair of vertically extending open channels 754 between the hub and the side walls 746. These open channels are adapted to receive the two vertically extending runs of the endless timing belt 702, as will be described in more clarity later.

The inner closure body 730 of the slide bracket has a base plate 756 with a central opening 758 therethrough and a pair of horizontally disposed and vertically spaced catch plates 760 on its innermost surface which function as previously described to releasably receive in a snap-like manner the tabs 720 on the end caps 714 of the bottom rails 708 of each shade component. The inner closure body is secured to the main body 728 of the slide member with a threaded screw-type fastener 762 which extends through the opening in the base plate 756 of the closure body and into the blind hole 750 in the main body. Before securing the closure body to the main body, however, the anchor block 732 as shown in FIG. 131 is positioned in one of the channels 754. The anchor block, as probably best seen in FIG. 113, has a pair of protruding pins 764 adapted to extend through holes in the timing belt and into recesses in the associated side wall 740 of the main body to secure the slide bracket to the timing belt for unitary movement therewith. The anchor block was previously illustrated in FIG. 85 in connection with another embodiment of the present invention and described therewith.

It will, therefore, be appreciated that the slide bracket 722 is adapted to be secured to the timing belt and be reciprocally moved with one vertical run of the timing belt within the channel guide. The slide bracket of course, is connected to an associated end of the bottom rail so that the bottom rail 708 can be moved downwardly from the its associated roller thereby extending the flexible curtain or sheet of material 634 by movement of the timing belt in a direction that causes the slide bracket to move downwardly. Of course, an opposite movement of the timing belt causes the slide bracket to move upwardly thereby moving the bottom rail of a shade component upwardly toward its associated roller allowing the flexible sheet of material to wrap around the roller.

The right side frame member 628 of the frame has a vertical slot 766 (FIGS. 93 and 117) formed therein and the slide bracket that is associated with the shade component aligned with the slot 766 is formed slightly differently than the slide bracket 722 associated with the other shade components. With reference to FIG. 93, it will be appreciated that there are five vertically aligned shade components 632 in the covering so that the two uppermost shade components and the two lowermost shade components would have a slide bracket 722 as previously described. The slide bracket 768 associated with the middle shade component, however, would have a closure body 770, as illustrated in FIG. 123, which is identical to the previously described closure body illustrated in FIG. 130 except that it has an integral extension 772 from a base plate 774 that protrudes outwardly through the slot in the right side frame member. The edges of the extension 772 at the end thereof are serrated at 776 to receive a manually-operated finger slide cap 778, which is probably best seen in FIGS. 118 and 124–127. As illustrated in FIG. 118, the finger slide cap has a base component 780 shown in FIGS. 124 and 125 that is press-fit onto the end of the extension so as to cooperate with the serrated edges 776 of the closure body so that the base component is securely positioned and attached thereto. The base component has a hub 782 with a horizontal passageway therethrough that is adapted to pivotally support a pivot arm component 784 of the finger slide cap. The pivot arm, which is shown in FIGS. 118, 126 and 127, is pivoted on the hub by a pivot pin 786 so that the arm can be swung inwardly or outwardly as desired. When the arm is swung outwardly into the dashed line position of FIG. 118, it is easy to grasp by an operator of the covering and when it is folded inwardly into the full line position of FIG. 118, it does not protrude undesirably from an aesthetic standpoint. Both the pivot arm and the base component of the finger slide are contoured so as to compliment each other and give a smooth exterior look.

Figure 107:
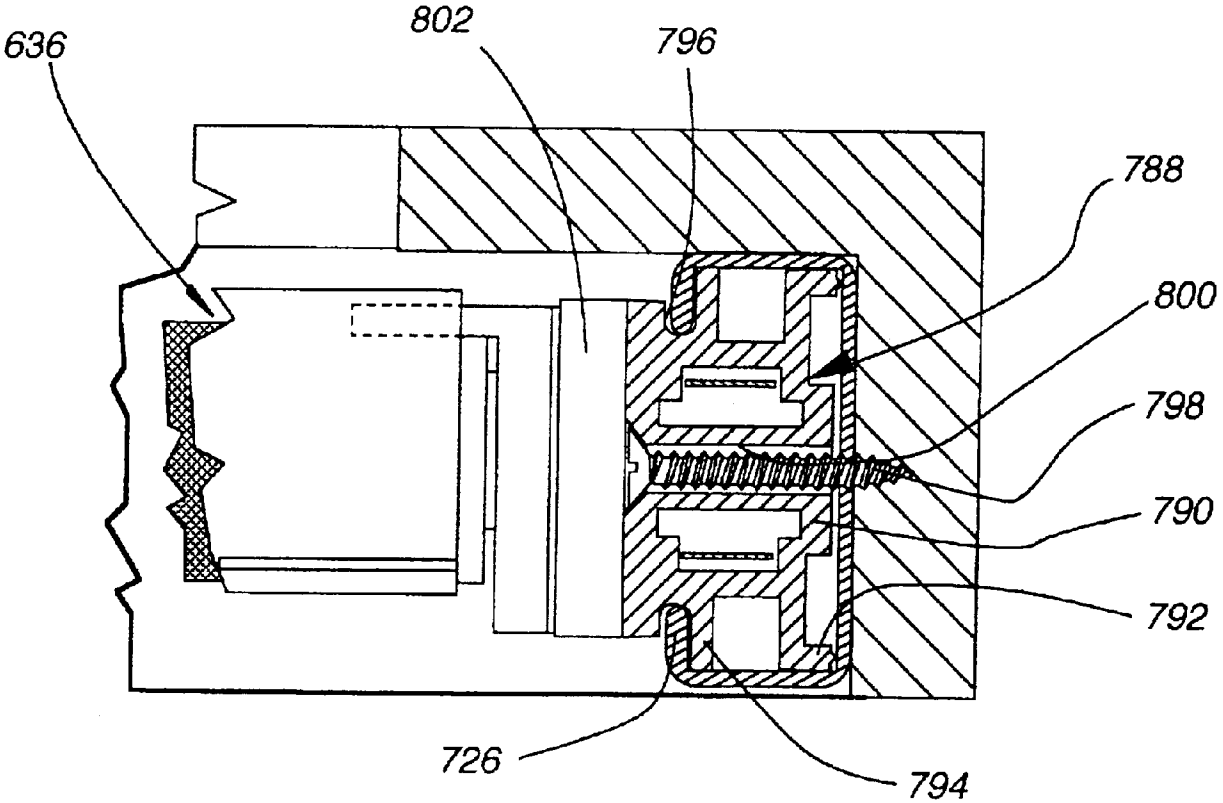
Figure 110:
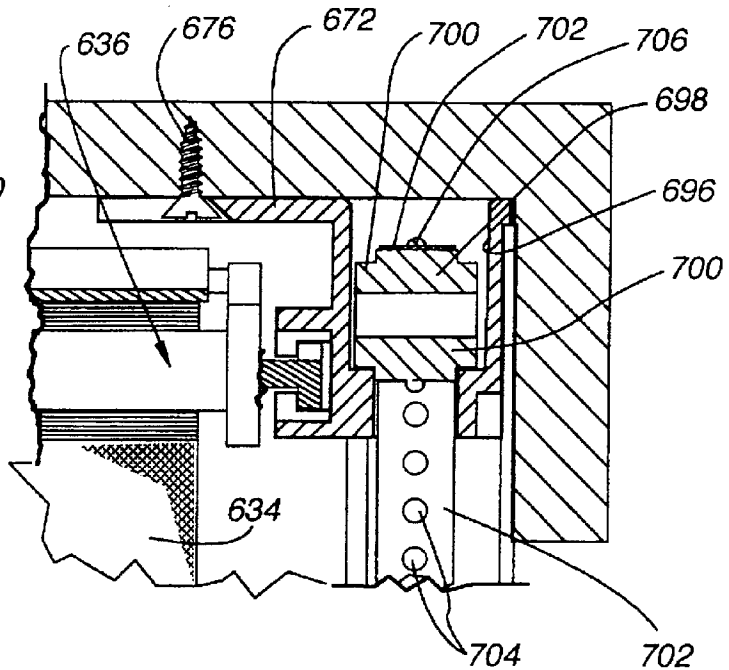
Figure 108:
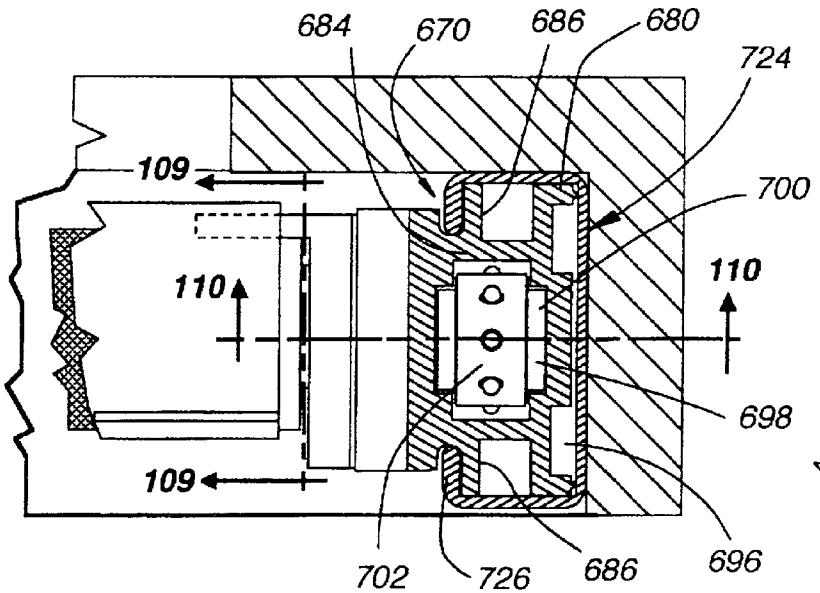
Figure 109:
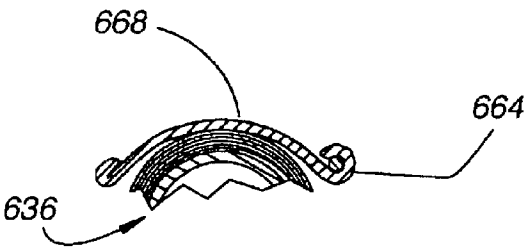
Figure 112:
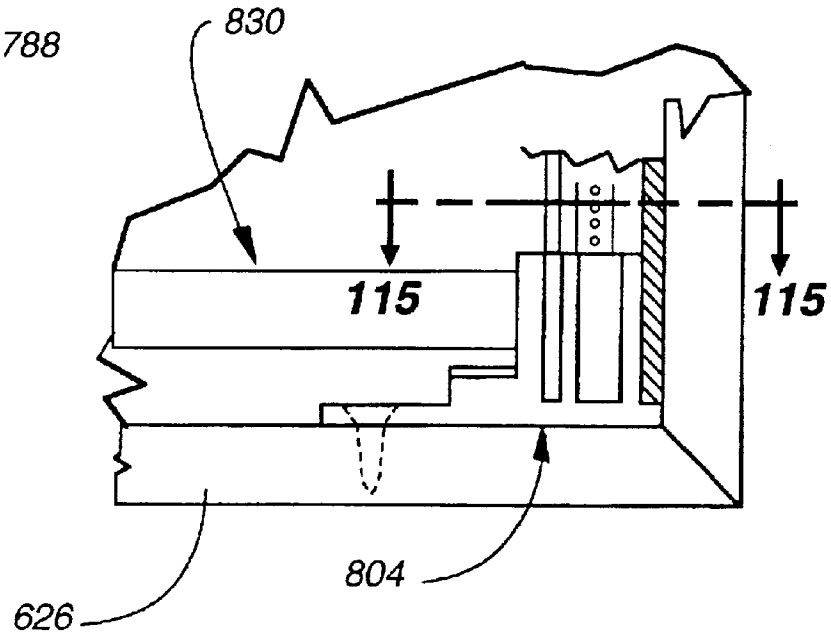
Figure 111:
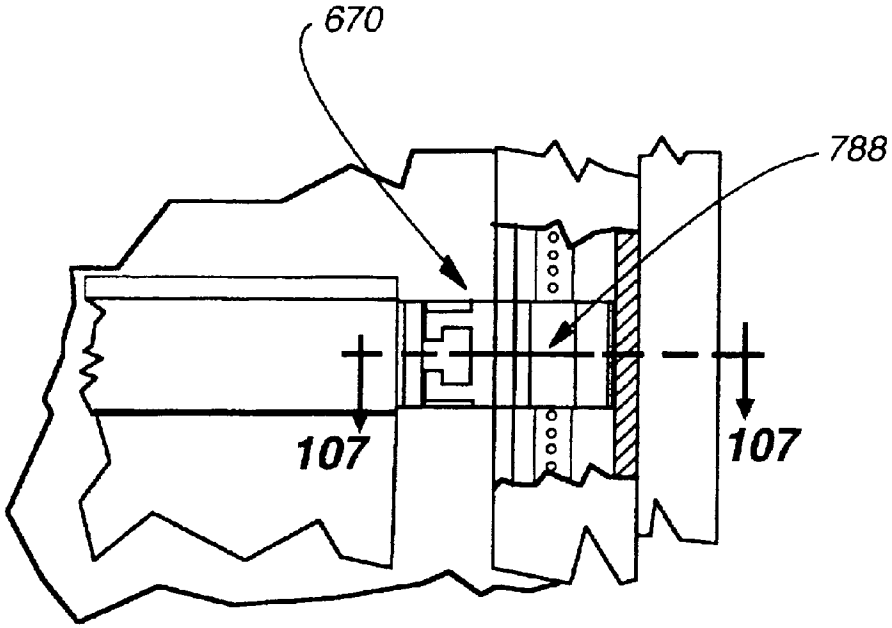

Each roller 636 of a shade component 632, with the exception of the uppermost roller which is mounted as previously described, is mounted on a fixed bracket 788 that is best seen in FIGS. 107, 111 and 129A. The bracket is a single piece bracket having an outer plate 790 with vertically extending guide fingers 792 adapted to engage the inner surface of the outer wall 738 of the channel guide 724 and vertically extending guide plates 794 adapted to engage the inturned lips 726 with the inturned lips being received in vertical grooves 796 formed in the bracket. As is probably best seen in FIG. 107, the bracket is, therefore, disposed for positive positioning within the channel guide and is anchored to the channel guide and the associated side frame member with a screw-type fastener 798 that passes through a passage 800 in the center of the bracket. The innermost face of the bracket has a pair of catch plates 802 identical to those previously described that are adapted to releasably receive in a snap-lock manner the tabs on the end cap of the associated roller.

Figure 116:
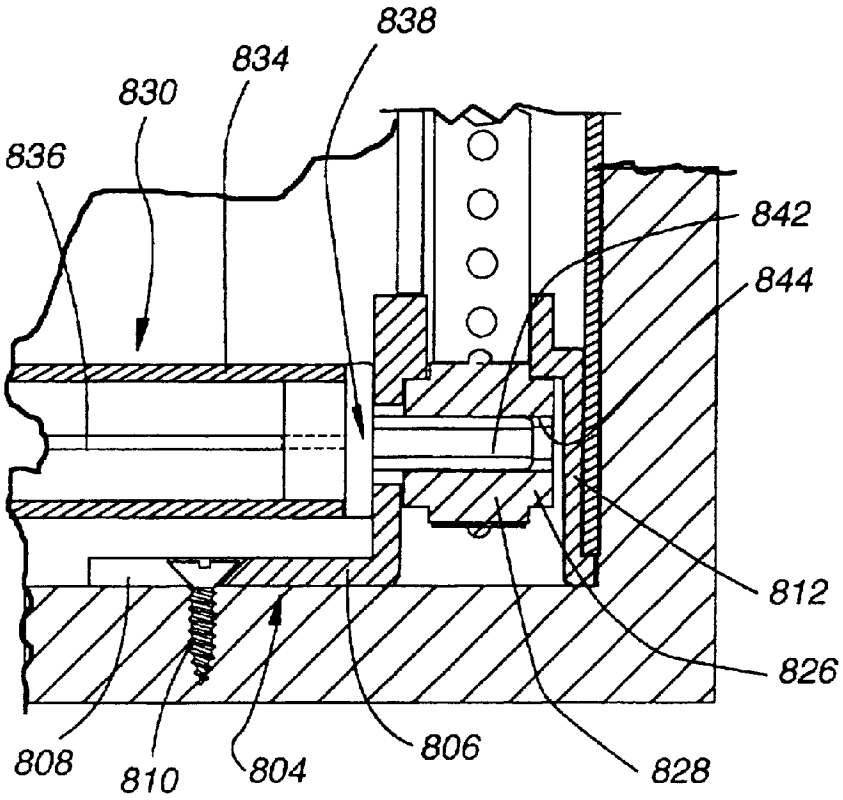
Figure 115:
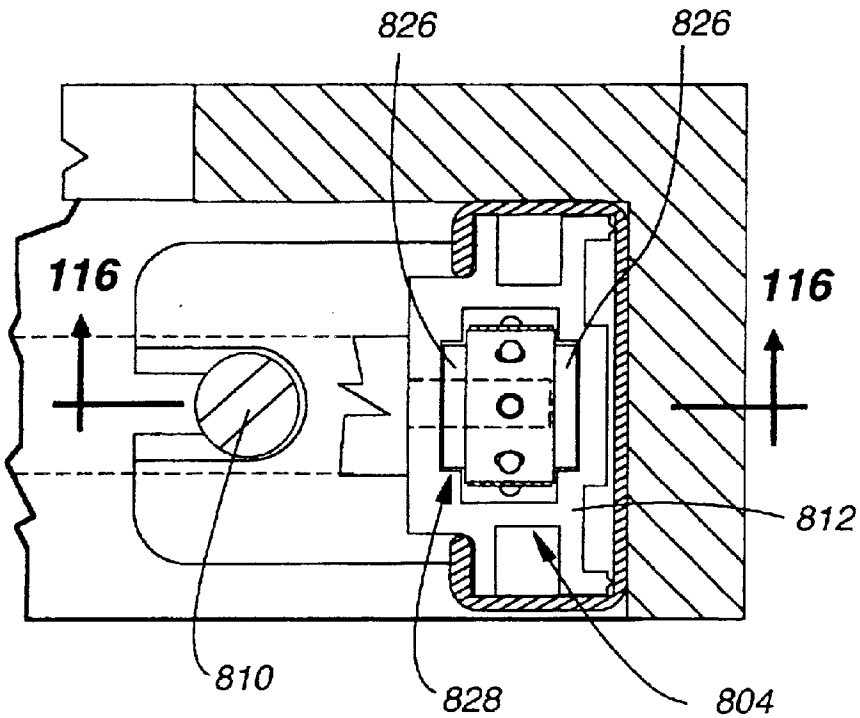

The bottom bracket 804 associated with the left and right side frame members 628 is probably best illustrated in FIGS. 112, 115, 116, 133 and 134. The bracket is also designed to fit snugly within the vertical channel guide 724 and has a bottom plate 806 with a screw slot 808 adapted to receive a fastener 810 that can be anchored in the bottom frame member 626 as seen in FIG. 116. The bottom bracket has an outer plate 812 with outwardly projecting fingers 814 that engage the inner surface of the outer wall 738 of the channel guide and forwardly and rearwardly directed guide plates 816 that engage the inturned lips 726 of the channel guide with the guide plates defining groove 818 therein adapted to receive the inturned lips of the channel guide. The bottom plate projects slightly beyond the fingers 814 on the outer plate 812 so as to underlie the bottom edge of the channel guide thereby cooperating with the screw-type fastener to hold the bracket in position. The bracket defines a downwardly opening pocket 820 that opens through the base plate. The pocket is generally rectangular in cross section having recesses 822 formed in inner and outer sides thereof that are aligned with generally U-shaped channels 824 adapted to receive the stub shafts 826 on a roller 828 of the type illustrated in FIG. 81 in connection with a different embodiment of the present invention. The roller is adapted to engage the timing belt and is confined within the bottom bracket by the U-shaped grooves and their cooperation with the stub shafts on the roller.

The bottom brackets 804 are also adapted to support a transfer rod 830 that is confined within the bottom frame member 626 and extends horizontally across the base of the frame. The transfer rod has several component parts as best illustrated in FIGS. 116, 119–122, 135 and 136. The transfer rod includes left 832 and right 834 hollow cylindrical members having a longitudinally extending internally disposed key 836 formed therein. The open right end of the right cylindrical member 834 and the open left end of the left cylindrical member 832 receive end caps 838 that protrude into the associated open ends and have a groove 840 that is keyed to the key 836 of the associated cylindrical member. The end caps also have an axially and outwardly extending hexagonal shaft 842 that is mated with a hexagonal axial passageway 844 through the roller 828 mounted in the pocket 820 of the associated bottom bracket. Rotational movement of the roller thereby rotates the shaft on the end cap and also the associated cylindrical member connected thereto. The inner ends of each cylindrical member are spaced adjacent the center of the bottom frame member 626 and are connected by a braking system. The braking system includes an outer sleeve 846 shown in FIG. 136 that is rotatably mounted in U-shaped grooves 848 in a saddle bracket 850 anchored to the bottom frame member. The left end of the sleeve has an enlarged disk-like cap 852 adapted to engage the outer surface of the saddle and a blind axial hole 854 is provided in the left end of the sleeve that is of generally star-shaped cross section. The blind hole is adapted to receive the shank 856 of a support shaft 858 that has a mating star-shaped cross section so that the two pieces rotate in unison. The opposite end 859 of the support shaft is solid and fits in the open inner end of the left cylindrical member 832 and has a groove 860 formed therein adapted to receive the key 836 in the cylindrical member so that the cylindrical member also rotates in unison with the shaft 858 and the sleeve 846. The right end of the sleeve has a projection 862 of reduced diameter adapted to be received within the open end of the right cylindrical member and the reduced diameter portion has a groove 864 formed therein adapted to receive the key 836 in the right cylindrical member. An internal partition 866 is formed in the sleeve which is spaced from the end of the shank 856 of the shaft to define a cavity 868. A compression spring 870 is positioned in the cavity to bias the shaft 858 outwardly or to the left as viewed in FIG. 120. The spring is provided for assembly purposes so that the hexagonal shafts at opposite ends of the transfer rod can be inserted into the associated rollers by shortening the length of the transfer rod against the bias of the compression spring until the rod is aligned with the rollers in each of the bottom brackets, and at that point the rod is released and the compression spring forces the shaft into a longer length so as to be suitably received in each of the associated rollers.

A two-way spring lock 872 circumscribes the sleeve 846 within the saddle bracket 850 and is adapted to cooperate with a longitudinally extending rib 874 provided on a bottom wall of the saddle bracket to selectively prevent or permit rotation of the rod. The spring lock is a conventional spring clutch or break that has a tong 876 projecting downwardly at opposite ends of the spring that cooperate with the rib 874. One tong is inclined slightly in one direction and the other tong is inclined slightly in the opposite direction so that they lie on opposite sides of the rib. When the transfer rod is rotated in one direction or the other, one of the tongs engages the rib thereby causing the spring to slightly expand from its neutral gripping relationship with the sleeve so that the transfer rod can rotate freely relative thereto. When rotation is ceased, however, the tongs are no longer engaged with the rib and the spring clutch contracts in diameter to grip the outer surface of the sleeve to prevent rotation of the transfer rod.

The spring clutch thereby functions to hold the shade components in any predetermined position since advancement of a bottom rail downwardly by the finger slide causes the torsion springs 640 within each roller 636 of a shade component 632 to become biased thereby urging the shade components toward a retracted position. Since movement of the slide member is governed by the timing belt, which is also keyed to the transfer rod, once movement of the finger slide is terminated, the spring clutch will prevent the torsion springs in each roller from returning the associated shade component to the retracted position until an operator moves the finger slide upwardly thereby causing the spring brake to release the transfer rod and allow the shade components to retract.

It will be appreciated from the descriptions of the various embodiments of the present invention that a unique covering for an architectural opening has been described and wherein one or more shade components can be utilized to cover selected portions of an architectural opening, such as of the type divided into a plurality of panels by muntins. It will further be appreciated that the entire architectural opening can be covered with a very short stroke of the finger slide which is far less than the entire dimension of the opening defined by the direction of movement of the shade components. It will be appreciated that the shade components can be mounted horizontally as illustrated or vertically and still perform the desired function of selectively covering portions of the architectural openings with individual shade components. It will also be appreciated that the shade components could be inverted so that the roller in each shade component moved up and down while the bottom rail (which would then be on the top) was fixed. Further, with minor modifications within the skill of those in the art, the shade components could be mounted so that they extended upwardly and retracted downwardly as opposed to the reverse which has been described above. This would also be true for other embodiments of the present invention described previously.

Although the present invention has been described with a certain degree of particularity, it is understood that the present disclosure has been made by way of example, and changes in detail or structure may be made without departing from the spirit of the invention as defined in the appended claims.

What is claimed is:

1. A covering for an architectural opening comprising in combination: an outer frame extending along at least some of the perimeter of said opening, a plurality of roll up shade components disposed in parallel relationship having a roller at the top thereof, a bottom rail and a curtain of material secured thereto for movement between extended and retracted positions, one of said roller and bottom rail being fixed to said frame and the other being movable, the movable ones of said rollers and rails being connected to a common transfer member, and a manually operable slide member operably connected to said transfer member and protruding through said outer frame for moving said transfer member to effect simultaneous and synchronized movement of the movable ones of said rollers and rails toward and away from said fixed ones.

2. The covering of claim 1 wherein said fixed ones of said rollers and rails are removably fixed to said frame and said movable ones of said rollers and rails are removably connected to said transfer member such that each shade component is replaceable independently of the other shade components.

3. The covering of claim 2 wherein said transfer member is an endless belt.

4. The covering of claim 3 wherein said endless belt, the fixing of the fixed ones of said rollers and rails to the frame, the connection of the movable ones of said rollers and rails to the endless belt and a portion of said slide member are concealed within said outer frame.

5. The covering of claim 2 further including snap-on connectors for achieving said removable fixation of the fixed ones of said rollers and rails and the removable connection of the movable ones of said rollers and rails.

6. The covering of claim 4 further including a plurality of parallel cross-frame members connected to said outer frame at spaced locations and wherein said fixed ones of said rollers and rails are positioned adjacent to an associated cross-frame member so as to be hidden from view when viewed from a predetermined direction.

7. The covering of claim 6 wherein said top rail, bottom rail and curtain are all positioned adjacent to an associated cross-frame member when the associated shade component is fully retracted such that the roller, bottom rail and curtain are hidden from view when viewed from said predetermined direction.

8. The covering of claim 7 wherein said cross-frame member is horizontally oriented.

* * * * *